United States Patent [19]

Nishimori et al.

[11] Patent Number: 5,041,874

[45] Date of Patent: Aug. 20, 1991

[54] IMAGE DUPLICATING APPARATUS HAVING CHANGEABLE DOCUMENT SCANNING MODES

[75] Inventors: Kadotaro Nishimori; Masazumi Ito; Kimihiko Higashio, all of Osaka, Japan

[73] Assignee: Minolta Camera Kabushiki Kaisha, Osaka, Japan

[21] Appl. No.: 429,962

[22] Filed: Oct. 30, 1989

[30] Foreign Application Priority Data

Oct. 28, 1988 [JP] Japan ..... 63-274304
Mar. 31, 1989 [JP] Japan ..... 1-82201

[51] Int. Cl.[5] ..... G03G 21/00

[52] U.S. Cl. ..... 355/233; 271/3.1; 355/243; 355/313; 355/314; 355/319; 355/323

[58] Field of Search ..... 355/204, 205, 206, 207, 355/208, 232, 233, 243, 313, 314, 319, 320; 271/3.1

[56] References Cited

U.S. PATENT DOCUMENTS

| | | | |
|---|---|---|---|
| 4,057,341 | 11/1977 | Sohm | 355/234 |
| 4,169,674 | 10/1979 | Russel | 355/309 |
| 4,468,114 | 8/1984 | Pels | 355/313 |
| 4,537,497 | 8/1985 | Masuda | 355/313 |
| 4,814,824 | 3/1989 | Ito et al. | 355/314 |
| 4,866,484 | 9/1989 | Murai | 355/235 |

*Primary Examiner*—A. T. Grimley

*Assistant Examiner*—J. E. Barlow

*Attorney, Agent, or Firm*—Burns, Doane, Swecker & Mathis

[57] ABSTRACT

A scan-mode changeable image duplicating apparatus having operational parameters and modes of operation and operative to duplicate a document in accordance with selected ones of the operational parameters and modes of operation, including a recirculating document feeder unit having a document storage tray and a passageway through which a document is to be withdrawn from the tray and returned to the tray by way of an exposure position in which the document is to be scanned, a scanning unit for scanning a document in the exposure position, the scanning unit being movable back and forth with respect to the exposure position, a control system for controlling the document feeder unit and the scanning unit to operate either in a scanner-moved scanning mode in which the scanning unit is driven to move with respect to the exposure position to scan a document fixedly held in the exposure position and a document-moved scanning mode in which the scanning unit is fixed with respect to the exposure position and scans a document being moved with respect to the exposure position, and keys for entering desired ones of the operational parameters and the modes of operation for automatically selecting the scanning mode in which the control system is to control the document feeder unit and the scanning unit.

7 Claims, 66 Drawing Sheets

IMAGE DUPLICATING APPARATUS HAVING CHANGEABLE DOCUMENT SCANNING MODES

FIELD OF THE INVENTION

The present invention relates to an image duplicating apparatus having changeable document scanning modes and, more particularly, to an image duplicating apparatus of the type which allows the user to select either a document-moved scanning mode or an scanner-moved scanning mode.

BACKGROUND OF THE INVENTION

An image duplicating apparatus is known in which the document to be duplicated is scanned by the movable units of the optical system driven for movement with respect to the document which is fixedly held in place. This mode of scanning a document in an image duplicating apparatus is herein referred to as scanner-moved scanning mode. Also known is an image duplicating apparatus in which the document to be duplicating is scanned by the optical system while the document is being moved with respect to the optical system which fixedly held in place. This mode of scanning a document in an image duplicating apparatus is herein referred to as document-moved scanning mode. The present invention is concerned with an image duplicating apparatus which has both the scanner-moved scanning mode and the document-moved scanning mode and which allows the user to select either of the two different scanning modes.

The document-moved scanning mode is advantageous over the scanner-moved scanning mode in that the period of time required for the duplication of especially a large number of documents since there is no period of time required for the movement of the optical scanner units and the plurality of documents can be duplicated successively. In the document-moved scanning mode, a document is scanned while the document is being conveyed on the document support table by means of an endless drive belt. Due to the sliding friction thus produced between the document and the document support table, the endless belt tends to slide on the document sliding on the table. This results in an irregularity in the speed of movement of the document on the table and may thus cause a failure in achieving strict synchronism between the scanning speed and the speeds at which various active units and members of the apparatus are to operate. Such active units and members include the photosensitive drum and the rollers for feeding print sheets to the drum. The document-moved scanning mode is in this respect lower in performance reliability than the scanner-moved scanning mode.

On the other hand, when a document is to be duplicated to a reduced or magnified scale in the document-moved scanning mode, it is required that the speed at which the document transport belt be controlled to vary in accordance with the desired reduction or magnification ratio. Intricate techniques and control devices, which are usually low in reliability, are however necessitated for this purpose and, accordingly, it is ordinarily not desirable to vary the reduction/magnification ratio during document-moved scanning mode of operation.

The scanner-moved mode of scanning is thus more reliable in performance and more adapted for controlling the reduction/magnification ratio than the document-moved mode of scanning but has a problem when it is desired that a plurality of sets of printed outputs are to be produced each from a plurality of documents and assorted each in a sequence identical to that of the documents where a page sortor unit is not available. When such a page sorting mode is selected for collecting printed outputs, the apparatus is required to repeat cycles of operation each for feeding a document to the document support table, correctly positioning the document on the table, withdrawing the document from the table on termination of the scanning operation, and feeding a new document to the table. Such cycles of operation require to be performed in a number of times equal to the number of the documents multiplied by the desired number of the printed outputs to be produced for each of the documents. An extremely large amount of time is thus required for executing the scanner-moved scanning mode when the sorting mode is selected. This means that it will be scanning mode when the sorting mode is selected.

Thus, the document-moved scanning mode has advantages over the scanner-moved scanning mode and vice versa. The fact is however that most of the users of an image duplicating apparatus having the document-moved and scanner-moved modes would not be able to utilize the apparatus with adequate appreciation of the advantages of each mode. It is quite likely that the user of the apparatus selects the improper one of the modes for the duplicating operation under desired conditions and enables the apparatus to produce printed outputs of satisfactory quality in a short period of time.

SUMMARY OF THE INVENTION

It is, accordingly, an important object of the present invention to provide an improved scan-mode changeable image duplicating apparatus which is capable of automatically selecting one of the document-moved scanning mode and document-moved scanning mode depending on the modes and parameters of copying operation selected by the user. The modes of copying operation herein referred to include the simultaneous multi-color copying mode, automatic magnification selecting mode (AMS mode), automatic print-sheet selecting mode (APS), double-faced document copying mode, two-in-one copying mode, book document copying mode, duplex/composite copying mode, and manually sheet supplied copying mode. Furthermore, the parameters which may be selected by the user include the quantity of the printed outputs to be produced for each document, and the reduction/magnification ratio (hereinafter referred to as R/M ratio).

In accordance with an outstanding of the present invention, there is provided a scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in the exposure position, the scanning means being movable back and forth with respect to the exposure position, c) control means for controlling the recirculating document handling means and the scanning means to operate either in a scanner-moved scanning mode in which the scanning means is driven to move with respect to the exposure position to scan a document fixedly held in the exposure position and a document-moved scanning mode in which the scanning means is fixed with respect to the exposure position and scans a document being moved with respect to the exposure position, d) input means for entering desired ones of the operational parameters and the modes of operation, and e) selecting means responsive to the operational parameters and modes of operation entered by the input means for automatically selecting the scanning mode in which the control means is to control the recirculating document handling means and the scanning means.

BRIEF DESCRIPTION OF THE ACCOMPANYING DRAWINGS

The features and advantages of an image duplicating apparatus according to the present invention will be more clearly understood from the following description taken in conjunction with the accompanying drawings in which:

FIGS. 17A to 17K are schematic front elevation views of the recirculating document feeder unit of the second preferred embodiment of the present invention in scanner-moved and document-moved mode operating conditions;

PREFERRED EMBODIMENTS OF THE INVENTION

FIRST PREFERRED EMBODIMENT

Description will be hereinafter made with reference to FIGS. 1A and 1B regarding the general mechanical construction and arrangement of a first preferred embodiment of a scan-mode changeable image duplicating apparatus according to the present invention.

Figure 1A:
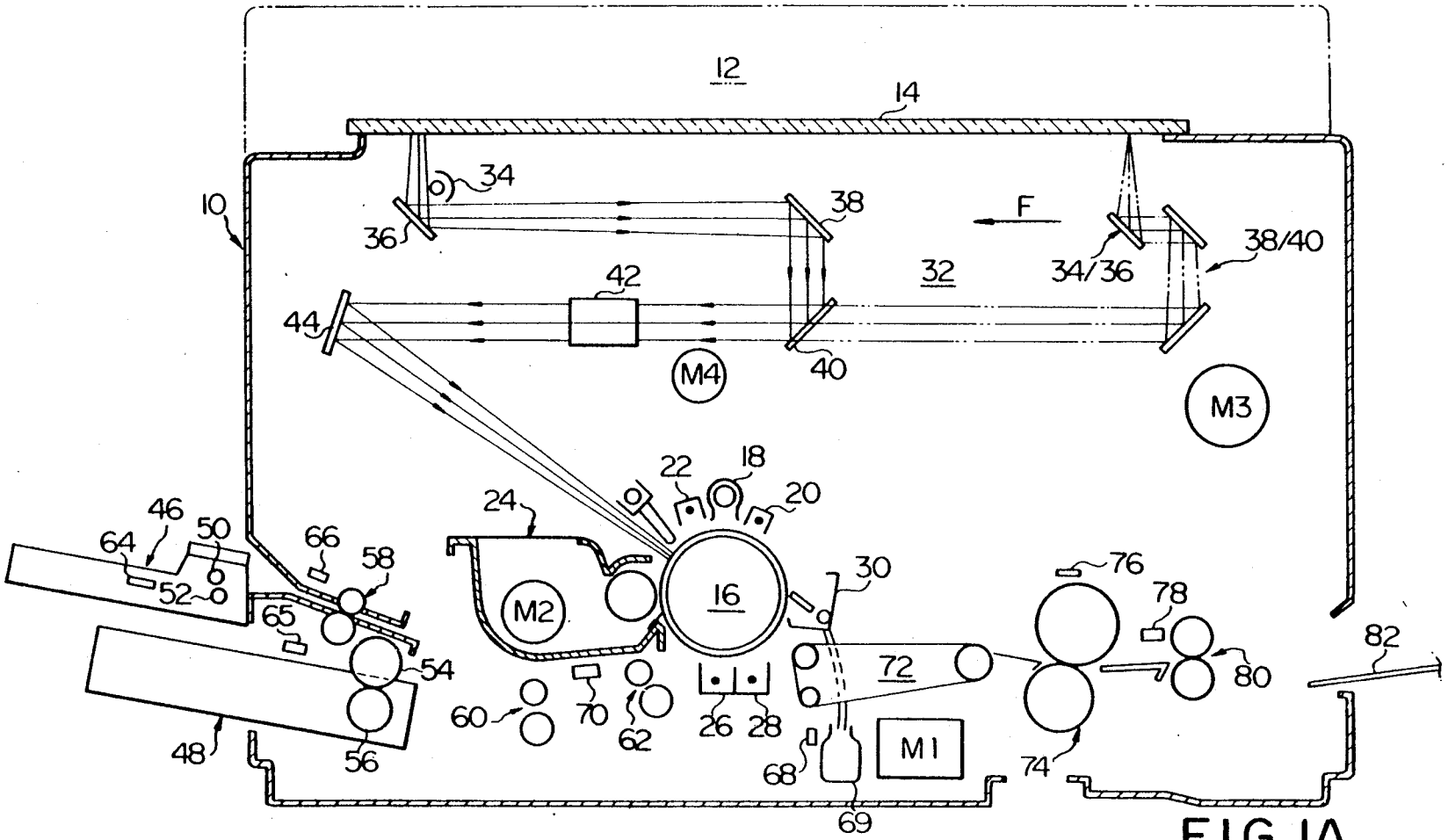
FIG. 1A is a schematic front elevation view showing the general mechanical construction of the main duplicator module of a first preferred embodiment of a scan-mode changeable image duplicating apparatus according to the present invention.
Figure 1B:
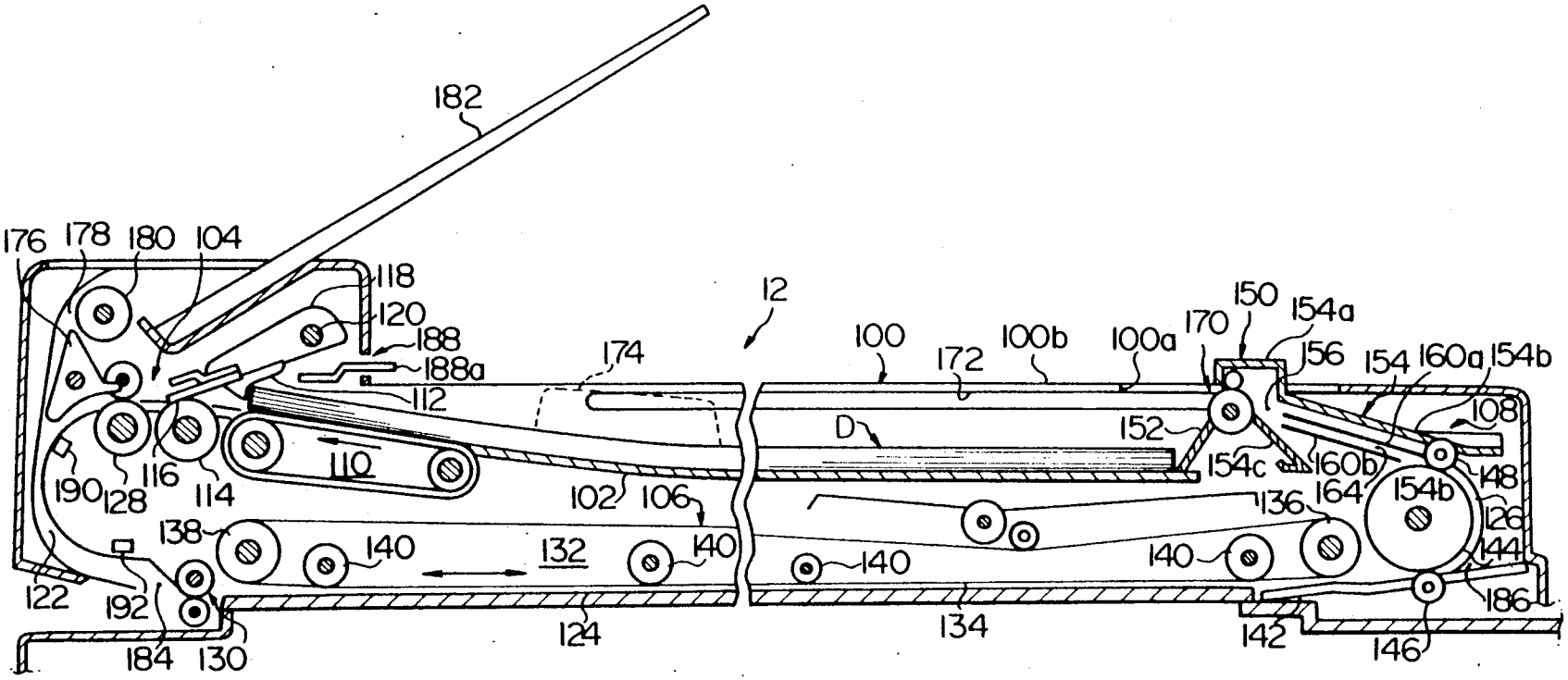
FIG. 1B is a fragmentary front elevation view showing the general mechanical construction of the recirculating document feeder unit of the first preferred embodiment of the image duplicating apparatus according to the present invention.

As shown in the drawing, the scan-mode changeable image duplicating apparatus embodying the present invention generally comprises a main duplicator module 10 illustrated in FIG. 1A, and a document feeder unit 12 mounted on the main duplicator module 10 as shown in FIG. 1B. The document feeder unit 12 is of the recirculating document handling or RDH type which per se is well known in the art. In a document feeder unit of the RDH type, a plurality of documents D successively fed from a document storage position and scanned by exposure to light are returned to the storage position and are placed one upon another in the same sequence as the documents D were initially placed in the storage position, as will be described in more detail.

[1/1] Construction of Main Duplicator Module 10

Referring first to FIG. 1A, the main duplicator module 10 comprises a transparent document support table 14 of typically glass on which a document (not shown) to be scanned is to be placed either automatically or manually. The recirculating document feeder unit 12 is positioned on this document support table 14.

Approximately centrally of the main duplicator module 10 is positioned a photosensitive drum 16 which is to be driven for counter-clockwise rotation by a main drive motor M1. Around this photosensitive drum 16 are disposed various active devices contributing to reproduction of the images picked up from the document scanned. Such active devices form an image reproducing stage in the main duplicator module 10 and are shown including a charge eraser lamp 18, an auxiliary charger 20, a main charger 22, a developing assembly 24, a transfer charger 26, a separation charger 28, and a cleaner device 30 of the blade type as shown. The constructions and manners of operation of all these active devices are well known in the art and will not be herein described. The developing assembly 24 includes rotatable members to be driven for rotation by a motor M2.

The photosensitive drum 16 has a peripheral surface formed by a photosensitive layer which is to be sensitized by charges applied thereto when the drum 16 is driven to turn in the vicinity of the chargers 20 and 22.

Below the document support table 14 is provided an optical system 32 which is arranged to optically scan the images on a document placed on the document support table 14. The optical system 32 comprises an exposure lamp 34, movable reflector mirrors 36, 38 and 40, a lens unit 42 and a stationary reflector mirror 44 as shown. The combination of the lamp 34 and reflector mirror 36 and the combination of the reflector mirrors 38 and 40 are movable along the document support table 14 at controlled speeds. In the description to follow, each of the combination of the lamp 34 and reflector mirror 36 and the combination of the reflector mirrors 38 and 40 will be referred to as movable scanner unit.

During scanning operation, each of these movable scanner units 34/36 and 38/40 is driven by a scanner drive motor M3 to move in the direction of arrow F from its home position indicated by phantom lines. On termination of the scanning operation, the scanner units 34/36 and 38/40 are returned to their respective home positions with respect to the document support table 14. The lens unit 42 is driven for movement by a lens drive motor M4 to adjust the effective R/M ratio for image reproduction.

In the scan-mode changeable image duplicating apparatus embodying the present invention, two different modes of scanning operation are available which consist of a document-moved scanning mode and a scanner-moved scanning mode. When the document-moved scanning mode is in effect, the document on the document support table 14 is driven to move on the table 14 with the movable scanner units 34/36 and 38/40 of the optical system 16 fixedly held in place. In this document-moved scanning mode, the document on the document support table 14 is driven to move at a fixed speed on the table 14 by means of the document feed unit 12. On the other hand, when the scanner-moved scanning mode is selected, each of the movable scanner units 34/36 and 38/40 of the optical system 32 is driven to move along the document support table 14 with the document fixedly held in place on the table 14.

On the left side of the main duplicator module 10 is provided a print-sheet supply stage which comprises an upper sheet supply assembly 46 and a lower sheet supply assembly 48. The upper sheet supply assembly 46 includes an upper sheet feed roller 50 having an associated solenoid-operated clutch 52 and driven for rotation when the clutch 52 is actuated. Likewise, the lower sheet supply assembly 48 includes a lower sheet feed roller 54 having an associated solenoid-operated clutch 56 and driven for rotation when the clutch 56 is actuated. Print sheets are supplied successively from a selected one of these upper and lower sheet supply assemblies 46 and 48 toward the photosensitive drum 16 along a passageway defined by pairs of transport rollers 58 and 60 or along a passageway defined by the pair of transport rollers 60, a pair of timing rollers 62, and various guide members (not shown). The timing roller pair 62 also has an associated solenoid-operated clutch (not shown) and is driven for rotation when the associated clutch is actuated.

In the main duplicator module 10 are further provided various sensors and detectors. These sensors and detectors include an upper sheet empty detecting switch 64. Further provided is a manually-fed sheet detecting switch 66 for detecting the presence of print sheet being manually fed into the main duplicator module 10.

The sensors and detectors provided in the main duplicator module 10 further include a waste toner detecting switch 68 for detecting that a waste toner container 69 storing waste toner particles is filled up, and a timing detect switch 70 for detecting the timing at which a print sheet has reached the timing roller pair 62.

The main duplicator module 10 has further provided therein an endless belt assembly 72 and a toner image fixing assembly 74. The print sheet separated from the photosensitive drum 16 is passed on the belt assembly 72 to the image fixing assembly 74. The print sheet is then withdrawn from the main duplicator module 10 by a pair of discharge rollers 80 to a discharge tray 82. In association with this toner image fixing assembly 74 are provided a temperature sensor 76 for detecting if the fixing assembly 74 is heated to a predetermined temperature, and a sheet detecting switch 78 for detecting the presence of a print sheet being withdrawn from the main duplicator module 10.

[½] Construction of Recirculating Document Feeder Unit 12

Turning to FIG. 1B, the document feeder unit 12 comprises a casing 100 positioned on and covering the document support table 14 of the main duplicator module 10 and having a document storage tray 102 formed by a downwardly concave panel portion of the casing 100. The document storage tray 102 is adapted to has stored thereon a stack of documents D.

In the casing 100 are accommodated a document supply assembly 104, a document transport assembly 106, and a document returning assembly 108. The document supply assembly 104 is disposed within one end portion of the casing 100 and is adapted to successively deliver documents D from the document storage tray 102 to the document transport assembly 106. The document transport assembly 106 is arranged on the document support table 14 and is adapted to transport a document from the document supply assembly 104 to the document returning assembly 108. The document returning assembly 108 is disposed within another end portion of the casing 100 and is adapted to return the document to the document storage tray 102.

The document supply assembly 104 comprises an endless document feed belt 110 and a document pre-handling member 112. The document feed belt 110 has an upper traveling path portion substantially continuous at its rear end to the upper face of the document storage tray 102. The document feed belt 110 is thus operative to feed documents D one after another from the storage tray 102 toward the document pre-handling member 112. The document pre-handling member 112 is located close to the leftward end of the upper traveling path portion of the document feed belt 110 and forms over the terminating end of the travelling path portion of the belt 110 a slight gap allowing a small number of documents D to pass therethrough. The document pre-handling member 112 allows the documents D to advance until the documents D are brought at their leading ends with the pre-handling member 112 and restrains the documents D from travelling beyond the pre-handling member 112 except for some lower ones of the documents D. The document feed belt 110 and the document pre-handling member 112 are thus operative in combination to allow a small number of documents D to leave the belt 110 and travel past the document pre-handling member 112 successively from the lowermost one of the documents D.

The document supply assembly 104 further comprises a document feed roller 114 and a document handling pad 116. The document feed roller 114 is located subsequently to the upper traveling path portion of the document feed belt 110. The document handling pad 116 has its leading end resting on the peripheral surface of the document feed roller 114. As the documents D allowed to advance past the document pre-handling member 112 are supplied successively from the document feed belt 110, the document handling pad 116 prevents leftward movement of the documents D overlying the lowermost one of the documents D so that only the lowermost one of the documents D on the belt 110 is allowed to travel on the document feed roller 114.

Both the document pre-handling member 112 and document handling pad 116 are attached to a lever 118 which is rockable on a pivot shaft 120 secured or journalled to the casing 100. The lever 118 is urged to turn counter clock-wise about the pivot shaft 120 by its own weight and further by the force of a spring (not shown) engaging the lever 118. Thus, the document handling pad 116 has its leading end portion forced against the peripheral surface of the roller 114 and the document pre-handling member 112 has its leading end located on a predetermined vertical plane with respect to the upper traveling path portion of the document feed belt 110. By preference, the document pre-handling member 112 may be securely attached to the casing 100, though not shown in the drawings.

On the other hand, the document transport assembly 106 arranged on the document support table 14 defines a continuous document transport path which consists of a vertically curved supply-side turning path portion 122, a straight intermediate path portion 124, and a vertically curved return-side turning path portion 126. The supplyside turning path portion 122 is subsequent to the document feed roller 114 and turns downwardly and rightwardly to merge into the straight intermediate path portion 124. The intermediate path portion 124 extends straight on the document support table 14 from the terminating end of the supply-side turning path portion 122 and merges at its rear end into the return-side turning path portion 126. The return-side turning path portion 126 turns upwardly and leftwardly from the terminating end of the intermediate path portion 124 and is leftwardly directed toward the document storage tray 100.

The supply-side turning path portion 122 is defined in part by a pair of transfer rollers 128 and in part by a pair of pinch rollers 130. The transfer roller pair 128 is located in the vicinity of the starting end of the path portion 122 and downstream of the document feed roller 114. The transfer roller pair 128 is to be driven for rotation at a speed slightly higher than the speed at which the document feed roller 114 is to be driven for rotation. The pinch roller pair 130 is located in the vicinity of the terminating end of the supply-side turning path portion 122, viz., immediately anterior to the intermediate path portion 124.

Thus, the transfer roller pair 128 receives the document advancing past the document feed roller 114 toward the supply-side turning path portion 122 and drives the document to travel along the supply-side turning path portion 122. The document feed roller 114 has incorporated therein a solenoid-operated one-way clutch (not shown) and races or idles away as the document is being passed from the roller 114 to the transfer roller pair 128 rotating at higher speed than the roller 114. Past the transfer roller pair 128, the document is driven to travel arcuately along the supply-side turning path portion 122 downwardly and rightwardly and is thus turned upside down by the time the document leaves the turning path portion 122.

The pinch roller pair 130 is held at rest until a predetermined period of time is elapsed after the document thus conveyed along the supply-side turning path portion 122 has reached the roller pair 130. If the document happens to have skewed on its way to the roller pair 130, the skewing of the document is remedied with the leading edge of the document forced uniformly along its length against the nip between the pair of rollers 130 until the roller pair 130 is driven for rotation. The document thus correctly directed rightwardly is then passed between the pair of pinch rollers 130 and is allowed to travel along the straight intermediate path 124 on the document support table 14. Thus, the pinch roller pair 130 defines the terminating end of the supply-side turning path portion 122, the starting end of which is defined by the transfer roller pair 128.

The straight intermediate path 124 on the document support table 14 is defined by a document transport belt assembly 132 which comprises an endless belt 134, a driving roller 136, a driven roller 138 and a plurality of guide rollers 140. The endless belt 134 is passed between the driving and driven rollers 136 and 138 and extends underneath the concave panel portion of the casing 100 forming the document storage tray 102.

The endless belt 134 has a lower traveling portion held in close but slidable contact with the upper face of the document support table 14 by means of the guide rollers 140 which are disposed at suitable intervals between the driving and driven rollers 136 and 138 as shown. Thus, the document which has been passed from the supply-side turning path portion 122 to the straight intermediate path portion 124 is conveyed on the document support table 14 by means of the document transport belt assembly 132 toward the return-side turning path portion 126. It may be noted that, while the document is thus being moved on the document support table 14 or is fixedly held in position on the document support table 14 before the document reaches the terminating end of the intermediate path portion 124, the document is scanned by means of the scanner units 34/36 and 38/40 of the optical system 32 as has been described.

Rearwardly of the document support table 14, that is, in the vicinity of the terminating end of the straight intermediate path portion 124 is disposed a document scale member 142. The document scale member 142 has a rear end portion rockably mounted on a pivot shaft (not shown) secured or journalled to the casing 100. The scale member 142 is driven to turn between two angular positions about the axis of the pivot shaft by means of a solenoid-operated actuator (not shown). The angular positions between which the scale member 142 is thus rockable consist of a first angular position having its leftwardly directed leading end located below a horizontal plane flush with the upper face of the document support table 14 and a second position having its leading end located above such a plane.

With the scale member 142 held in the first angular position, the document which has been moved to the terminating end of the intermediate path portion 124 is allowed to travel continously to the return-side turning path portion 126. On the other hand, when the scale member 142 is held in the second angular position, the document which has been moved to the terminal end of the intermediate path portion 124 is at its leading end brought into abutting contact with the leading end of the scale member 142 and is prevented from being passed to the return-side turning path portion 126.

The position of the document thus having its leading edge contacted by the document scale member 142 is predetermined and is herein referred to as "exposure position" of the document in which the document is to be fixedly held in position on the document support table 14 for being scanned by the scanner units 34/36 and 38/40 of the optical system 32. Thus, the document scale member 142 is held in the first angular position when the document-moved scanning mode is selected to scan the document while the document is being moved in the document support table 14. On the other hand, when the scanner-moved scanning mode is selected to scan the document held in the predetermined exposure position on the document support table 14, the scale member 142 is held in the second angular position thereof. It will be apparent that the document must be held in the predetermined exposure position on the document support table 14 during scanner-moved scanning mode and be moved through such a position when the document-moved scanning mode is selected.

The return-side turning path portion 126 is defined by a large-diameter document return roller 144 and lower and upper sets of small-diameter idler rollers 146 and 148. The idler rollers 146 and 148 are held in rollable contact with the peripheral surface of the return roller 144 in the neighborhood of the top and bottom, respectively, of the roller 144 as shown. The document transferred from the intermediate path portion 124 to the return-side turning path portion 126 is first passed between the return roller 144 and the lower set of idler rollers 146 and thereafter passed between the return roller 144 and the upper set of idler rollers 148. Thus, the lower and upper sets of idler rollers 146 and 148 define the starting and terminating ends, respectively, of the return-side turning path portion 126.

Between the lower and upper sets of idler rollers 146 and 148, the document is in this manner driven to travel arcuately along the return-side turning path portion 126 upwardly and leftwardly and is for a second time turned upside down by the time the document leaves the turning path portion 126. Past the upper set of idler rollers 148, the document leaving the return-side turning path portion 126 is directed toward the depression in the document storage tray 102 and is passed to and for a second time stored on the storage tray 102 through the rear end of the tray 102.

In the neighborhood of the rear or rightmost end of the document storage tray 102 is provided a document guide assembly 150 which is in its entirety movable leftwardly and rightwardly in the depression in the document storage tray 102. The document guide assembly 150 is adapted to guide the movement of the document on the document storage tray 102 away from the return-side turning path portion 126 until the document is received at its leading end on the document pre-handling member 112.

Figure 2:
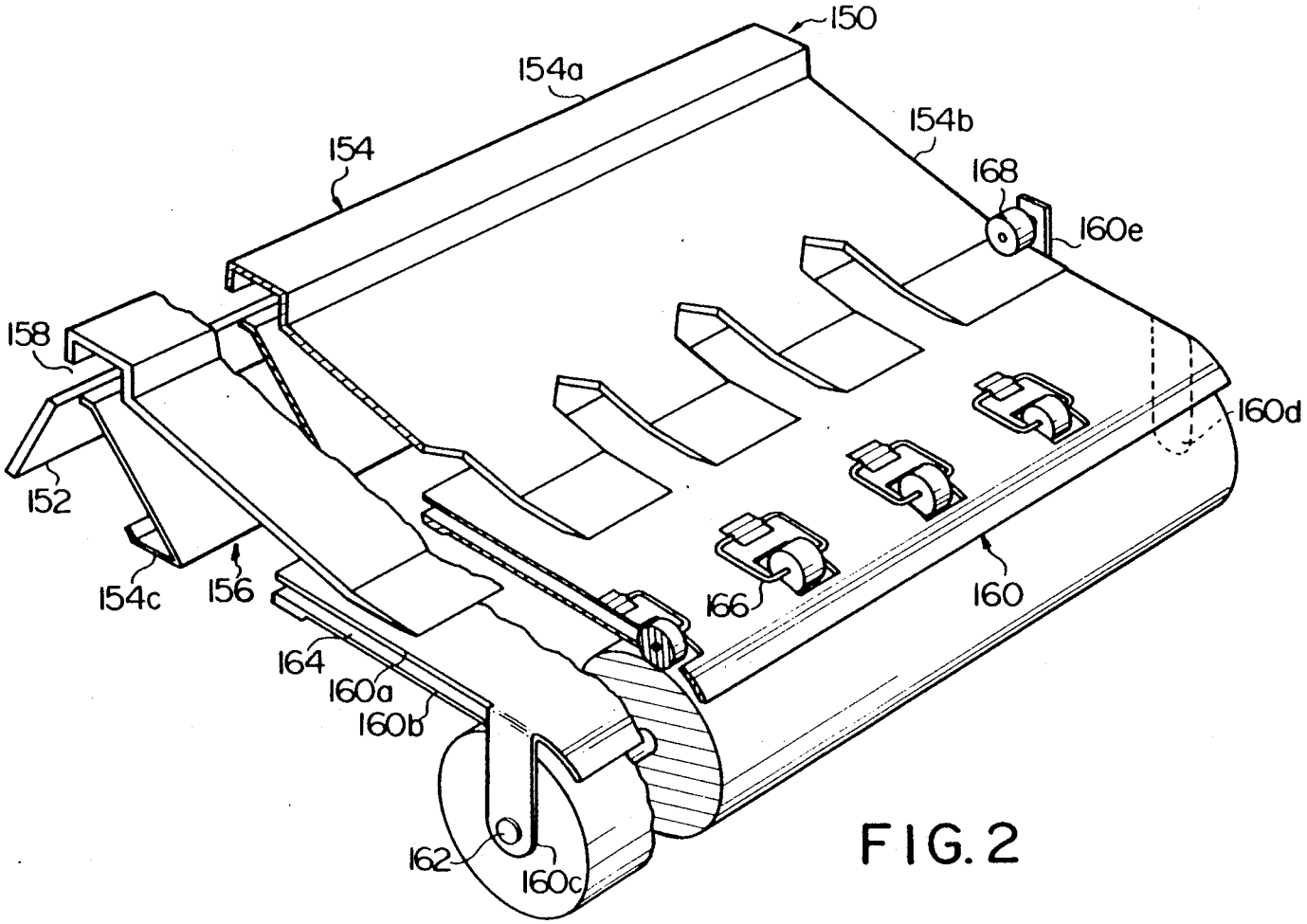
FIG. 2 is a partially cut-away perspective view showing, to an enlarged scale, a document guide assembly which forms part of the document feeder unit illustrated in FIG. 1B.

As illustrated to an enlarged scale in FIG. 2, the document guide assembly 150 comprises a lower front guide member 152 slanting leftwardly and downwardly on the concave panel portion of the casing 100 forming the document storage tray 102. The front guide member 152 is manually movable leftwardly and rightwardly with respect to the storage tray 102 and is capable of pressing the documents leftwardly at the trailing end of the documents stored on the storage tray 102. The guide member 152, when moved leftwardly on the tray 102, is thus operative to press the documents leftwardly on the tray 102 until the documents are brought into abutting contact with the document pre-handling member 112 located at the leftward end of the tray 102. The distance of leftward movement of the guide member 152 with respect to the document storage tray 102 depends on the size of the document stored on the tray 102.

The document guide assembly 150 further comprises a movable upper lid member 154 which is movable integrally with the guide member 152. The movable upper lid member 154 has an uppermost ridge portion **154*a* parallel with the document return roller 144 and protruding upwardly through an opening 100*a* in the casing 100 as will be seen from FIG. 1B. This upwardly protruding ridge portion 154*a* of the upper lid member 154 provides a manually-operated knob for allowing the operator to manually move the lid member 154 rightwardly or leftwardly in FIG. 1B with respect to the document return roller 144**.

The upper lid member 154 further has a rear upper panel portion **154*b* and a rear lower panel portion 154*c*, each of which projects rightwardly away from the ridge portion 154*a* as will be better seen from FIG. 2. The rear upper and lower panel portions 154*b* and 154*c* have formed therebetween a document-guide passageway 156 which diverges away from the rear ends of the portions 154*b* and 154*c*. The document-guide passageway 156 terminates in a document discharge slot 158** as shown.

There is further provided a rockable guide member 160 having upper and lower panel portions **160*a* and 160*b* extending from above the document return roller 144 into the document-guide passageway 156. The upper panel portion 160*a* of the guide member 160 is rockably supported on a drive shaft 162 of the document return roller 144 by a pair of arm portions 160*c* and 160*d* extending downwardly from the opposite side edges of the panel portion 160*a*. The guide member 160 is thus rockable in its entirety about the center axis of the drive shaft 162 supporting the document return roller 144**.

The upper panel portion **160*a* of the rockable guide member 160 is spaced apart in parallel from the lower panel portion 160*b* so that a document passageway 164 is formed between the panel portions 160*a* and 160*b*. The document passageway 164 leftwardly merges into the divergent document-guide passageway 156 and laterally extends throughout the axial length of the document return roller 144. The passageway 164 leftwardly extends tangentially to the upper end of the peripheral surface of the document return roller 144. The document which has been conveyed past the return-side turning path portion 126 is therefore enabled to travel reliably into the document-guide passageway 156 without respect to leftward or rightward movement of the lid member 154 with respect to the document return roller 144**.

The idler rollers 148 held in rollable contact with the peripheral surface of the return roller 144 at the top of the roller 144 are supported by shafts 166 mounted on the upper panel portion **160*a* of the rockable guide member 160. The idler rollers 146 thus follow the rocking movement of the guide member 160 about the center axis of the drive shaft 162 so that each of the rollers 146 has its lower end constantly located on a plane contained in the document passageway 164 between the upper and lower panel portions 160*a* and 160*b*. By virtue of such arrangement of the idler rollers 146 with respect to the document passageway 164, the document transferred from the return-side turning path portion 126 and leftwardly conveyed past the rollers 144 and 148 can be reliably admitted into the passageway 164**.

The rockable guide member 160 further has an upward arm portion **160*e* extending upwardly from a side edge of its upper panel portion 160*a* as shown in FIG. 2. An idler roller 168 is rotatably mounted on a shaft secured to this upward arm portion 160*e* of the guide member 160. The idler roller 168 is engageable with the upper face of the rear upper panel portion 154*b* of the movable upper lid member 154 in the vicinity of the rearmost end of the panel portion 154*b*. The upper and lower panel portions 160*a* and 160*b* of the rockable guide member 160 and accordingly, the passageway 164 formed therebetween, are in this manner enabled to reliably extend into the document-guide passageway 156 underneath the upper panel portion 154*b* of the movable upper lid member 154**.

Turning back to FIG. 1B, a pair of document discharge rollers 170 are disposed in close proximity to the document discharge slot 158 (FIG. 2) in the document guide assembly 150. The document being withdrawn from the document guide assembly 150 through the discharge slot 158 is thus driven to move leftwardly by this discharge roller pair 170 until the document is completely received on the document storage tray 102 with its trailing end moved past the roller pair 170.

The document discharge rollers 170 consist of a driven roller and a driving roller which is supported on a drive shaft which has its opposite end portions extending into the casing 100 through horizontally elongated slots 172 formed in front and rear panel portions, respectively, of the casing 100. The drive shaft of the discharge roller pair 170 is operatively connected to a suitable drive unit (not shown) provided within the casing 100. The slots 172 may be utilized also as means to guide the leftward and rightward movement of the document guide assembly 150.

The casing 100 as a whole is hingedly connected at its rear end to the upper panel member (not shown) of the housing structure of the main duplicator module 10 shown in FIG. 1A and is rockable upwardly and downwardly over the document support table 14 about its rear end. When the casing 100 is thus turned open upwardly over the document support table 14, the operator is given access to the upper face of the document support table 14 and may manually place a document on the document support table 14 or remove the document which has been placed on the document support table 14.

In the neighborhood of the left end of the document storage tray 102 and in parallel with the front panel portion of the casing 100 is provided a movable document guide member 174 which is movable toward and away from the rear panel portion 100*a* of the casing 100. The guide member 174 may be manually moved between the front and rear panel portions of the casing 100 to correctly set a document or documents D laterally on the document storage tray 102 depending on the width of the document or documents D.

Above the supply-side turning path portion 122 is provided a rockable two-position travel shifter 176. The travel shifter 176 is rockable between a first angular position in which a document being moved past the transfer roller pair 128 is to be directed downwardly to the supply-side turning path portion 122 and a second angular position in which a document is allowed to travel from the supply-side turning path portion 122 upwardly to a discharge-side turning path portion 178. A document discharge roller 180 is disposed along the discharge-side turning path portion 178 thus having its starting end defined by the travel shifter 176.

When the travel shifter 176 is held in the second angular position, the pinch rollers 130 and the document transport belt assembly 132 are driven to operate in the opposite directions. The opposite directions herein referred to are directions of operation of the pinch roller 130 and belt assembly 132 opposite to those in which they operate in transporting a document from the supply-side turning path portion 122 to the intermediate path portion 124. The document which has been exposed to light and scanned on the document support table 14 is thus driven to travel backwardly from the intermediate path portion 124 to the supply-side turning path portion 122. From the supply-side turning path portion 122, the document is driven to travel along the discharge-side turning path portion 178 and is finally withdrawn rightwardly to a document discharge tray 182 by the document discharge roller 180.

In the document feeder unit 12 are further provided a document supply/discharge port 184 located in the vicinity of the terminating end of the supply-side turning path portion 122 and a document supply/discharge port 186 located immediately downstream of the nip between the document return roller 144 and the associated idler roller 146.

Thus, the document feeder unit 12 forming part of the duplicating apparatus embodying the present invention is of the RDH type which per se is well known in the art. In the document feeder unit of the RDH type, a plurality of documents D successively exposed to light on the exposure table 14 are returned to the document storage tray 102 and are placed one upon another in the same sequence as the documents D were initially placed on the tray 102, as will be described in more detail.

Immediately anterior to the document pre-handling member 112 is provided a document feed wheel 188 having a feeder wing 188*a* of a pliable material such as polyurethane. The document feed wheel 188 is adapted to elastically impart a force effective to assist in the movement of the document being superposed on the stack of the documents D which have already been returned to the document storage tray 102.

If desired, the document feeder unit 12 herein shown may further comprise a document separator by means of which the stack of the documents D successively returned to the document storage tray 102 is to be separated from the document or the set of documents D which remain on the tray 102 to be supplied from the tray 102, though not shown in the drawings. In the presence of a document or a stack of documents D remaining to be fed from the tray 102, the document separator rests on the document or on the stack of documents D underlying the document or the stack of the documents D which have been returned to the tray 102.

In the document feeder unit 12 are further provided various sensors and detectors which include document travel sensor 190 and 192 located in the neighborhood of the starting and terminating ends, respectively, of the supply-side turning path portion 122 as shown. These document travel sensor 190 and 192 are responsive to passage of the leading end of a document through the starting and terminating ends, respectively, of the turning path portion 122. From the signals thus output at different timings from the sensors 190 and 192 can be calculated the speed at which the document is traveling along the supply-side turning path portion 122. Any change in the traveling speed of the document along the path portion 122 will indicate a change in line voltage, a change in the allowable error in the revolution speed of the motor used in the feeder unit 12, a change in the transmission efficiency between gears due to wear, a slip or a drag of the document on any contact surface, or the like. The document is thus driven to travel at a speed controlled on detection of such parameters and factors from the change in the speed calculated from the output signals from the sensors 190 and 192.

[1/3] Operation of Recirculating Document Feeder Unit 12

Description will now be made as to the operation of the document feeder unit 12 of the RDH type which is constructed and arranged as has been hereinbefore described.

Before the documents D to be duplicated are placed on the document storage tray 102, the operator is recommended to manually move the document guide assembly 108 to the position remotest from the document pre-handling member 112 and move the movable document guide member 174 to the position closest to the front panel portion of the casing 100. These positions of the guide assembly 150 and the guide member 174 are such that documents D of the largest standard size can be placed on the document storage tray 102 without being interfered by the guide assembly 150 and the guide member 174.

The operator will then place the documents D on the document storage tray 102. For this purpose, the operator is recommended to hold the documents D by hand at or in the neighborhood of the right trailing end of the stack of the documents D and move the documents D leftwardly on the tray 102 until the stack of the documents D is at its left leading end brought into pressing contact with the document pre-handling member 112 located close to the end of the tray 102. The stack of the documents D is in this manner roughly set in a predetermined position on the document storage tray 102 in the direction in which the documents D are to be withdrawn from the tray 102. The step of moving the documents D toward the document pre-handling member 112 will be facilitated if the document feed belt 110 is conditioned to be free to move.

The operator will then move the document guide assembly 150 leftwardly with respect to the document storage tray 102 until the lower front guide member 152 of the guide assembly 150 registers with a marking (not shown) indicating the trailing end of the correct position predetermined for the size of the documents D presently placed on the tray 102. The lower front guide member 152 of the guide assembly 150 being thus moved on the document storage tray 102, the stack of the documents D on the tray 102 is pressed leftwardly by the guide member 152 at its right trailing end. The stack of the documents D is in this manner correctly set in the predetermined position longitudinally of the tray 102 with the left leading edges of the documents D closely received on the document pre-handling member 112.

The operator will further move the document guide member 174 forwardly on the document storage tray 102 until the stack of the documents D contacted by the guide member 174 at its front end is pressed against the rear panel portion 100*a* of the casing 100. The stack of the documents D is in this manner correctly set in a predetermined position widthwise of the tray 102 with the front and rear edges of the documents D closely received between the guide member 174 and the rear panel portion 100*a* of the casing 100.

In FIG. 1B, the documents D are shown set in the correct position longitudinally and widthwise of the document storage tray 102, wherein the documents D are assumed to be of the largest standard size. In the description to follow, it is further assumed that the operator has selected "three" as the quantity of the printed outputs to be produced for each of the documents D.

When the operator then depresses the print start switch (to be described) under these conditions, the document feed belt 110, document feed roller 114 and transfer roller pair 128 are initiated into motion to drive the lowermost one of the documents D to move leftwardly from the document storage tray 102. The document which is thus withdrawn from the document storage tray 102 and has reached the transfer roller pair 128 is transferred to the supply-side turning path portion 122.

Past the transfer roller pair 128, the document is driven to travel arcuately along the supply-side turning path portion 122 downwardly and rightwardly and is turned upside down by the time the document leaves the turning path portion 122.

Until the document thus driven to travel along the supply-side turning path portion 122 reaches the pinch roller pair 130 located at the terminating end of the path portion 122, the pinch roller pair 130 is held at rest. The document which has reached the pinch roller pair 130 is in this manner brought into engagement at its leading edge with the nip between the pinch rollers 130 so that, in the event the document has been laterally deviated or skewed for one reason or another, the lateral deviation or skewing of the document is remedied by the pinch rollers 130 before the rollers 130 are driven for rotation.

With the pinch rollers 130 thus driven for rotation, the document is passed through the pinch roller pair 130 to the straight intermediate path portion 124 on the document support table 14 and is further driven by the document transport belt assembly 132 to move at a controlled speed on the table 14 toward the return-side turning path portion 126.

When the document-moved scanning mode is selected, the document scale member 142 is held in the first angular position and has its leading end located below a plane flush with the upper face of the document support table 14. The document which has been moved to the terminating end of the intermediate path portion 124 is therefore allowed to travel to the return-side turning path portion 126 past the document scale member 142.

On the other hand, when the scanner-moved scanning mode is selected, the scale member 142 is held in the second angular position thereof and has its leading end located above the plane flush with the upper face of the document support table 14. The document which has been moved to the terminating end of the intermediate path portion 124 is at its leading end brought into abutting contact with the leading end portion of the scale member 142 and is in this fashion prevented from being passed to the return-side turning path portion 126. It may be herein noted that the scale member 142 is operative not only to prevent passage of the document to the turning path portion 126 but also to rectify the skewing, if any, of the document which has its leading edge thus brought into abutting contact with the scale member 142.

At the point of time the document has its leadinf end brought into abutting contact with the scale member 142, the document transport belt assembly 132 is brought to a stop. Accordingly, the document is fixedly held in the predetermined exposure position on the document support table 14 with its leading end contacted by the scale member 142.

The movable scanner units 34/36 and 38/40 of the optical system 32 are now driven by the motor M3 to move in the direction of arrow F from their home positions indicated by phantom lines in FIG. 1A to scan the lower image-bearing surface of the document thus fixedly placed on the document support table 14. On termination of the scanning operation, the scanner units 34/36 and 38/40 are driven to return to their respective home positions with respect to the document support table 14.

At least by the point of time the scanning operation for the document is terminated, the document scale member 142 is moved to the first angular position having its leading end located below the plane flush with the upper face of the document support table 14. On condition that the scale member 142 is thus moved to the first angular position thereof, the document transport belt assembly 132 is for a second time initiated into motion and at the same time the document return roller 144 and the document discharge rollers 170 are driven for rotation. It therefore follows that the document released from the scale member 142 is driven to advance from the intermediate path portion 124 to the return-side turning path portion 126 past the scale member 142.

Driven by the document return roller 144 and the associated lower and upper idler rollers 146 and 148, the document travels arcuately along the return-side turning path portion 126 upwardly and leftwardly and is thus for a second time turned upside down by the time the document is leaving the turning path portion 126. Past the upper idler rollers 148, the document leaving the return-side turning path portion 126 travels by way of the document passageway 164 into the divergent document-guide passageway 156.

The document is then leftwardly withdrawn from the document guide assembly 150 through the discharge slot 158 thereof. The document is further driven to move leftwardly by the document discharge roller pair 170 until the document is completely received on the document storage tray 102 with its trailing end moved past the roller pair 170. The document discharge roller pair 170 comprises upper and lower sets of rollers, each set of rollers consisting of a plurality of roller elements axially spaced apart on a common roller shaft, wherein the individual roller elements of one set of rollers are arranged in staggered relationship to the roller elements of the other set of rollers. By virtue of such staggered arrangement of the roller elements, the document discharge roller pair 170 has have axial steps to cause the document to slightly undulate in lateral direction while the document is being passed therebetween. This is useful for enabling the document to advance straight on the document storage tray 102 or on the uppermost one of the documents D which have been successively returned to the tray 102.

The document thus returned to the document storage tray 102 is placed on the tray 102 or on the stack of the documents D which have already been returned to the tray 102. To the document which is being thus superposed on the stack of documents D on the tray 102 is elastically imparted by the document feed wheel 188 a force effective to promote the movement of the document being moved toward the document pre-handling member 112. The document is thus enabled to restore the correct initial position with respect to the document pre-handling member 112 by the aid of the axially stepped document discharge rollers 170 and the document feed wheel 188.

When the last one of the documents D initially placed on the document storage tray 102 is returned to the tray 102, the first cycle of duplicating operation is terminated and the document storage tray 102 has received thereon the complete set of documents D returned thereto. Where the document feeder unit 12 is provided with the previously described document separator, the document separator which has been resting on the last one of the documents D is allowed to turn downwardly below the document storage tray 102. At the point of time the last document is returned to the document storage tray 102, the separator is actuated to turn upwardly over the tray 102 and rests on the stack of the documents D re-placed on the tray 102 and ready to be supplied therefrom. Thus, the document separator lends itself to detecting the termination of a single cycle of duplicating operation for a set of documents D placed on the document storage tray 102.

At an appropriate point of time before the document on the document support table 14 has been completely scanned or after the printed outputs duplicating the document are produced, the document supply assembly 104 of the document feeder unit 12 is for a second time initiated into motion to start the second cycle of duplicating operation for the documents D returned to the document storage tray 102. The documents D re-placed on the document storage tray 102 are thus successively supplied for a second time from the tray 102, scanned one after another on the document support table 14 in the document-moved or scanner-moved scanning mode and are thereafter returned to the tray 102 each in the manner hereinbefore described.

Each time the scanning of a document is complete during the final cycle of duplicating operation in the scanner-moved scanning mode, the travel shifter 176 is turned to the previously defined second angular position. Furthermore, the pinch rollers 130 and document transport belt assembly 132 are driven to operate in the directions to transport a document from the intermediate path portion 124 back to the supply-side turning path portion 122. The document which has been scanned in the scanner-moved scanning mode is thus driven to travel backwardly along the supply-side turning path portion 122 and further along the discharge-side turning path portion 178 and is finally withdrawn to the discharge tray 182 by means of the discharge roller 180. The documents D which have been completely duplicated each for a desired number of times are in this manner discharged to the document discharge tray 182 so that the document storage tray 102 is ready to receive another set of documents D.

If desired, the set of documents D which have been discharged to the document discharge tray 182 may be left on the tray 182 during the second cycle of duplicating operation for another set of documents. At the end of the second cycle of duplicating operation, the set of documents D duplicated by the second cycle of duplicating operation will be superposed on the set of documents D duplicated by the first cycle of duplicating operation. In this manner, two or more sets of documents D may be stacked on the discharge tray 182 so that, if the sets of documents D are of the same size, the operator could not distinguish one set of documents D from another on the document discharge tray 182.

Suitable assorting or grouping means may thus be provided to enable the operator or operators of the apparatus to distinguish one set or group of documents D from another on the document discharge tray 182, though not shown in the drawings. Such assorting or grouping means may be of the type causing a document to make a 90-degree turn on the document discharge tray 182 or in its way toward the tray 182 during every second cycle of duplicating operation. Thus, the first set or group of documents D discharged to the tray 182 will be received longitudinally on the tray 182. the second set or group of documents D thereafter discharged on the tray 182 will be received laterally on the first set of documents D, and the third set of documents D further discharged on the tray 182 will be received longitudinally on the second set or group of documents D, and so forth. The documents D discharged to the document discharge tray 182 are thus assorted or grouped for each set or group and will enable the operator or operators of the apparatus to readily distinguish one set or group of document from another on the tray 182 from the positions in which the sets of printed outputs are received on the tray 182.

[1/4] Control Panel 200

Figure 3:
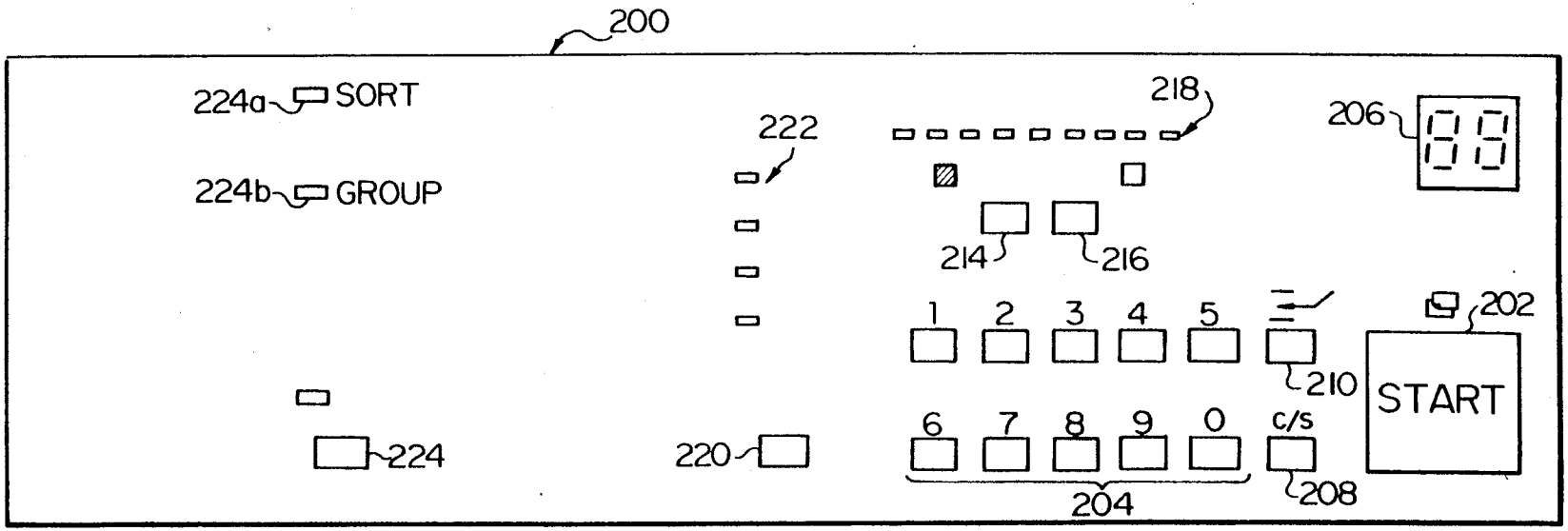
FIG. 3 is a plan view showing a portion of a control panel which forms part of the image duplicating apparatus embodying the present invention.

FIG. 3 shows a portion of a control panel 200 which forms part of the image duplicating apparatus hereinbefore described with reference to FIG. 1.

The control panel 200 has various control keys and indicators provided thereon though not all of such keys and indicators are herein illustrated. The keys thus provided on the control panel 200 herein shown include a print start key 202, and a plurality of numerical keys 204 allowing the operator to enter a desired quantity of printed outputs to be produced for a single document or a desired R/M ratio for duplication. The desired quantity of printed outputs to be produced for a single document or the desired R/M ratio for duplication thus entered at any one or more of the numerical keys 204 are visually indicated on a four-digit numerical display window 206. The quantity of the printed outputs to be produced and the R/M ratio which have once been entered can be cancelled by a clear/stop key 208. Further provided on the control panel 100 is a request for interruption of a cycle of duplicating operation in progress can be entered at an interrupt request key 210.

The keys and indicators provided on the control panel 200 further include density-up and density-down control keys 214 and 216 and associated indicators 218 and a print-sheet select key 220 and associated indicators 222. The density-up and density-down control keys 214 and 216 allow the operator to manually select a desired printing density.

Figure 4:
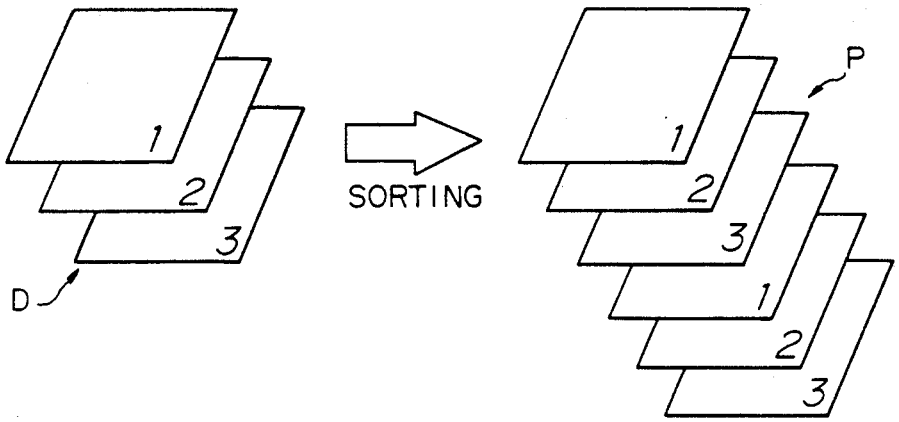
FIG. 4 is a schematic view showing an example of the manner in which documents are to be duplicated in a sorting mode.
Figure 5:
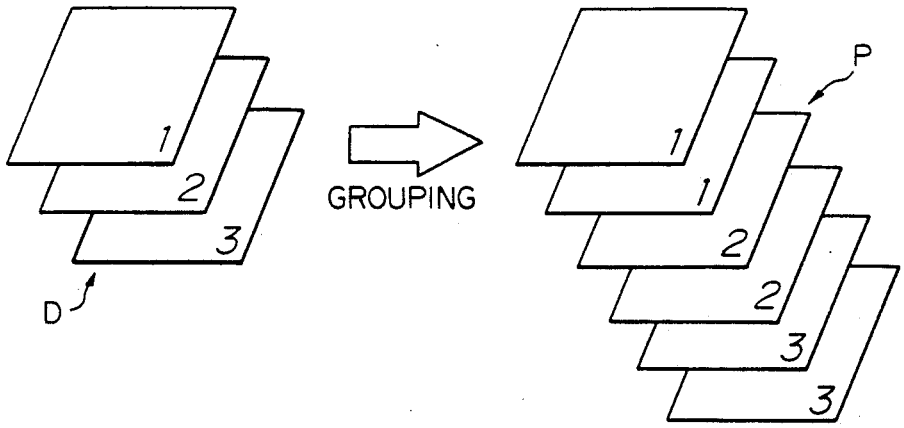
FIG. 5 is a schematic view showing an example of the manner in which documents are to be duplicated in a grouping mode.

On the control panel 200 is further provided a sorting/grouping mode select key 224 which is to be used to select either a sorting mode or a grouping mode of operation in discharging printed outputs. FIGS. 4 and 5 show examples of the manners in which documents D are to be duplicated in the sorting and grouping modes, respectively.

When the sorting mode is selected, the printed outputs P produced from the documents D of, for example, page 1, page 2 and page 3 as shown in FIG. 4 are assorted to form two or more sets of printed outputs with each set of printed outputs paged 1, 2 and 3 correspondingly to the documents D of pages 1, 2 and 3. On the other hand, when the grouping mode is selected, the printed outputs P are grouped to form two or more groups of printed outputs with each group of printed outputs commonly paged 1, 2 or 3 correspondingly to each page 1, 2 or 3 of the documents D as will be seen from FIG. 5. It may be noted that, when the grouping mode is selected, the scanner-moved scanning mode is exclusively selected as will be described in more detail.

Provided in association with the sorting/grouping mode select key 224 are an indicator 224*a* which is to be turned on to illuminate when the sorting mode is selected at the key 224 and an indicator 224*b* which is to be turned on to illuminate when the grouping mode is selected at the key 224. The sorting mode or the grouping mode which has once been selected at the key 224 can also be cancelled by the clear/stop key 206.

[1/5] Control Circuit 250

Figure 6:
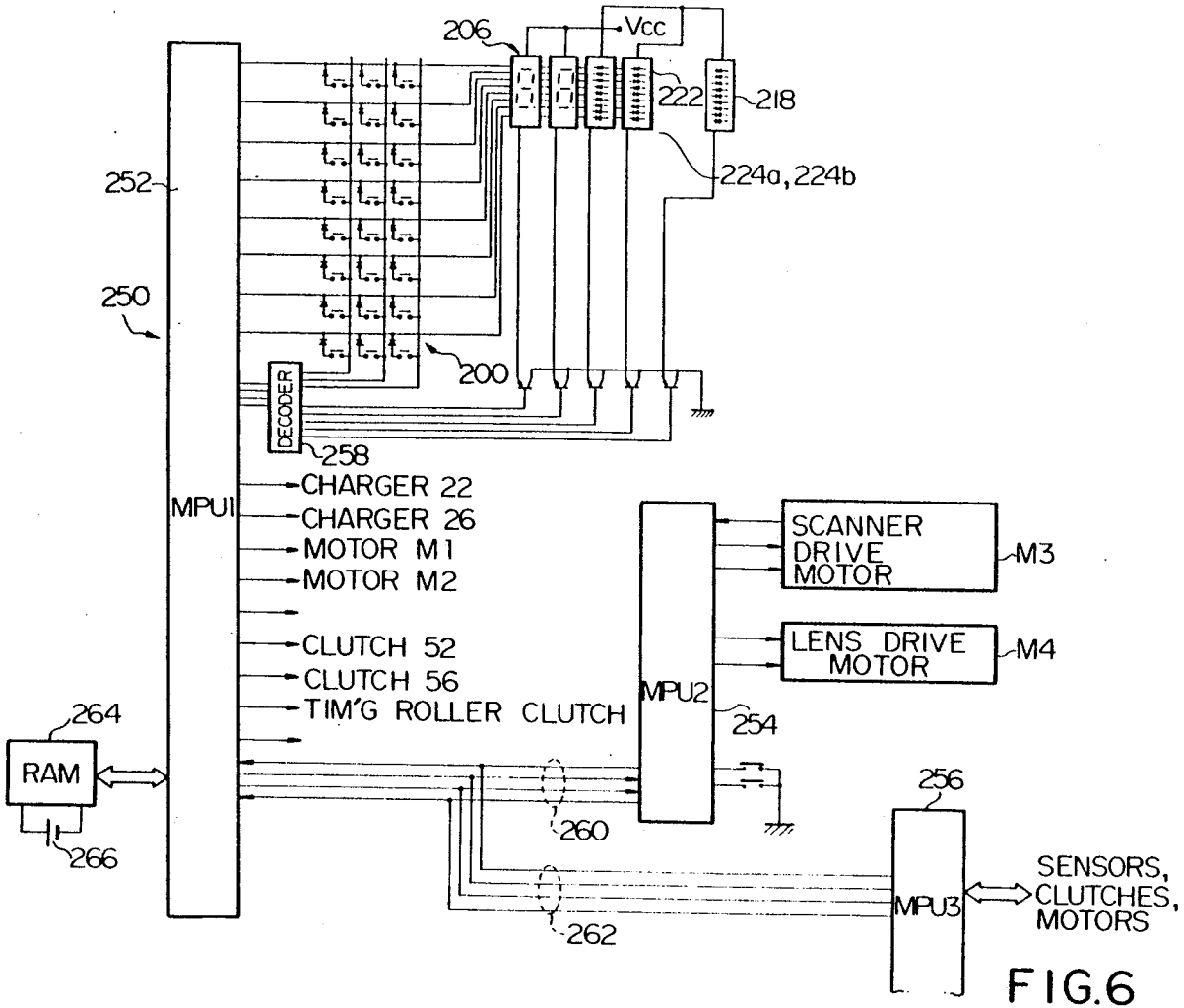
FIG. 6 is a diagram showing the general arrangement of a microprocessor-based control circuit incorporated in the first preferred embodiment of the image duplicating apparatus according to the present invention.

FIG. 6 shows the general arrangement of a microprocessor-based control circuit 250 which is incorporated in the first preferred embodiment of the present invention. The control circuit 250 largely comprises a main microprocessor 252 and first and second subsidiary microprocessors 254 and 256.

The main microprocessor 252 (MPU1) is predominant over all the operational aspects of the main duplicator module 10 of the duplicating apparatus embodying the present invention except for those of the optical system 32. Thus, the main microprocessor 252 has input ports electrically connected to the various keys provided on the control panel 200 and is responsive to the control and instruction signals supplied from the keys. The signals thus supplied from the control panel 200 to the main microprocessor 252 include those from the print start key 202, numerical keys 204, clear/stop key 208, interrupt request key 210, density-up and density-down control keys 214 and 216, print-sheet select key 220 and sorting/grouping mode select key 224 on the control panel 200.

Though not illustrated in the drawings, the main microprocessor 252 further has input ports electrically connected to the various sensors and detectors provided in the image reproducing and print-sheet supply stages of the main duplicator module 10. These sensors and detectors include the upper and lower sheet empty detecting switches 64 and 65.

The main microprocessor 252 is operative to supply various control and driver signals to the control panel 200. Thus, the main microprocessor 252 has output ports electrically connected through a decoder 258 to the active elements forming the numerical display window 206, the indicators 218 associated with the density-up and density-down control keys 214 and 216, the indicators 222 associated with the print-sheet sheet select key 220, and the indicators 224*a* and 224*b* associated with the sorting/grouping mode select key 224 on the control panel 200.

The main microprocessor 252 is further operative to supply control and driver signals to the actuator elements of the various active devices and drive units provided in the main duplicator module 10. Thus, the main microprocessor 252 further has output ports electrically connected to the main charger 22, the transfer charger 26, the main drive motor M1, motor M2 for the developing assembly 24, the solenoid-operated clutches 52 and 56 for the upper and lower sheet supply assemblies 46 and 48, respectively, and the solenoid-operated clutches (not shown) for the timing rollers 62.

The first subsidiary microprocessor 254 (MPU2) is in control of the operation of, particularly, the optical system 32 of the main duplicator module 10 and communicates with the main microprocessor 252 through a bidirectional bus 260. The first subsidiary microprocessor 254 is thus responsive to signals supplied from the various sensors and detectors (not shown) that are included in the optical system 32. The first subsidiary microprocessor 254 is further operative to actuate various active devices and drive units that are provided in the optical system 32. Examples of the active devices and drive units thus actuated by the first subsidiary microprocessor 254 include the drive motor M3 for the movable scanner units 34/36 and 38/40, and the drive motor M4 for the lens unit 42 of the optical system 32.

The second subsidiary microprocessor 256 (MPU3) is in control of the operation of, particularly, the document feeder unit 12 and communicates with the main microprocessor 252 through a bidirectional bus 262. The second subsidiary microprocessor 256 is thus responsive to signals supplied from the various sensors and detectors that are incorporated in the document feeder unit 12. Examples of such sensors and detectors include the document travel sensor 190 and 192 provided in conjunction with the document supply assembly 104 of the document feeder unit 12. The second subsidiary microprocessor 256 is further operative to actuate various active devices and drive units such as the solenoid-operated clutches and drive motors that are included in the document feeder unit 12.

The various pieces of information which are thus supplied to or generated in each of the main and subsidiary microprocessors 252, 254, 256 and 128 are loaded into a random-access memory 264 (RAM) directly or after being processed by the main microprocessor 252. The random-access memory 264 has a built-in backup power source 266 to assuredly retain the information thus stored in the memory 264.

[1/6] Operation of Main Duplicator Module 10

Description will be hereinafter made in regard to the operation of the main duplicator module 10 with reference concurrently to FIGS. 1A and 1B to FIG. 4 and further to FIGS. 7 to 13.

Before starting a cycle of duplicating operation, the operator will select either the print sheets stored in the upper sheet supply assembly 46 or the print sheets stored in the lower sheet supply assembly 48. This selection is made by depressing the print-sheet select key 220 on the control panel 200. The operator will further select either the sorting mode or the grouping mode of operation at the sorting/grouping mode select key 224 on the control panel 200.

If it is desired that two or more printed outputs be produced for each of the documents D, the operator will enter the desired quantity of printed outputs per document at any of the numerical keys 204 on the control panel 200. As has been noted, the quantity of the printed outputs thus selected is visually indicated on the numerical display window 206.

Two different cases, that is, Case I and Case II will be taken into consideration in the following description. In case I, the sorting mode is selected at key 224 so that the indicator **224*a* is activated to illuminate. In case II, the grouping mode is selected at key 224 so that the indicator 224*b* is activated to illuminate. In each of Case I and Case II, two or more printed outputs are to be produced for each of the documents D initially placed on the document storage tray 102**. It may be noted that, when a single printed output is to be produced for each of the documents D, the scanner-moved scanning mode is automatically selected when either of the sorting mode and the grouping mode is selected.

Case I

The sorting mode is selected at key 224 and a plurality of printed outputs are to be produced for each of the documents D placed on the document storage tray 102.

When the print start key 202 on the control panel 200 is depressed by the operator, the documents D placed on the document storage tray 102 of the document feeder unit 12 are supplied one after another from the tray 102. Each of the documents D is passed over to the upper face of the document support table 14 by way of the supply-side turning path portion 122 by means of the document supply assembly 104 under the control of the second subsidiary microprocessor 256 as has been described in detail.

The sorting mode being selected, the document-moved scanning mode is automatically selected so that the document scale member 142 is held in the first angular position thereof and has its leading end located below a plane flush with the upper face of the document support table 14. The document which has been moved to the terminating end of the intermediate path portion 124 is accordingly allowed to travel freely from the intermediate path portion 124 to the return-side turning path portion 126 past the document scale member 142.

With the document-moved scanning mode selected, the scanner units 34/36 and 38/40 of the optical system 32 are held at rest in their respective home positions indicated by phantom lines in FIG. 1A so that the images on the document are scanned while the document is travelling on the document support table 14 at a fixed speed.

In the image reproducing stage of the main duplicator module 10, the image on the document thus scanned is reproduced on a print sheet by the electrophotographic process which is well known in the art and which will not be herein described.

Each of the documents D is in this manner duplicated and moved on the document support table 14 repeatedly until every one of the documents D is duplicated a number of times that is equal to the quantity of printed outputs designated by the operator. Accordingly, the printed outputs are assorted to form two or more sets of printed outputs with each set of printed outputs paged correspondingly to the set of documents D.

Figure 7:
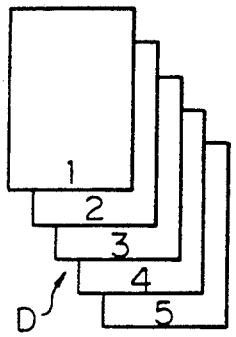
FIGS. 7, 8 and 9 are schematic views showing an example of the manner in which documents are to be duplicated in the document-moved scanning mode with the sorting mode selected.
Figure 8:
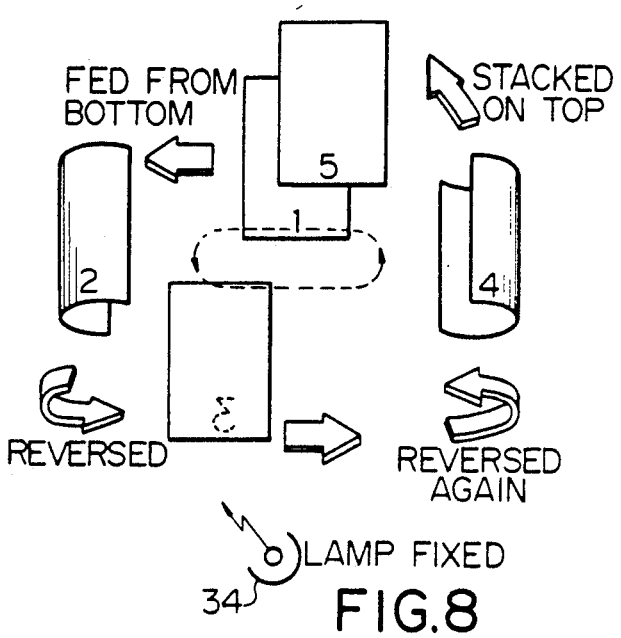
Figure 9:
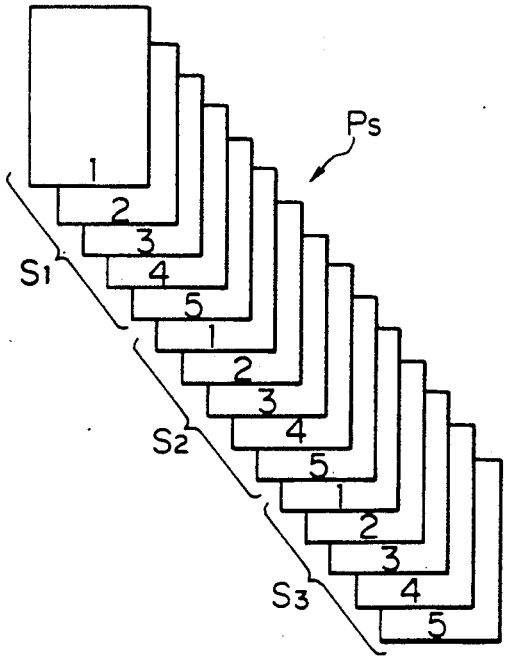

FIGS. 7, 8 and 9 show the manner in which documents D are to be duplicated in the document-moved scanning mode with the sorting mode concurrently selected as has been described.

It is assumed that three printed outputs are to be produced for each of five documents D respectively paginated 1, 2, 3, 4 and 5 and stacked with the document of page 5 at the bottom, as shown in FIG. 7. When the document-moved scanning mode is selected for the duplication of these documents D, the documents D will be successively fed to the document support table 14 in a sequence of page 5, page 4, . . . page 1 and scanned by the scanner units 34/36 and 38/40 of the optical system 32 which are fixedly held in position with respect to the document support table 14. As illustrated schematically in FIG. 8, each of the documents D is supplied from the bottom of the stack of documents, turned upside down, moved straight on the exposure table and scanned by the exposure lamp fixed, turned upside down for a second time, and placed on top of the stack of the documents D. As a result of the three cycles of duplicating operation, there will be produced three sets $S_1$, $S_2$ and $S_3$ of printed outputs $P_s$ with each set of printed outputs paged correspondingly to the set of documents D, as shown in FIG. 9.

Case II

The grouping mode is selected at key 224 and two or more printed outputs are to be produced for each of the documents D placed on the document storage tray 102.

When the print start key 202 on the control panel 200 is depressed by the operator, the documents D placed on the document storage tray 102 of the document feeder unit 12 are also supplied one after another to the upper face of the document support table 14. The grouping mode being selected, the scanner-moved scanning mode is automatically selected so that the document scale member 142 is held in the second angular position thereof and has its leading end located above the plane flush with the upper face of the document support table 14. The document which has been moved to the intermediate path portion 124 is accordingly held in position on the document support table 14 and is prevented from travelling to the return-side turning path portion 126.

With the scanner-moved scanning mode selected, the scanner units 34/36 and 38/40 provided in the optical system 32 are driven to move each along the document support table 14 for scanning the document fixed on the document support table 14 by a number of times that is equal to the designated quantity of printed outputs. The images of the document thus scanned are reproduced on print sheets as in Case I.

Each of the documents D is in this manner duplicated repeatedly while being fixed on the document support table 14 until every one of the documents D is duplicated a number of times equal to the quantity of printed outputs designated by the operator. The printed outputs are thus grouped to form five groups of printed outputs with each group of printed outputs commonly paged correspondingly to each of the documents D.

Figure 10:
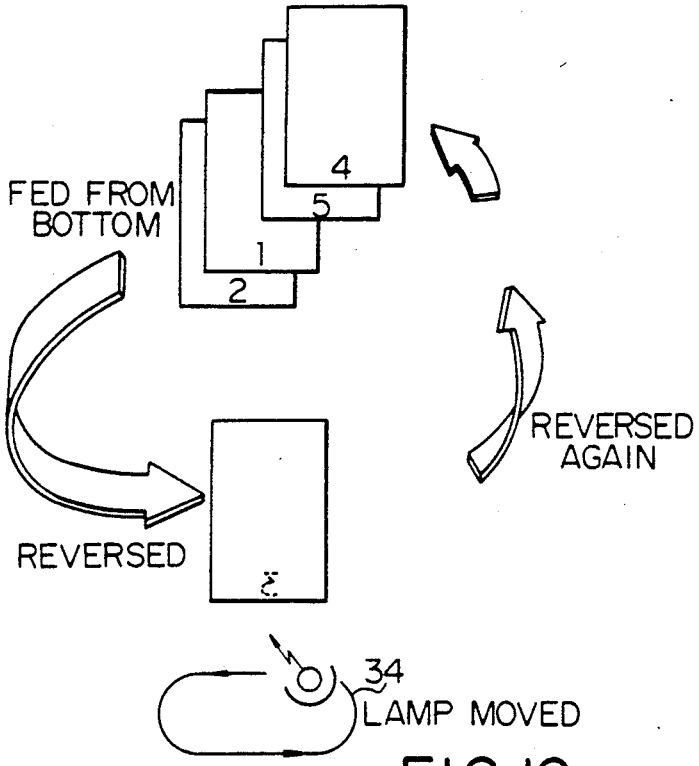
FIGS. 10 and 11 are schematic views showing an example of the manner in which documents are to be duplicated in the scanner-moved scanning mode with the grouping mode selected.
Figure 11:
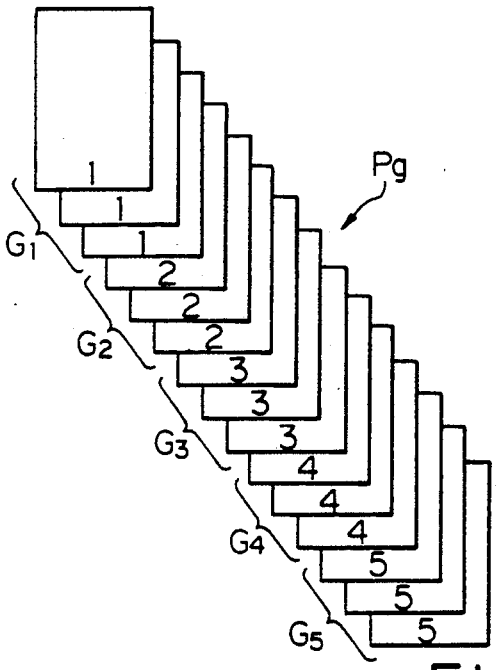

FIGS. 10 and 11 show the manner in which documents D are thus duplicated in the scanner-moved scanning mode with the grouping mode selected.

It is herein also assumed that three printed outputs are to be produced for each of five documents D respectively paginated 1, 2, 3, 4 and 5 and stacked with the document of page 5 at the bottom, as shown in FIG. 7. These documents D are also successively fed to the document support table 14 in a sequence of page 5, page 4, . . . page 1 and scanned by the scanner units 34/36 and 38/40 of the optical system 32 moved along the document support table 14. As illustrated schematically in FIG. 10, each of the documents D is supplied from the bottom of the stack, turned upside down, fixed on the exposure table, scanned by the exposure lamp which is three times driven for reciprocating movement along the table, turned upside down for a second time, and placed on top of the stack of the documents D. As a result of the five cycles of duplicating operation, there will be produced five groups $G_1$, $G_2$, $G_3$, $G_4$, and $G_5$ of printed outputs $P_g$ with each group of printed outputs commonly paged correspondingly to each of the documents D, as depicted in FIG. 11.

Figure 12:
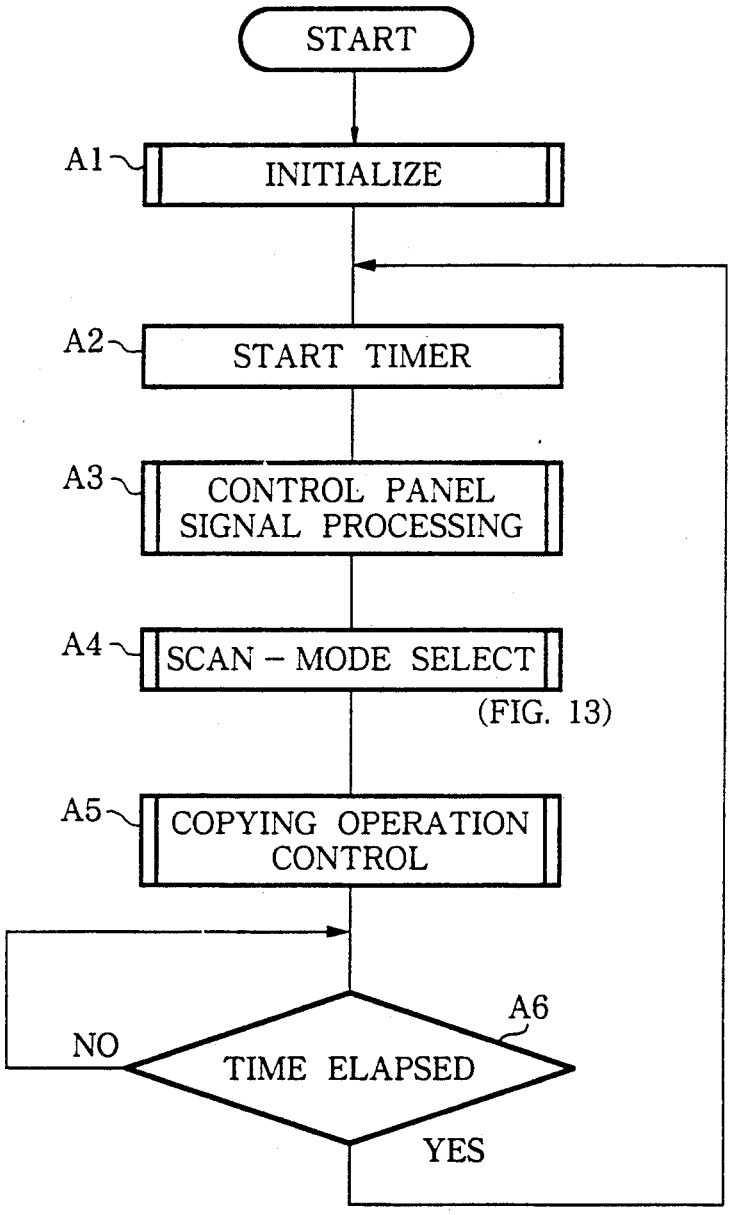
FIG. 12 is a flowchart showing the flow of the main routine program to be executed by a main microprocessor forming part of the control circuit illustrated in FIG. 3.
Figure 13:
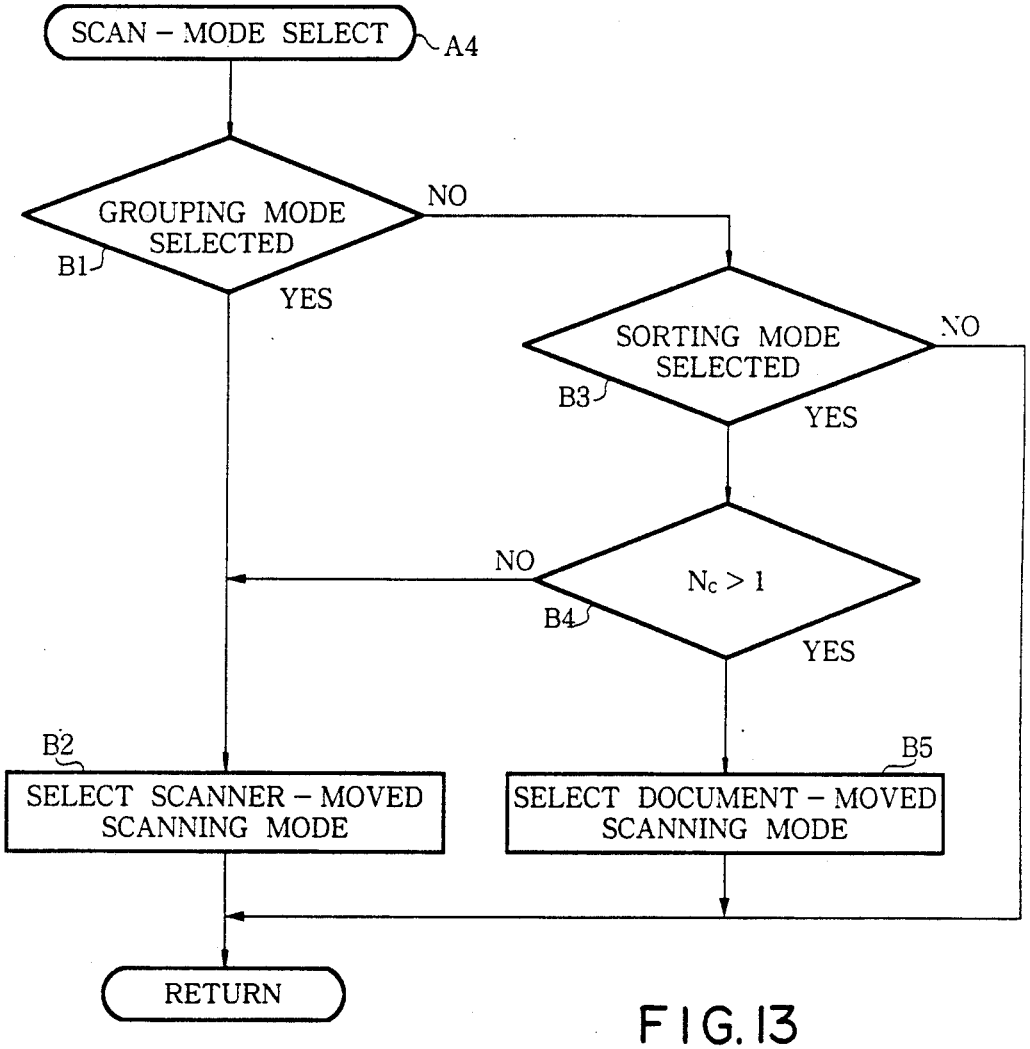
FIG. 13 is a flowchart showing the details of a scan-mode select subroutine program included in the main routine program illustrated in FIG. 14.

FIG. 12 is a flowchart showing the flow of the main routine program to be executed by the main microprocessor 252 which forms part of the control circuit 250 hereinbefore described with reference to FIG. 3. Furthermore, FIG. 13 is a flowchart showing the details of a scan-mode select subroutine program included in the main routine program illustrated in FIG. 12.

Main Routine Program

The main microprocessor 252 is activated to start execution of the main routine program when the main switch (which is usually the power supply switch, not shown) of the apparatus is closed or the microprocessor 252 is reset. Thus, the main microprocessor 252 first proceeds to step A1 to initialize all the variable parameters in the system to the starting values selected by the system default rules. At this step A1, the contents of the memory 264 and various registers provided in the microprocessor 252 are thus cleared and the various active units, devices and elements of the duplicating apparatus are set in predetermined initial conditions.

On completion of the initialization of the system, the main microprocessor 252 proceeds to step A2 to activate the internal timer which is set for a period of time required for the single itineration through the subsequent steps of the main routine program. Subsequently, the main microprocessor 252 proceeds to subroutine program A3 to process the signals which may have been received from the control panel 200 and sends signals to selectively actuate the various indicators and display elements provided on the control panel 200.

The subroutine program A3 is followed by a scan-mode select subroutine program A4 at which the main microprocessor 252 selects either the document-moved scanning mode or the scanner-moved scanning mode for the copying operation which is about to be carried out. The details of this scan-mode select subroutine program A4 will be hereinafter described with reference to FIG. 13.

Subsequently to the scan-mode select subroutine program A4, the main microprocessor 252 proceeds to subroutine program A5 to process the signals received and generates signals to actuate the various active units and elements which contribute to the execution of copying operation. The main microprocessor 252 then proceeds to step A6 to check if the period of time set for the internal timer has elapsed. When it is confirmed at step A6 that the period of time set for the timer has elapsed, the microprocessor 252 reverts to step A2 and reiterates the step A2, subroutine programs A3 to A5 and step A6.

Scan-Mode Select Subroutine Program

The scan-mode select subroutine program A4 starts with step B1 at which the main microprocessor 252 checks if the grouping mode is selected from the sorting/grouping select key 224 on the control panel 200. When the answer for this step B1 is given in the affirmative, the microprocessor 252 selects the scanner-moved scanning mode at step B2. After the scanner-moved mode is thus selected at step B2, the microprocessor 252 returns to the main routine program described with reference to FIG. 12.

If it is determined at step B1 that the grouping mode is not selected, the main microprocessor 252 proceeds to step B3 to check if the sorting mode is selected from the key 224 on the control panel 200. When the answer for this step B3 is given in the affirmative, then the microprocessor 252 confirms at step B4 if the quantity $N_c$ of the printed outputs to be produced for each document is two or more.

If the answer for this step B4 is given in the affirmative, the microprocessor 252 proceeds to step B5 to select the document-moved scanning mode. If it is found at step B4 that it is not required that two or more printed outputs be produced for each document, the microprocessor 252 proceeds to step B2 to select the scanner-moved scanning mode. After the scanner-moved or document-moved scanning mode is thus selected at step B2 or B5, respectively, or when the answer for step B3 is given in the negative, the main microprocessor 252 returns to the main routine program described with reference to FIG. 12.

As will have been understood from the foregoing description, the first preferred embodiment of a scan-mode changeable image duplicating apparatus according to the present invention is advantageous in that the apparatus is capable of automatically selecting one of the document-moved and scanner-moved scanning modes depending on the mode of copying operation selected by the user.

SECOND PREFERRED EMBODIMENT

Description will be hereinafter made with reference to FIGS. 14A and 14B regarding the general mechanical construction and arrangement of a second preferred embodiment of a scan-mode changeable image duplicating apparatus according to the present invention.

Figure 14A:
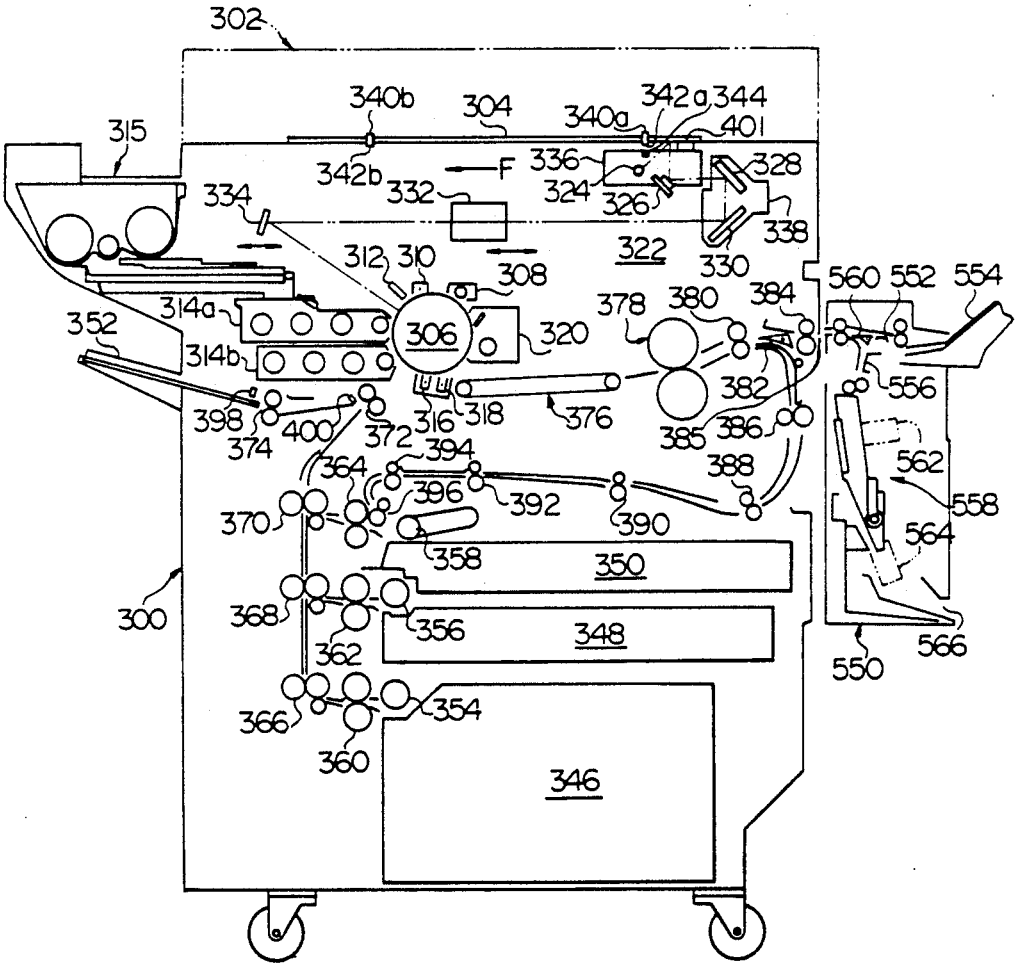
FIG. 14A is a schematic front elevation view showing the general mechanical construction of the main duplicator module of a second preferred embodiment of a scan-mode changeable image duplicating apparatus according to the present invention.
Figure 14B:
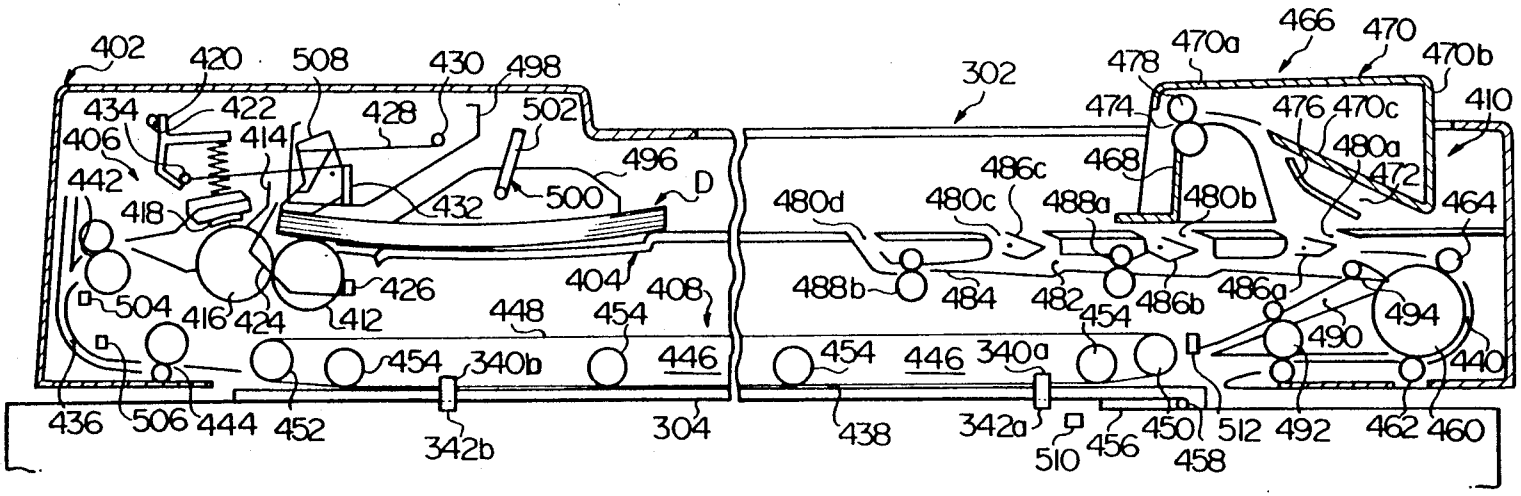
FIG. 14B is a fragmentary front elevation view showing the general mechanical construction of the recirculating document feeder unit of the second preferred embodiment of the image duplicating apparatus according to the present invention.

Similarly to the first preferred embodiment of the present invention, the scan-mode changeable image duplicating apparatus implementing the second preferred embodiment generally comprises a main duplicator module 300 illustrated in FIG. 14A, and a document feeder unit 302 of the RDH type mounted on the main duplicator module 300 as shown in FIG. 14B.

[2/1] Construction of Main Duplicator Module 300

Referring first to FIG. 14A, the main duplicator module 300 comprises a transparent document support table 304 of typically glass. Approximately centrally of the main duplicator module 300 is positioned a photosensitive drum 306 which is to be driven for counter-clockwise rotation by a main drive motor (not shown).

Around the photosensitive drum 306 are disposed various active devices contributing to reproduction of the images picked up from the document scanned. Such active devices form an image reproducing stage in the main duplicator module 300 and typically include a charge eraser lamp 308, a main charger 310, a selective charge eraser 312, first and second developing units 314*a* and 314*b*, a transfer charger 316, a separation charger 318, and a cleaner device 320 of the blade type as shown. The developing units 314*a* and 314*b* include respective rotatable members each to be driven for rotation by a motor (not shown).

The photosensitive drum 306 has a peripheral surface formed by a photosensitive layer which is to be sensitized by charges applied thereto when the drum 306 is driven to turn in the vicinity of the main charger 310.

Below the document support table 304 is provided an optical system 322 which is arranged to optically scan the images on a document placed on the document support table 304. The optical system 322 comprises an exposure lamp 324, first, second and third movable reflector mirrors 326, 328 and 330, a lens unit 332 and a fourth reflector mirror 334 as shown. The exposure lamp 324 and the first reflector mirror 326 are jointly supported on a common slide carrier 336 and thus implement a first movable scanner unit 324/326 and the second and third reflector mirrors 328 and 330 are jointly supported on a common slide carrier 338 and implement a second movable scanner unit 328/330. These first and second movable scanner units 326/328 and 328/330 are movable along the document support table 304 and are driven for movement by means of a scanner drive motor (not shown).

During scanner-moved mode of scanning operation, the first movable scanner unit 324/326 is driven for movement in the direction of arrow F at a speed V/N and the second movable scanner unit 324/326 is driven for movement in the direction of arrow F at a speed V/2N, where V is the peripheral speed of rotation of the photosensitive drum 306 and N is the selected R/M ratio. An image-bearing document fixedly held in position on the document support table 304 is thus scanned by means of the first and second movable scanner units 324/326 and 328/330 and the resultant information-carrying beam of light is directed from the stationary reflector mirror 334 toward the photosensitive drum 306. On termination of the scanning operation, the scanner units 324/326 and 328/330 are returned to their respective home positions with respect to the document support table 304.

On the other hand, when the document-moved scanning mode is established, a document is driven to move on the table 304 with the movable scanner units 324/326 and 328/330 of the optical system 306 fixedly held in place with respect to the document support table 304. The resultant information-carrying beam of light is also directed from the stationary reflector mirror 334 to the photosensitive drum 306. In this document-moved scanning mode, the document on the document support table 304 is driven to move at a fixed speed on the table 304 by means of the document feed unit 12. It may be herein noted that the document-moved scanning mode of operation can be performed not by a document feeder unit of the RDH type but an ordinary document feeder unit of non-RDH type or by means capable of simply moving a document on the document support table 304.

The control lens unit 332 is driven for movement by a lens drive motor (not shown) to adjust the effective R/M ratio for image reproduction. Consonantly with the movement of the lens unit 332, the fourth reflector mirror 334 is driven to slightly move or turn with respect to the lens unit 32 so as to compensate for the dislocation from the in-focus point and ensure the information-carrying beam to correctly reach the peripheral surface of the photosensitive drum 306.

In the scanner-moved scanning mode of operation, a change in the effective R/M ratio results in a change in the speed V/N of movement of the first scanner unit 324/326 and the speed V/2N of movement of the second movable scanner unit 328/330. On the other hand, in the document-moved scanning mode of operation, a change in the effective R/M ratio results in a change in the speed at which a document is to be driven to travel on the document support table 304. In either of the scanner-moved and document-moved scanning mode, the speed at which a document is to be scanned becomes lower and accordingly the time duration for which the exposure lamp 324 is required to be turned on becomes longer as the R/M ratio selected becomes larger particularly when the R/M ratio is larger than unity, that is, $N>1$. This means that the exposure lamp 324 is required to be continuously turned on for a long period of time when the magnified image reproducing operation is to be performed in the document-moved scanning mode. The exposure lamp 324 being fixed with respect to the document support table 304 in the document-moved scanning mode, the result will be that a particular portion of the document support table 304 close to the exposure lamp 324 is heated to unusually high temperature. Such a localized portion of the document support table 304 will be heated to a prohibitively high temperature especially when a large number of documents D are to be duplicated in a single cycle of duplicating operation.

A useful expedient to avoid or at least alleviate this problem is to make it a rule to automatically select the scanner-moved scanning mode unconditionally when an R/M ratio larger than unity is selected and to prohibit selection of the document-moved scanning mode for magnified duplicating operation. Thus, when magnified duplicating operation is to be performed, it is required that the document feeder unit 302 of the RDH type be conditioned to operate in such a manner as to move a document to a predetermined exposure position on the document support table 304.

With the uniformly charged peripheral surface of the photosensitive drum 306 exposed to the information-carrying beam directed from the optical system 322, electrostatic latent images corresponding to those picked up from the document are produced on the peripheral surface of the drum 306 as has been described. The latent images thus produced on the drum 306 are converted into visible toner images when the latent images are moved past the first or second developing unit 314*a* or 314*b*. The visualized toner images are transferred to the surface of a print sheet by means of the transfer charger 316 when the print sheet passes between the drum 306 and the transfer charger 316.

The first developing unit 314*a* has stored therein a stock of black toner particles and the second developing unit 314*b* has stock of toner particles of a color other than black. Black toner particles are ordinarily consumed at a higher rate than otherwise colored toner particles and, for this reason, a black-toner refiller 315 is provided in association with the first developing unit 314*a* so that the developing unit 314*a* is constantly replete with black toner particles.

The operator of the apparatus is allowed to select one of the first and second developing units 314*a* and 314*b* for developing the latent images into black or otherwise colored visible toner images. If desired, one of the developing units 314*a* and 314*b* may be activated first and the other activated thereafter for developing the latent images produced by a single cycle of exposure to information-carrying beam. As a result of such a two-stage developing process, images will be formed in one color in one area of the print sheet and in another color in another area of the sheet. This mode of duplicating operation is herein referred to as "simultaneous multi-colored copying mode".

The boundary between the differently colored areas of a print sheet on which images are to be produced in this simultaneous multi-colored copying mode is defined by means of first and second index elements 340*a* and 340*b*. These index elements 340*a* and 340*b* are located close to one longitudinal edge of the document support table 304 and are movable along the edge of the table 304. The index elements 340*a* and 340*b* are thus moved along the longitudinal edge of the document support table 304 to define locations of boundary lines between desired differently colored areas of a print sheet. To the index elements 340*a* and 340*b* are attached permanent magnet members 342*a* and 342*b*, respectively, which are provided in association with a magnet-sensitive lead switch 344 carried on the slide carrier 336 carrying the first scanner unit 324/326. While the slide carrier 336 is being driven to move along the document support table 304 in a direction of arrow F so that the document on the table 304 is being scanned by the scanner unit 324/326, the locations of the magnet members 342*a* and 342*b* and accordingly the first and second index elements 340*a* and 340*b* are detected by the lead switch 344. The first and second developing units 314*a* and 314*b* are thus put into operation one after the other according to the timings at which the locations of the first and second index elements 340*a* and 340*b* are detected by means of the lead switch 344.

Throughout duplicating operation in the document-moved scanning mode, the scanner units 324/326 and 328/340 and accordingly the lead switch 344 on the slide carrier 366 are held at rest with respect to the document support table 304. Thus, the locations of the index elements 340*a* and 340*b* can not be detected by the lead switch 344 during document-moved scanning mode of operation when the document-moved scanning mode is selected along with the simultaneous multi-colored copying mode. It is, for this reason, preferable to automatically select the scanner-moved scanning mode when the simultaneous multi-colored copying mode is selected.

In the main duplicator module 300 is further provided a print-sheet supply stage which comprises a first sheet supply unit 346, a second sheet supply unit 348 and a sheet re-supply unit 350. A print sheet on which a document is to be duplicated is supplied from any one of these first and second sheet supply units 346 and 348 and sheet re-supply unit 350 or from a manual sheet supply table 352 attached to the main duplicator module 300.

From the first or second sheet supply unit 346 or 348 or the sheet re-supply unit 350, print sheets are successively drawn out by a pickup roller 354, 356 or 358, respectively, and are each passed through an associated pair of restricting rollers 360, 362 or 364 which restrict passage of two or more sheets therebetween. The print sheet is then passed through pairs of feed rollers 366, 368 and 370 toward a pair of timing rollers 372. A print sheet supplied from the manual sheet supply table 352 is directly passed through a pair of feed rollers 374 toward the timing roller pair 372.

The print sheet thus supplied from one of the sheet supply units 346 and 348 is then passed between the pair of timing rollers 372 and is allowed to travel between the peripheral surface of the drum 306 and transfer charger 316. While the print sheet is thus travelling between the transfer charger 316 and the rotating drum 16, the visible toner images on the peripheral surface of the drum 16 are transferred to the print sheet by the action of the transfer charger 316. The print sheet which has thus received the visible toner images from the photosensitive drum 306 is separated from the peripheral surface of the drum 306.

The main duplicator module 300 has further provided therein an endless belt assembly 376 and a toner image fixing assembly 378 which are provided in a path of print sheet downstream of the separation charger 318. The print sheet is then passed through a pair of transfer rollers 380 to a rockable two-position travel shifter 382 which is rockable between a first angular position forming a sheet discharge passageway and a second angular position forming a sheet recirculation passageway.

When the sheet discharge passageway is formed with the travel shifter 382 turned to the first angular position, the print sheet rightwardly conveyed past the transfer roller pair 380 is withdrawn from the main duplicator module 300 through a sheet discharge roller pair 384 located immediately downstream of the sheet-path shifter 382 and a sheet discharge port 385 which is open at the left end of the main duplicator module 300 as shown.

On the other hand, when the sheet recirculation passageway is formed with the travel shifter 382 turned to the second angular position, the print sheet conveyed past the transfer roller pair 380 is directed downwardly by means of a pair of guide rollers 386. The print sheet is further driven to travel leftwardly along a passageway defined by a series of guide roller pairs 388, 390, 392, 394 and 396. This passageway subsequent to the guide roller pair 386 is arranged so that the print sheet is finally received in the sheet re-supply unit 350 with its printed surface directed either upwardly or downwardly depending on the duplex printing mode or the composite printing mode selected.

The print sheet thus stored temporarily in the sheet re-supply unit 350 is thereafter drawn out by the pickup roller 358 and is passed through the associated pair of restricting rollers 364. The print sheet is then passed through the feed roller pair 370 toward the timing roller pair 372.

When the duplex printing mode is selected so that the print sheet is received in the sheet re-supply unit 350 with its printed surface directed upwardly, the print sheet re-supplied from the unit 350 is turned upside down while the sheet is being thus conveyed toward the timing roller pair 372. The print sheet is in this manner for a second time fed to the photosensitive drum 306 with its printed surface directed downwardly and accordingly its fresh surface directed upwardly with respect to the drum 306. On the other hand, when the print sheet is received in the sheet re-supply unit 350 with its printed surface directed downwardly with the composite printing mode selected, the print sheet re-supplied from the unit 350 is turned upside down while the sheet is being thus conveyed toward the timing roller pair 372. The print sheet is thus for a second time fed to the photosensitive drum 306 with its printed surface directed upwardly.

In the main duplicator module 300 are further provided various sensors and detectors. These sensors and detectors include a manually-fed sheet detecting switch 398 which is adapted to detect a print sheet manually supplied into the main duplicator module 300 from the manual sheet supply table 352, and a timing detect switch 400 for detecting the timing at which a print sheet has reached the timing roller pair 372. The sensors and detectors provided in the main duplicator module 300 further include a home position sensor 401 responsive to the presence of the first scanner unit 324/326 in a predetermined home position from which the scanner unit is to be moved for scanning a document on the document support table 304.

[2/2] Construction of Recirculating Document Feeder Unit 302

Turning to FIG. 14B, the document feeder unit 302 comprises a casing 402 positioned on and covering the document support table 304 of the main duplicator module 300 and having a document storage tray 404 formed by a downwardly concave bottom panel portion of the casing 402. The document storage tray 404 is adapted to has stored thereon a stack of documents D.

In the casing 402 are accommodated a document supply assembly 406, a document transport assembly 408, and a document returning assembly 410. The document supply assembly 406 is disposed within one end portion of the casing 402 and is adapted to successively deliver documents D from the document storage tray 404 to the document transport assembly 408. The document transport assembly 408 is arranged on the document support table 304 and is adapted to transport a document from the document supply assembly 406 to the document returning assembly 410. The document returning assembly 410 is disposed within another end portion of the casing 402 and is adapted to return the document to the document storage tray 404.

The document supply assembly 406 comprises a pickup roller 412 and a document pre-handling member 414. The pickup roller 412 has an upper end substantially level with the upper face of the document storage tray 404. The pickup roller 412 is thus operative to draw documents D one after another from the storage tray 404 toward the document pre-handling member 414. The document pre-handling member 414 is located immediately downstream of the pickup roller 412 and forms over the pick roller 412 a slight gap allowing a small number of documents D to pass therethrough. The document pre-handling member 414 allows the documents D to advance until the documents D are brought at their leading ends with the pre-handling member 414 and restrains the documents D from travelling beyond the pre-handling member 414 except for some lower ones of the documents D. The pickup roller 412 and the document pre-handling member 414 are thus operative in combination to allow a small number of documents D to leave the pickup roller 412 and travel past the document pre-handling member 414 successively from the lowermost one of the documents D. The document pre-handling member 414 is further useful for adjusting the direction of movement of the document supplied from the pickup roller 412.

The document supply assembly 406 further comprises a document feed roller 416 and a document handling pad 418. The document feed roller 416 is located subsequently to the pickup roller 412. The document handling pad 418 has its leading end resting on the peripheral surface of the document feed roller 416. As the documents D allowed to advance past the document pre-handling member 414 are supplied successively from the pickup roller 412, the document handling pad 418 prevents leftward movement of the documents D overlying the lowermost one of the documents D so that only the lowermost one of the documents D on the pickup roller 412 is allowed to travel on the document feed roller 416.

Both the document pre-handling member 414 and document handling pad 418 are attached to a lever 420 which is rockable on a pivot shaft 422 secured or journalled to the casing 402. The lever 420 is urged to turn counter clockwise about the pivot shaft 422 by its own weight and further by the force of a spring (not numbered) engaging the lever 420. Thus, the document handling pad 418 has its leading end portion forced against the peripheral surface of the roller 416 and the document pre-handling member 414 has its leading end located on a predetermined vertical plane with respect to the upper traveling path portion of the pickup roller 412. By preference, the document pre-handling member 414 may be securely attached to the casing 402, though not shown in the drawings.

Anterior to the document pre-handling member 414 is located a document stop member 424 which is rockable at one end on a pivot shaft 426 between an upwardly turned operative angular position and a downwardly turned inoperative angular position. When turned upwardly to the operative angular position about the pivot shaft 426, the stop member 424 prevents forward (or leftward in FIG. 14B) movement of the document away from the pickup roller 412. On the other hand, when turned downwardly to the inoperative angular position about the pivot shaft 426, the stop member 424 allows the document to travel forwardly away from the pickup roller 412.

Above the pickup roller 412 is positioned a document retaining member 428 which is rockable at one end on a pivot shaft 430 between a downwardly turned operative angular position and an upwardly turned inoperative angular position. When turned downwardly to the operative angular position about the pivot shaft 430, the retaining member 428 presses against the stack of documents D on the document storage tray 404. On the other hand, when turned upwardly to the inoperative angular position about the pivot shaft 430, the retaining member 428 is spaced apart upwardly from the stack of the documents D on the tray 404.

There is further provided a returned-document stop member 432 which is disposed anterior to the document path leading from the pickup roller 412. The returned-document stop member 432 is rockable on a pivot shaft 434 between a downwardly turned operative angular position and an upwardly turned inoperative angular position. When turned downwardly to the operative angular position about the pivot shaft 434, the returned-document stop member 432 prevents a document returned to the document storage tray 404 from forwardly (or leftwardly in FIG. 14B) advancing to a position resting on or having its leading end portion located above the pickup roller 412, as will be understood more clearly as the description proceeds. On the other hand, when turned downwardly to the inoperative angular position about the pivot shaft 434, the stop member 430 allows forward (or leftward) movement of the document to the position resting on or having its leading end portion located above the pickup roller 412.

On the other hand, the document transport assembly 408 arranged on the document support table 304 defines a continuous document transport path which consists of a vertically curved supply-side turning path portion 436, a straight intermediate path portion 438, and a vertically curved return-side turning path portion 440. The supply-side turning path portion 436 is subsequent to the document feed roller 416 and turns downwardly and righwardly to merge into the straight intermediate path portion 438. The intermediate path portion 438 extends straight on the document support table 304 from the terminating end of the supply-side turning path portion 436 and merges at its rear end into the return-side turning path portion 440. The return-side turning path portion 440 turns upwardly and leftwardly from the terminating end of the intermediate path portion 438 and is leftwardly directed toward the document storage tray 402.

The supply-side turning path portion 436 is defined in part by a pair of transfer rollers 442 and in part by a pair of pinch rollers 444. The transfer roller pair 442 is located in the vicinity of the starting end of the path portion 436 and downstream of the document feed roller 416. The transfer roller pair 436 is to be driven for rotation at a speed slightly higher than the speed at which the document feed roller 416 is to be driven for rotation. The pinch roller pair 444 is located in the vicinity of the terminating end of the supply-side turning path portion 436, viz., immediately anterior to the intermediate path portion 438.

Thus, the transfer roller pair 442 receives the document advancing past the document feed roller 416 toward the supply-side turning path portion 436 and drives the document to travel along the supply-side turning path portion 436. The document feed roller 416 has incorporated therein a solenoid-operated one-way clutch (not shown) and races or idles away as the document is being passed from the roller 416 to the transfer roller pair 442 rotating at higher speed than the roller 416. Past the transfer roller pair 442, the document is driven to travel arcuately along the supply-side turning path portion 436 downwardly and rightwardly and is thus turned upside down by the time the document leaves the turning path portion 436.

The pinch roller pair 444 is held at rest until a predetermined period of time is elapsed after the document thus conveyed along the supply-side turning path portion 436 has reached the roller pair 444. If the document happens to have skewed on its way to the roller pair 444, the skewing of the document is remedied with the leading edge of the document forced uniformly along its length against the nip between the pair of rollers 444 until the roller pair 444 is driven for rotation. The document thus correctly directed rightwardly is then passed between the pair of pinch rollers 444 and is allowed to travel along the straight intermediate path 438 on the document support table 304. Thus, the pinch roller pair 444 defines the terminating end of the supply-side turning path portion 436, the starting end of which is defined by the transfer roller pair 442.

The straight intermediate path 438 on the document support table 304 is defined by a document transport belt assembly 446 which comprises an endless belt 448, a driving roller 450, a driven roller 452 and a plurality of guide rollers 454. The endless belt 448 is passed between the driving and driven rollers 450 and 452 and extends underneath the concave bottom panel portion of the casing 402 forming the document storage tray 404.

The endless belt 448 has a lower traveling portion held in close but slidable contact with the upper face of the document support table 304 by means of the guide rollers 454 disposed at suitable intervals between the driving and driven rollers 450 and 452 as shown. Thus, the document which has been passed from the supply-side turning path portion 436 to the straight intermediate path portion 438 is conveyed on the document support table 304 by means of the document transport belt assembly 446 toward the return-side turning path portion 440. It may be noted that, while the document is thus being moved on the document support table 304 or is fixedly held in position on the document support table 304 after the document reaches the terminating end of the intermediate path portion 438, the document is scanned by means of the scanner units 324/326 and 328/330 of the optical system 322 as has been described.

Rearwardly of the document support table 304, that is, in the vicinity of the terminating end of the straight intermediate path portion 438 is disposed a document scale member 456. The document scale member 456 has a rear end portion rockably mounted on a pivot shaft 458 secured or journalled to the casing 402. The scale member 456 is driven to turn between two angular positions about the axis of the pivot shaft by means of a solenoid-operated actuator (not shown). The angular positions between which the scale member 456 is thus rockable consist of a first angular position having its leftwardly directed leading end located below a horizontal plane flush with the upper face of the document support table 304 and a second position having its leading end located above such a plane.

With the scale member 456 held in the first angular position, the document which has been moved to the terminating end of the intermediate path portion 438 is allowed to travel continuously to the return-side turning path portion 440. On the other hand, when the scale member 456 is held in the second angular position, the document which has been moved to the terminal end of the intermediate path portion 438 is at its leading end brought into abutting contact with the leading end of the scale member 456 and is prevented from being passed to the return-side turning path portion 440.

The position of the document thus having its leading edge contacted by the document scale member 456 is the previously mentioned predetermined exposure position of the document in which the document is to be fixedly held in position on the document support table 304 for being scanned by the scanner units 324/326 and 328/330 of the optical system 322. Thus, the document scale member 456 is held in the first angular position when the document-moved scanning mode is selected to scan the document while the document is being moved in the document support table 304. On the other hand, when the scanner-moved scanning mode is selected to scan the document fixedly held in place on the document support table 304, the scale member 456 is held in the second angular position thereof.

The return-side turning path portion 440 is defined by a large-diameter document return roller 460 and lower and upper sets of small-diameter idler rollers 462 and 464. The idler rollers 462 and 464 are held in rollable contact with the peripheral surface of the return roller 460 in the neighborhood of the top and bottom, respectively, of the roller 460 as shown. The document transferred from the intermediate path portion 438 to the return-side turning path portion 440 is first passed between the return roller 460 and the lower set of idler rollers 462 and thereafter passed between the return roller 460 and the upper set of idler rollers 464. Thus, the lower and upper sets of idler rollers 462 and 464 define the starting and terminating ends, respectively, of the return-side turning path portion 440.

Between the lower and upper sets of idler rollers 462 and 464, the document is in this manner driven to travel arcuately along the return-side turning path portion 440 upwardly and leftwardly and is for a second time turned upside down by the time the document leaves the turning path portion 440. Past the upper set of idler rollers 464, the document leaving the return-side turning path portion 440 is directed toward the depression in the document storage tray 404 and is passed to and for a second time stored on the storage tray 404 through the rear end of the tray 404.

In the vicinity of the rear or rightmost end of the document storage tray 404 is provided a document guide assembly 466 which is in its entirety movable leftwardly and rightwardly in the depression in the document storage tray 404. The document guide assembly 466 is adapted to guide the movement of the document on the document storage tray 404 away from the return-side turning path portion 440 until the document is brought into contact with the document stop member 424 held in the downwardly turned first angular position thereof.

The document guide assembly 466 comprises a lower front guide member 468 having an L-shaped cross section and having a lower extension directed in a direction in which a document is to be returned into the document storage tray 404. The front guide member 468 is capable of pressing the documents leftwardly at the trailing ends of the documents stacked on the storage tray 404. The guide member 468, when driven to move leftwardly on the tray 404, is thus operative to press the documents leftwardly on the tray 404 until the documents are brought into abutting contact with the document stop member 424 located forwardly of the tray 404. The distance of leftward movement of the guide member 468 with respect to the document storage tray 404 depends on the size of the document returned to the tray 404.

The document guide assembly 466 further comprises a movable upper lid member 470 which is movable leftwardly and rightwardly together with the lower front guide member 468 with respect to the storage tray 404. The movable upper lid member 470 has an uppermost ridge portion **470*a* parallel with the document return roller 460 and protruding upwardly through an opening in the casing 402**.

The upper lid member 470 further has a rear panel portion **470*b* projecting rightwardly away from the ridge portion 470*a* and an internal panel portion 470*c* projecting upwardly and leftwardly from the lower end of the rear panel portion 470*b*. Between the front guide member 468 and the internal panel portion 470*c* of the lid member 470 is formed a main document guide passageway 472 which diverges toward the rear end of the lid member 470. The document guide passageway 472 thus formed between the front guide member 468 and the internal panel portion 470*c* of the lid member 470 leftwardly and upwardly terminates in a document discharge slot 474 which the panel portions 470*b* and 470*c* have formed at their foremost ends and which is elongated in parallel with the document return roller 460**.

Between the front guide member 468 and the internal panel portion **470*c* of the lid member 470 may be provided a partition member 476 to narrow the document-guide passageway 472 toward the forward (or leftward in FIG. 14B) end of the passageway 472 as shown for enabling the document to advance assuredly along the passageway 472. The document which has been conveyed past the return-side turning path portion 440 is accordingly enabled to travel reliably into the document guide passageway 472 without respect to leftward or rightward movement of the lid member 470 with respect to the document return roller 460**.

A pair of document discharge rollers 478 are disposed in close proximity to the document discharge slot 474 in the document guide assembly 466. The document being withdrawn from the document guide assembly 466 through the discharge slot 474 is thus driven to move leftwardly by this discharge roller pair 478 until the document is completely received on the document storage tray 404 with its trailing end moved past the roller pair 478.

The concave bottom panel portion of the casing 402 forming the document storage tray 404 has formed therein a plurality of lateral grooves or slots which are shown including first, second, third and fourth slots **480*a*, 480*b*, 480*c* and 480*d* located in this sequence leftwardly from the vicinity of the document return roller 460. These lateral slots 480*a*, 480*b*, 480*c* and 480*d* are located at predetermined distances from the document stop member 424 depending on the different standard sizes of documents D which are likely to be used on the apparatus. The front guide member 468 thus forming part of the guide assembly 466 is movable leftwardly and rightwardly with respect to the storage tray 404 so that the main document guide passageway 472 has its bottom inlet end is located over any one of these lateral slots 480*a*, 480*b*, 480*c* and 480*d***.

Below the document storage tray 404 is provided an auxiliary document guide passageway 482 defined by a guide plate 482 extending generally in parallel with the tray 404. The guide plate 484 has a rearmost end (or rightmost end in FIG. 14B) located close to the upper end of the document return roller 460 as shown. In the vicinity of the first, second and third slots 480*a*, 480*b* and 480*c* are disposed rockable slide elements 486*a*, 486*b* and 486*c*, respectively. Each of these slide elements 486*a*, 486*b* and 486*c* is rockable to and from a downwardly turned operative angular position allowing the associated slot to open. When the slide element 486*a*, 486*b* or 486*c* is turned to this angular position, the slide element is operative to guide the document to move from the auxiliary document guide passageway 482 upwardly over the upper face of the document storage tray 404. To aid in such movement of the document through any of the first to fourth slots 480*a* to 480*d*, there are provided a suitable number of document feed roller pairs such as those indicated at 480*a* and 480*b*.

When the document guide assembly 466 is moved to a position having the bottom end of the main document guide passageway 472 located above any one of the first, second and third slots 480*a*, 480*b* and 480*c*, the slide element 486*a*, 486*b* or 486*c* located below the particular slot is downwardly turned to the operative angular position thereof and allows the document to move from the auxiliary document guide passageway 482 upwardly into the main document guide passageway 472 within the guide assembly 466. On the other hand, when the document guide assembly 466 is moved to a position having the bottom end of the main document guide passageway 472 located above the fourth slot 480*d*, all the slide elements 486*a*, 486*b* and 486*c* are upwardly turned to their inoperative angular positions thereof. Under this condition, the document which has been passed to the auxiliary document guide passageway 482 is allowed to move upwardly into the main document guide passageway 472 in the guide assembly 466 through the fourth slot 480*d*. The document thus admitted into the guide assembly 466 is withdrawn from the guide assembly 466 through the discharge slot 474 by the discharge roller pair 478 until the document is contacted at its leading end by the document stop member 424 located leftwardly of the tray 404.

During duplex copying mode of duplicating operation, the document passed to the return-side turning path portion 440 is reversed and conveyed backwardly through the intermediate path portion 438 to the document storage tray 404. For this purpose, the document feeder unit 302 shown in FIG. 14B further comprises a backward document guide passageway 490 defined in part by a pair of backward transport rollers 492 located intermediate between the document return roller 460 and document transport belt assembly 466 as shown. The document which has been passed between the document return roller 460 and the upper idler roller 464 is thus guide to advance either toward the auxiliary document guide passageway 482 or toward the backward document guide passageway 490. A two-position travel shifter 494 is located immediately downstream of the nip between the document return roller 460 and upper idler roller 464. The travel shifter 494 is rockable between a first angular position selecting the auxiliary document guide passageway 482 and a second angular position selecting the backward document guide passageway 490. The travel shifter 494 has an associated solenoid-operated actuator (not shown) operative to actuate the shifter 494 to turn between these first and second angular positions thereof.

When the travel shifter 494 is turned to the second angular position selecting the backward document guide passageway 490, the document transport belt assembly 446 and the rollers associated with the supply-side turning path portion 436 are driven to operate in the opposite directions. The opposite directions herein referred to are the directions of operation of the belt assembly 446 and rollers opposite to those in which they operate in transporting a document from the supply-side turning path portion 436 to the intermediate path portion 438.

The casing 402 as a whole is hingedly connected at its rear end to the upper panel member (not shown) of the housing structure of the main duplicator module 300 shown in FIG. 14A and is rockable upwardly and downwardly over the document support table 304 about its rear end. When the casing 402 is thus turned open upwardly over the document support table 304, the operator is given access to the upper face of the document support table 304 and may manually place a document on the document support table 304 or remove the document which has been placed on the document support table 304.

In the neighborhood of the left end of the document storage tray 404 and in parallel with the front panel portion of the casing 402 is provided a movable document guide member 496 which is movable toward and away from the rear panel portion of the casing 402. The guide member 496 may be manually moved between the front and rear panel portions of the casing 402 to correctly set a document or documents D laterally on the document storage tray 404 depending on the width of the document or documents D.

Above a left end portion of the document storage tray 404 is fixedly positioned an upper document guide member 498 which has a lower surface portion slanting upwardly and rightwardly in FIG. 14B and a lower surface portion extending horizontally above the pickup roller 412 as shown. When a document or a set of documents are to be manually placed on the document storage tray 404, the guide member 498 thus positioned above the tray 404 guide the leading end of the document or the set of document to slide first on its lower surface portions so that the document or the set of documents has its leading portion stably rests on the pickup roller 412.

Immediately anterior to the document stop member 424 is provided a document feed wheel 500 having a feeder wing 500 of a pliable material such as polyurethane. The document feed wheel 500 is adapted to elastically impart a force effective to assist in the movement of the document being superposed on the stack of the documents D which have already been returned to the document storage tray 404.

In the document feeder unit 302 are further provided various sensors and detectors which include document travel sensors 504 and 506 located in the neighborhood of the starting and terminating ends, respectively, of the supply-side turning path portion 436 as shown. These document travel sensor 504 and 506 are responsive to passage of the leading end of a document through the starting and terminating ends, respectively, of the turning path portion 436. From the signals thus output at different timings from the sensors 504 and 506 can be calculated the speed at which the document is traveling along the supply-side turning path portion 436. The document is thus driven to travel at a speed controlled on detection of a change in the speed calculated from the output signals from the sensors 504 and 506. The time duration of the signal from one of these document travel sensors 504 and 506 is indicative of the longitudinal measurement of the document detected by the sensor. Thus, the size of the document which is about to be duplicated is detected on the basis of the signal output from the sensor 504 or 506 and the lateral position of the movable guide member 496, as will be described in more detail.

The sensors and detectors provided in the document feeder unit 302 further include a document empty sensor 508 for detecting the absence of a document on the document storage tray 404. When there is a document or a stack of documents D on the document storage tray 404, the document empty sensor 508 is allowed to rest on the document or the stack of documents D but, in the absence of a document on the tray 404, the detector 508 turns downwardly with no weight-bearing support provided therefor. Further provided in the document feeder unit 302 is a reversed document sensor 510 located below the document support table 304 and adapted to detect the trailing edge of a document being transferred from the return-side turning path portion 440 to the backward guide passageway 490.

The second preferred embodiment of an image duplicating apparatus according to the present invention further comprises a finisher unit 550 assembled to the main duplicator module 300 in conjunction with the sheet discharge port 385 which is open at the left end of the main duplicator module 300.

In the finisher unit 550 is defined a sheet discharge passageway 552 extending from the discharge port 385 to a sheet discharge tray 554, and a sheet stacking passageway 556 branched downwardly from the discharge passageway 552 and extending to a sheet stacking assembly 558. Each of these discharge and stacking passageways 552 and 556 is defined by drive/guide roller pairs and guide plates which are not herein described. Between the discharge and stacking passageways 552 and 556 is provided a rockable two-position travel shifter 560 having a first angular position selecting the sheet discharge passageway 552 and a second angular position selecting the sheet stacking passageway 556.

The sheet stacking assembly 558 is adapted to receive the printed outputs successively withdrawn from the main duplicator module 300 and passed through the sheet stacking passageway 556 and form a stack of the documents either in the sorting mode or in the grouping mode if two or more duplicates are being produced from each of the documents. On each of the complete sets of printed output thus stacked may be impressed any marking or the like by means of a stamper 562 and/or each set of printed outputs may be bound into book form by means of a stapler 564 provided in the unit 550. The sets of printed outputs are then withdrawn from the finisher unit 550 through a discharge port 566 located at the bottom of the unit 504 as shown.

When the travel shifter 560 is held in the first angular position selecting the sheet discharge passageway 554, the printed outputs successively withdrawn from the main duplicator module 300 and passed through the sheet discharge passageway 552 are stacked on one another on the sheet discharge tray 554. In this instance, the printed outputs are stacked on the tray 554 either in the sorting mode or in the grouping mode if two or more duplicates are being produced from each of the documents.

As has been explained with reference to FIG. 4, when the sorting mode is selected, the printed outputs P produced from the documents D of, for example, page 1, page 2 and page 3 are assorted to form two or more sets of printed outputs with each set of printed outputs paged 1, 2 and 3 correspondingly to the documents D of pages 1, 2 and 3. On the other hand, when the grouping mode is selected, the printed outputs P are grouped to form two or more groups of printed outputs with each group of printed outputs commonly paged 1, 2 or 3 correspondingly to each page 1, 2 or 3 of the documents D as has been explained with reference to FIG. 5.

Figure 15:
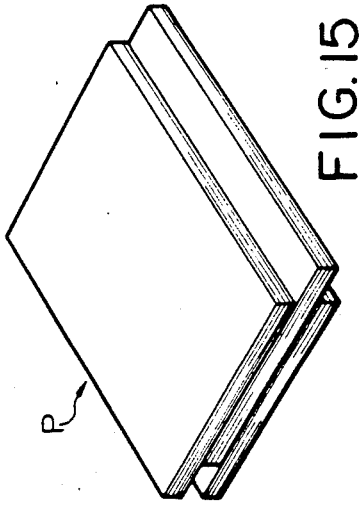
FIG. 15 is a schematic perspective view showing an example of the manner in which a plurality of sets of printed outputs produced from different documents are to be discharged and stacked on one another in the second preferred embodiment of the present invention.

If desired, arrangements may be made in the finisher unit 550 so that the document discharge tray 554 is to be driven to laterally move in one direction or the other each time a set or group of printed outputs P is discharged to the tray 554. In this instance, every set or group of printed outputs P received on the discharge tray 554 is laterally deviated in one direction or the other from each of the underlying and overlying sets of printed outputs P as indicated in FIG. 15 and will thus enable the operator or operators of the apparatus to readily distinguish one set or group of document from another on the tray 554.

Figure 16A:
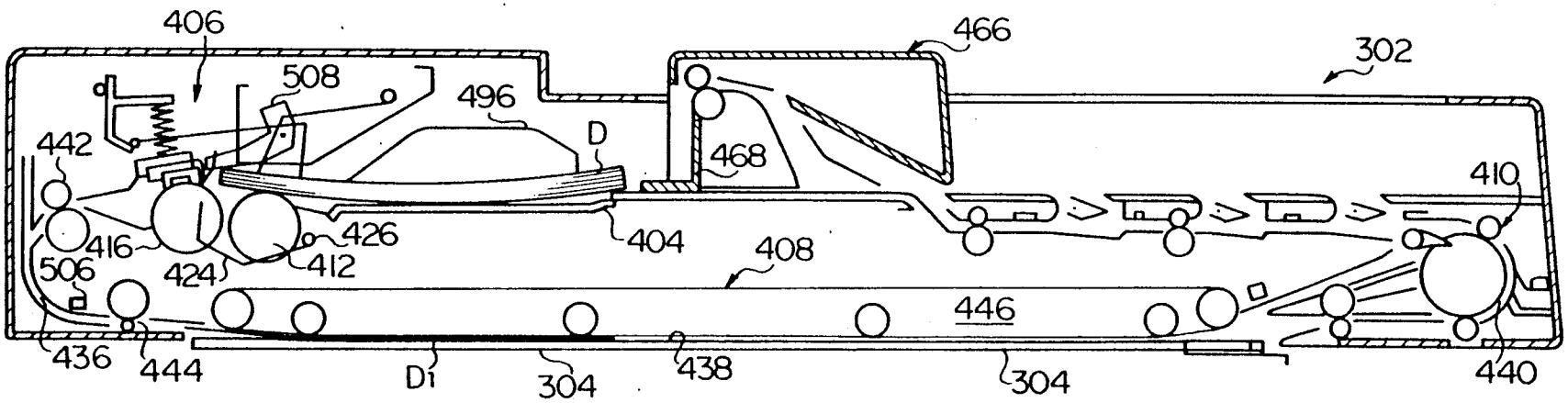
FIGS. 16A to 16C are schematic front elevation views of the recirculating document feeder unit of the second preferred embodiment of the present invention in the "two-in-one" mode operating condition.
Figure 16B:
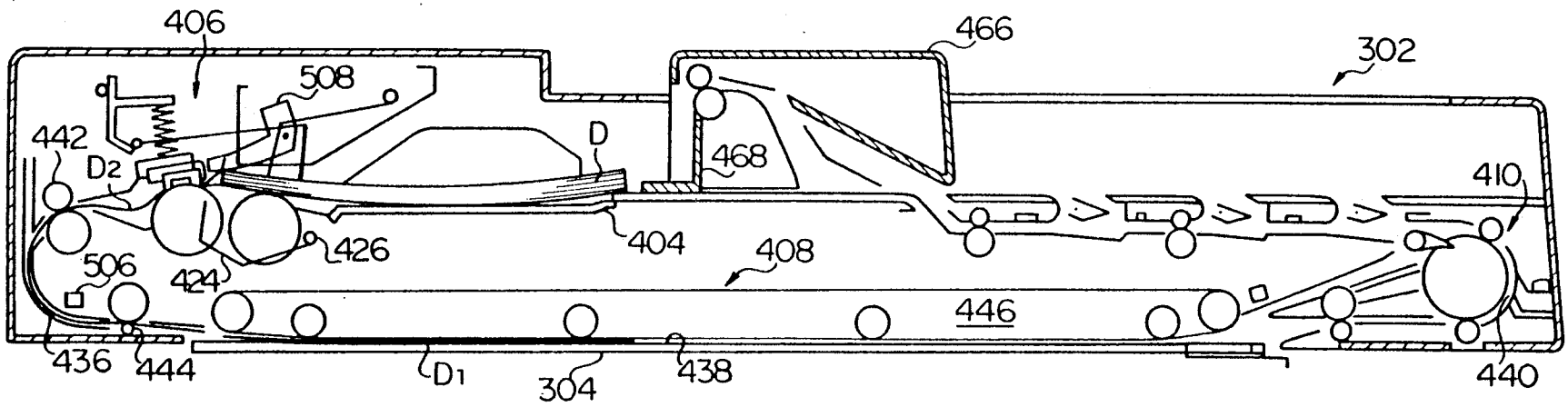
Figure 16C:
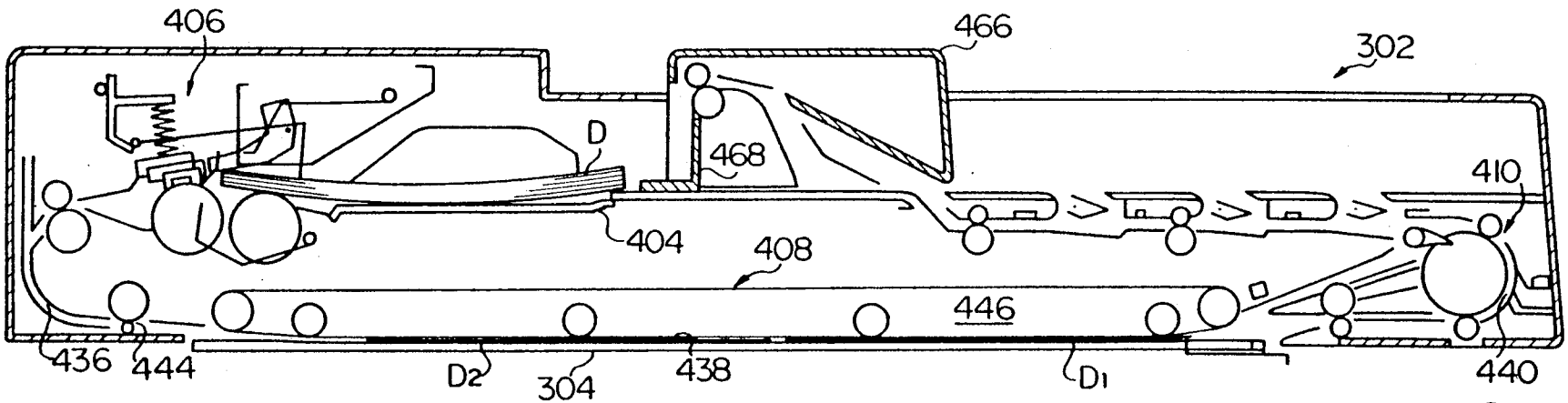

Whereas, the image duplicating apparatus equipped with the document feeder unit 302 of the RDH type has a two-in-one mode of duplicating operation in which two documents are supplied to the document support table 304 one after the other and are duplicated on a single print sheet in a single cycle of operation. FIGS. 16A to 16C show the procedure in which such a two-in-one mode of duplicating operation is performed in the document feeder unit 302 hereinbefore described with reference to FIG. 14B.

A first document $D_1$ is supplied from the document storage tray 404 and is brought to a stop immediately past the starting end of the intermediate path portion 438 as indicated in FIG. 16A at a predetermined timing after the document is first detected by the document travel sensor 506 located in the neighborhood of the terminating end of the supply-side turning path portion 436. This predetermined timing is selected such that the document $D_1$ has its trailing end moved immediately past the pinch rollers 444 after the trailing end of the document $D_1$ was detected by the sensor 506. The document $D_1$ is then fixedly held in position on the document support table 304. A second document $D_2$ is thereafter supplied from the document storage tray 404 and, at a timing the second document $D_2$ reaches a position having its leading end brought into contact with the trailing end of the first document $D_1$ as illustrated in FIG. 16B, the first document $D_1$ is moved from the fixed position toward the terminating end of the intermediate path portion 438 together with the second document $D_2$. When the first document $D_1$ immediately followed by the second document $D_2$ reaches the predetermined exposure position on the document support table 304 as illustrated in FIG. 16C, the two documents $D_1$ and $D_2$ are fixedly held in position on the table 304 and are scanned by the scanner units 324/326 and 328/330.

[2/3] Operation of Recirculating Document Feeder Unit 302

Description will now be made with reference to FIGS. 17A to 17K as to the operation of the document feeder unit 302 of the RDH type which is constructed and arranged as has been hereinbefore described.

Before the documents D to be duplicated are placed on the document storage tray 404. the document guide assembly 466 is driven to move to the position remotest from the document stop member 424 and the movable document guide member 496 is moved to the position closest to the panel portion of the casing 402. These positions of the guide assembly 466 and the guide member 496 are such that documents D of the largest standard size can be placed on the document storage tray 404 without being interfered by the guide assembly 466 and the guide member 496.

Figure 17A:
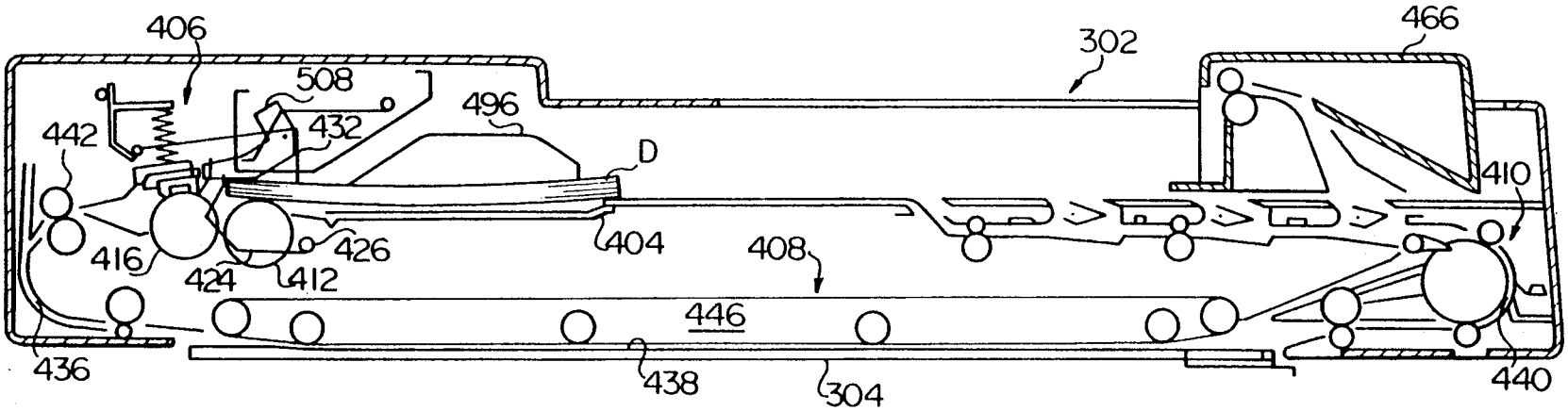

The operator will then place the documents D on the document storage tray 404 such that the stack of the documents D is at its left leading end brought into pressing contact with the document stop member 424 located close to the end of the tray 404, as illustrated in FIG. 17A. The step of moving the documents D toward the document stop member 424 will be facilitated if the pickup roller 412 is conditioned to be free to move.

When the operator then depresses the print start switch (to be described) under these conditions, the pickup roller 412 and document feed roller 416 are initiated into motion to drive the lowermost one of the documents D to move leftwardly from the document storage tray 404 toward the transfer roller pair 442. The transfer roller pair 442 is held at rest until a predetermined period of time is elapsed after the document D thus conveyed toward the supply-side turning path portion 436 has reached the roller pair 442 to remedy the skewing of the document D.

Figure 17B:
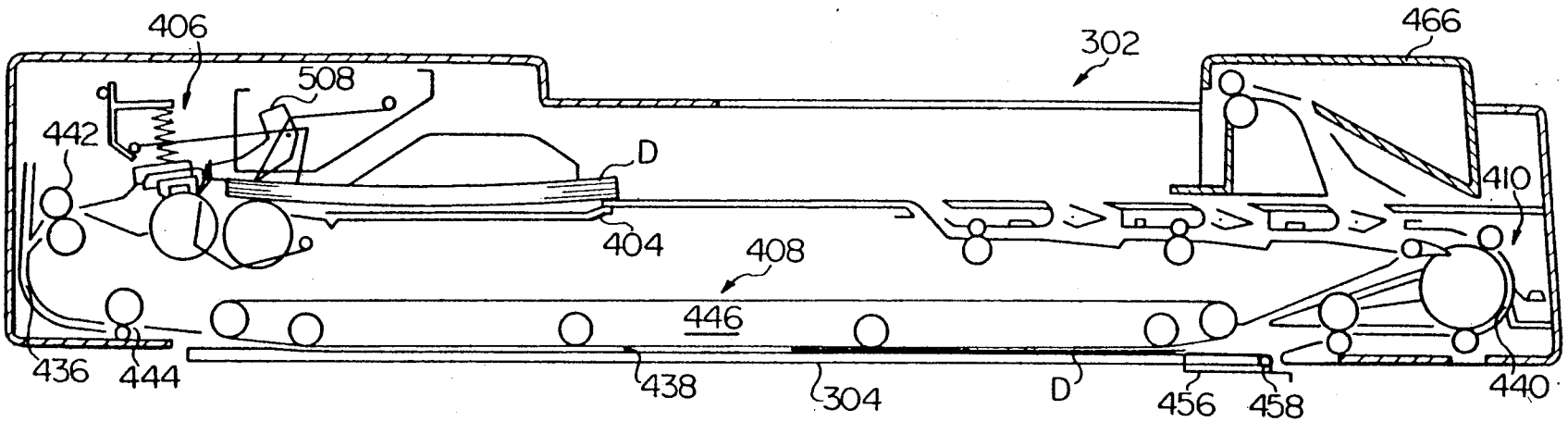

Past the transfer roller pair 442, the document D is driven to travel arcuately along the supply-side turning path portion 436 downwardly and rightwardly toward the pinch roller pair 444 as shown in FIG. 17B and is turned upside down by the time the document D leaves the turning path portion 436. As has been noted, the document D is driven to travel toward the pinch roller pair 444 at a speed controlled through detection of a change in the speed calculated from the signals output from the document travel sensors 504 and 506 located in the neighborhood of the starting and terminating ends, respectively, of the turning path portion 436.

The lateral measurement or width of the documents D placed on the document storage tray 404 is detected depending on the position of the movable guide member 496 between the front and rear panel portions of the casing 402. Alternatively, the lateral measurements of documents may be detected through provision of sensors (not shown) located at suitable intervals laterally of, for example, the turning path portion 436 to determine the width of the documents which are usually of any of the known standardized sizes. On the other hand, the longitudinal measurement of the documents D is detected from the time duration of the signal output from the document travel sensor 506 located in the neighborhood of the terminating end of the supply-side turning path portion 436. The size of the documents D to be duplicated is determined from the lateral and longitudinal measurements of the documents detected in these manners and the size of the print sheets to be used is determined on the basis of the size of the documents thus determined.

With the pinch rollers 444 driven for rotation, the document D is passed through the pinch roller pair 444 to the straight intermediate path portion 438 on the document support table 304 and is further driven by the document transport belt assembly 446 to move at a controlled speed on the table 304 toward the return-side turning path portion 440.

When the scanner-moved scanning mode is selected along with the grouping mode, the scale member 456 is held in the second angular position and has its leading end located above the plane flush with the upper face of the document support table 304. The document D which has been moved to the terminal end of the intermediate path portion 438 is at its leading end brought into abutting contact with the leading end of the scale member 456 and is prevented from being passed to the return-side turning path portion 440. It may be noted that the scale member 456 is operative not only to prevent passage of the document D to the turning path portion 440 but also to rectify the skewing, if any, of the document D which has its leading edge thus brought into abutting contact with the scale member 456.

At the point of time the document D is brought into abutting contact with the scale member 456, the document transport belt assembly 446 is brought to a stop. Accordingly, the document D prevented from being passed to the return-side turning path portion 440 by means of the document scale member 456 is fixedly held in the predetermined exposure position on the document support table 304 with its leading end contacted by the scale member 456.

Figure 17C:
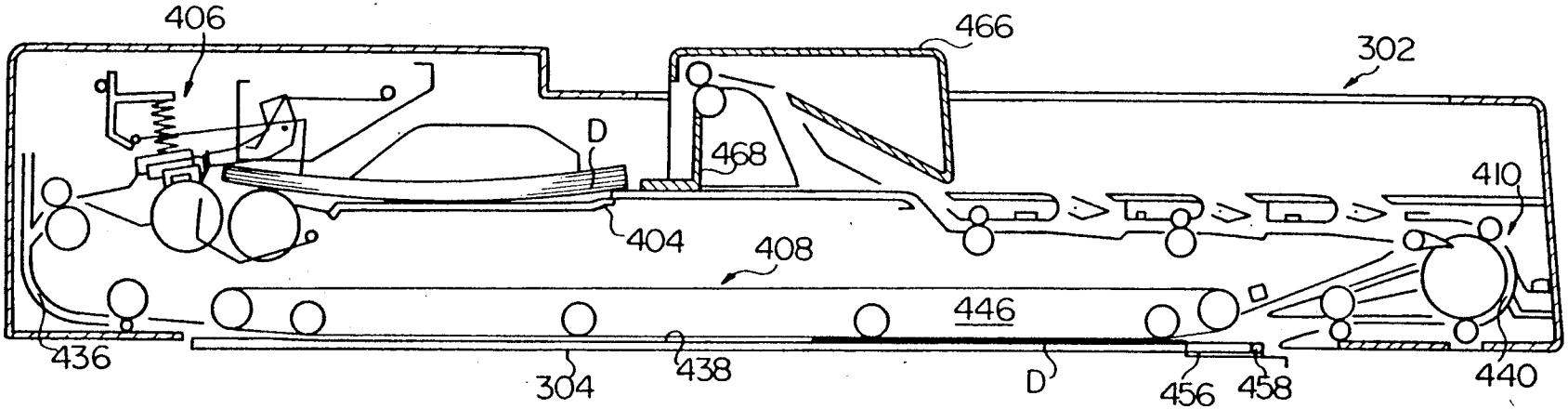

By the time the document D is thus fixedly positioned on the document support table 304, the document guide assembly 466 is moved depending on the detected size of the document to a position having the bottom end of the main document guide passageway 472 located above any one of the first, second and third slots 480*a*, 480*b* and 480*c* such as the fourth slot 480*d* in the document storage tray 404 as shown in FIG. 17C. The guide assembly 466 being thus moved to the position having the bottom end of the passageway 472 located above the fourth slot 480*d*, all the slide elements 486*a*, 486*b* and 486*c* are upwardly turned to their inoperative angular positions thereof.

The movable scanner units 324/326 and 328/330 of the optical system 322 are now driven to move in the direction of arrow F from their home positions indicated by phantom lines in FIG. 14A to scan the lower image-bearing surface of the document D thus fixedly placed on the document support table 304. On termination of the scanning operation, the scanner units 324/326 and 328/330 are driven to return to their respective home positions with respect to the document support table 304. The reciprocating motion of each of the scanner units 324/326 and 328/330 is repeated by a number of times equal to the quantity of printed outputs that has been designated by the operator At least by the point of time the final cycle of scanning operation for the document D is terminated, the document scale member 456 is moved to the first angular position having its leading end located below the plane flush with the upper face of the document support table 304. On condition that the scale member 456 is thus moved to the first angular position thereof, the document transport belt assembly 446 is for a second time initiated into motion and at the same time the document return roller 460 and the document discharge rollers 478 are driven for rotation. It therefore follows that the document D released from the scale member 456 is driven to advance from the intermediate path portion 438 to the return-side turning path portion 440 past the scale member 456.

Figure 17D:
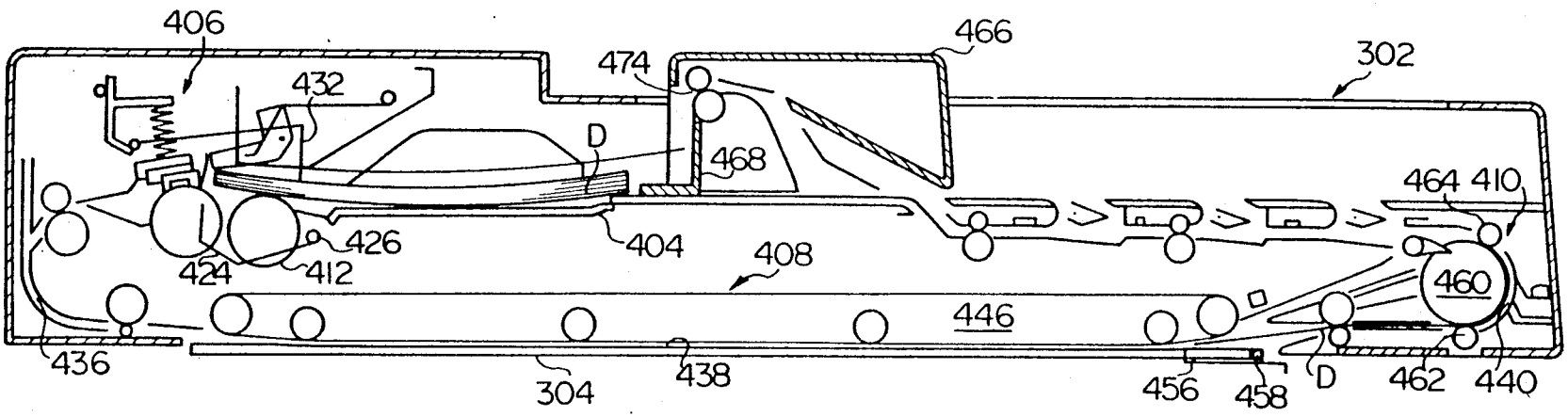

Driven by the document return roller 460 and associated lower and upper idler rollers 462 and 464, the document D travels arcuately along the return-side turning path portion 440 upwardly and leftwardly as shown in FIG. 17D and is thus for a second time turned upside down by the time the document D leaves the turning path portion 440.

The slide elements 486*a*, 486*b* and 486*c* in the first, second and third slots 480*a*, 480*b* and 480*c* being upwardly turned to their inoperative angular positions thereof, the document D passed to the auxiliary document guide passageway 482 is allowed to move upwardly into the main document guide passageway 472 in the guide assembly 466 through the fourth slot 480*d*. The document thus admitted into the guide assembly 466 is withdrawn from the guide assembly 466 through the discharge slot 474 by the discharge roller pair 478. The document D is further driven to move leftwardly by the document discharge roller pair 478 until the document D is completely received on the document storage tray 404 and is contacted at its leading end by the returned-document stop member 432 located close to the leading end of the tray 404 and held in the downwardly turned operative angular position thereof.

The document D thus returned to the document storage tray 404 is placed on the tray 404 or on the stack of the documents D which have already been returned to the tray 404. To the document D which is being thus superposed on the stack of documents D on the tray 404 is elastically imparted by the document feed wheel 500 a force effective to promote the movement of the document D being moved toward the retuened-document stop member 432. The document D is thus enabled to restore the correct initial position with respect to the returned-document stop member 432 by the aid of the axially stepped document discharge rollers 478 and the document feed wheel 500.

The documents D are successively withdrawn from the document storage tray 404, scanned one after another on the document support table 304, and returned successively to the document storage tray 404.

Figure 17E:
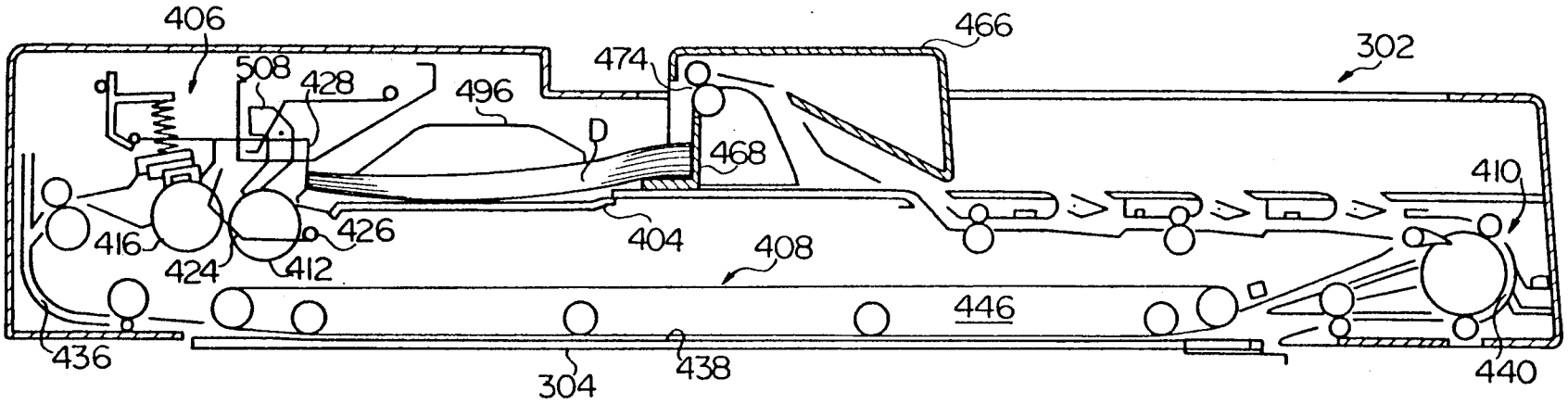

On termination of all the cycles of duplicating operation in the grouping mode, the documents D returned to the document storage tray 404 are contacted at their leading ends by the returned-document stop member 432 and thus have their leading end portions located anterior to the pickup roller 412 as shown in FIG. 17E. Thus, when the last one of the documents D initially placed on the document storage tray 404 is withdrawn from the tray 404, there is no document supporting the document empty sensor 508, which is accordingly allowed to turn downwardly as illustrated in FIG. 17E to indicate that all the cycles of duplicating operation in the grouping mode are complete.

When the documents D are duplicated in the document-moved scanning mode with the sorting mode selected, the documents D initially stacked on the document storage tray 404 as shown in FIG. 7 are handled as described with reference to FIG. 8. The printed outputs $P_s$ produced from the documents D are thus assorted on the sheet discharge tray 554 or in the stacking assembly 558 in a sequence indicated in FIG. 9.

If the grouping mode is selected for the document-moved scanning mode of operation, the documents D initially stacked on the document storage tray 404 as shown in FIG. 7 are handled as described with reference to FIG. 10. The printed outputs $P_g$ produced from the documents D are thus grouped on the sheet discharge tray 554 or in the stacking assembly 558 in a sequence indicated in FIG. 11.

When the documents D which have been returned to the document storage tray 404 as shown in FIG. 17E are to be duplicated for a second time in the sorting mode, the returned-document stop member 432 is turned upwardly to the inoperative angular position thereof and at the same time the document guide assembly 466 is moved forwardly or leftwardly a predetermined distance on the document storage tray 404. The document guide assembly 466 being thus moved forwardly, the documents D placed on the document storage tray 404 are moved also forwardly by the lower front guide member 468 toward the document stop member 424 located posterior to the pickup roller 412. The guide assembly 466 is brought to a stop in a position having the documents D contacted by the document stop member 424 at their leading edges as shown in FIG. 17F.

Figure 17F:
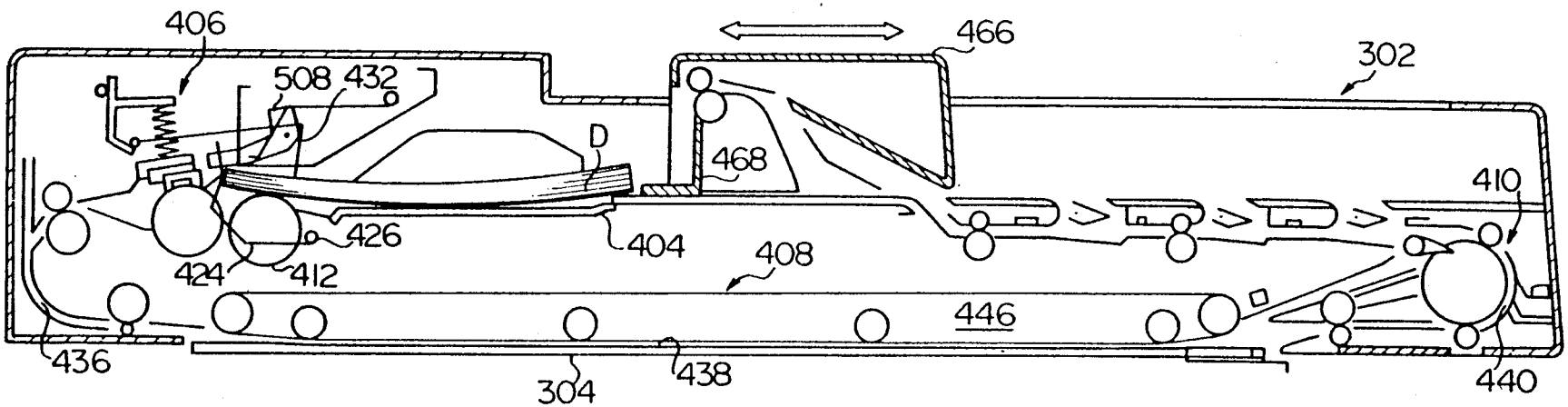

The document guide assembly 466 is then slightly moved backwardly or rightwardly in the drawings so that the lower front guide member 468 is located to be ready to bear against the trailing edges of the documents D to be returned to the tray 404 as shown in FIG. 17F. The document stop member 424 is downwardly turned to the inoperative angular position disengaged from the stack of the documents D on the tray 404 and, simultaneously, the document retaining member 428 is downwardly turned to the operative angular position resting on the stack of the documents D on the tray 404 as also illustrated in FIG. 17F.

The documents D are then successively withdrawn from the document storage tray and are scanned one after another on the document support table 304 in the scanner-moved scanning mode of operation either in the sorting mode or in the grouping mode. On termination of the duplicating operation in the required number of the printed outputs, the document guide assembly 466 is driven to the initial or home position close to the rightmost end of the document storage tray 404 as shown in FIG. 14B to enable the operator to readily remove the documents D from the tray 404 or exchange them with another document or another set of documents.

It will now be assumed that the document-moved scanning mode is selected concurrently with the sorting mode. A set of documents D are placed on the document storage tray 404 and are conditioned to be ready to be fed from the tray 404 in a manner hereinbefore described with reference to FIGS. 17A to 17C.

The document scale member 456 is held in the first angular position and has its leading end located below a plane flush with the upper face of the document support table 304.

A cycle of preliminary operation is then started with the lowest one of the documents D on the document support table 304 withdrawn from the document storage tray 404 as has been described with reference to FIG. 17D and returned to the tray 404 as has been described with reference to FIG. 17E. The lateral and longitudinal measurements of the documents D thus set on the document storage tray 404 are detected depending on the position of the movable guide member 496 and from the time duration of the signal output from the document travel sensor 506. The size of the documents D being thus determined, the size of the print sheets to be used is determined and the document guide assembly 466 is driven to move the stack of documents D correctly with respect to the document stop member 424. Thereafter, the remaining documents D are successively fed from the tray 404 and returned one after another to the tray 404. The document scale member 456 being held in the first angular position, the document D moved to the terminating end of the intermediate path portion 438 is allowed to travel to the return-side turning path portion 440 past the document scale member 456. During the preliminary operation, however, the scanner units 324/326 and 328/330 are maintained inoperative so that the document D being moved on the document support table 304 is not scanned by the scanner units 324/326 and 328/330.

Each time a document D is supplied from the document storage tray 404 and is returned to the tray 404 during the preliminary operation, the number of the documents D which have been fed from and returned to the tray 404 is counted. During each of the cycles of duplicating operation to be subsequent to the preliminary of operation, print sheets are supplied from the sheet supply stage to the image reproducing stage in the main duplicator module 300 on the basis of the number of the documents D thus counted during the first cycle of operation. It may be noted in this connection that a print sheet on which a document D is to be duplicated is supplied from the sheet supply stage before the particular document D is fed from the tray 404. Thus, when a plurality of printed outputs are to be produced from each of the documents D, it would happen that a print sheet is unneccessarily supplied after all the documents have been duplicated each by a number of times if the total number of the documents D to be duplicated is unknown. Detecting the number of the documents D during the preliminary operation is thus useful for avoiding the feeding of such an unnecessary print sheet during each cycle of duplicating operation which is to follow the preliminary operation.

After the total number of the documents D has been counted, the documents D which have once been withdrawn from the document storage tray 404 in the preliminary cycle of operation are returned to the document storage tray 404 as illustrated in FIG. 17F.

When the documents D have been returned to the document storage tray 404 in the preliminary cycle of operation, the returned document stop member 432 is turned upwardly to the inoperative angular position thereof and at the same time the document guide assembly 466 is moved forwardly or leftwardly a predetermined distance on the document storage tray 404. The document guide assembly 466 being thus moved forwardly, the documents D placed on the document storage tray 404 are moved also forwardly by means of the lower front guide member 468 toward the document stop member 424 located posterior to the pickup roller 412. The guide assembly 466 is brought to a stop in a position having the documents D contacted by the document stop member 424 at their leading edges as shown in FIG. 17F.

The document guide assembly 466 is then slightly moved backwardly or rightwardly in the drawings so that the lower front guide member 468 thereof is located to to be ready to bear against the trailing edges of the documents D to be returned to the document storage tray 404 as shown in FIG. 17F. The document stop member 424 is downwardly turned to the inoperative angular position disengaged from the stack of the documents D on the document storage tray 404 and, simultaneously, the document retaining member 428 is downwardly turned to the operative angular position resting on the stack of the documents D on the tray 404 as also illustrated in FIG. 17F.

Figure 17G:
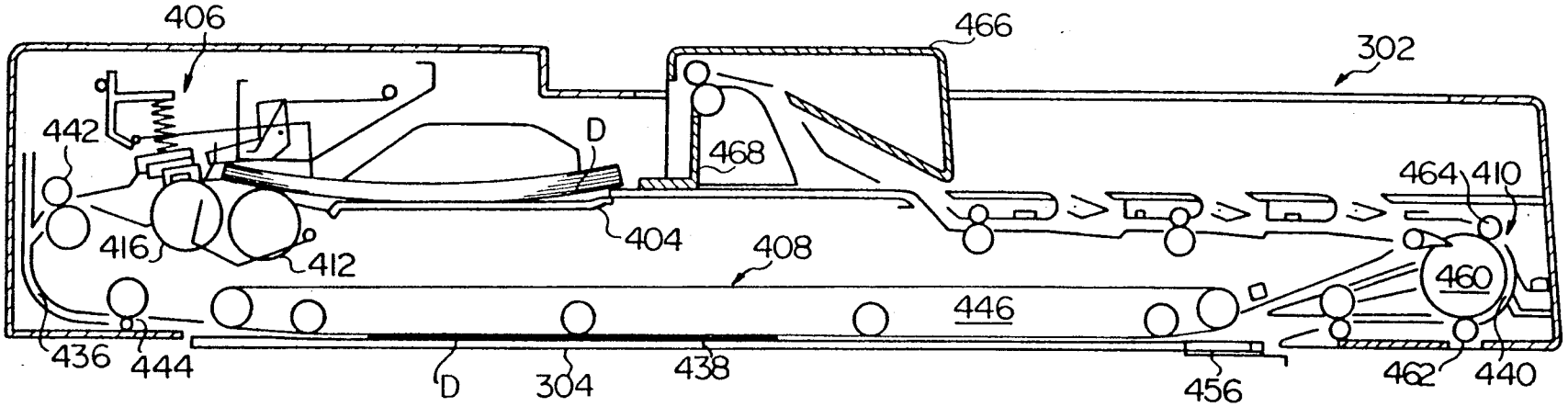

The first cycle of duplicating operation is then started with the lowest one of the documents D on the tray 404 withdrawn from the tray 404, followed by successive feeding of the remaining documents D. Each of the documents D thus supplied from the document storage tray 404 is scanned by the scanner units 324/326 and 328/330 while the document D is travelling from one end of the document support table 304 to the other toward the return-side turning path portion 440 as illustrated in FIG. 17G.

Figure 17H:
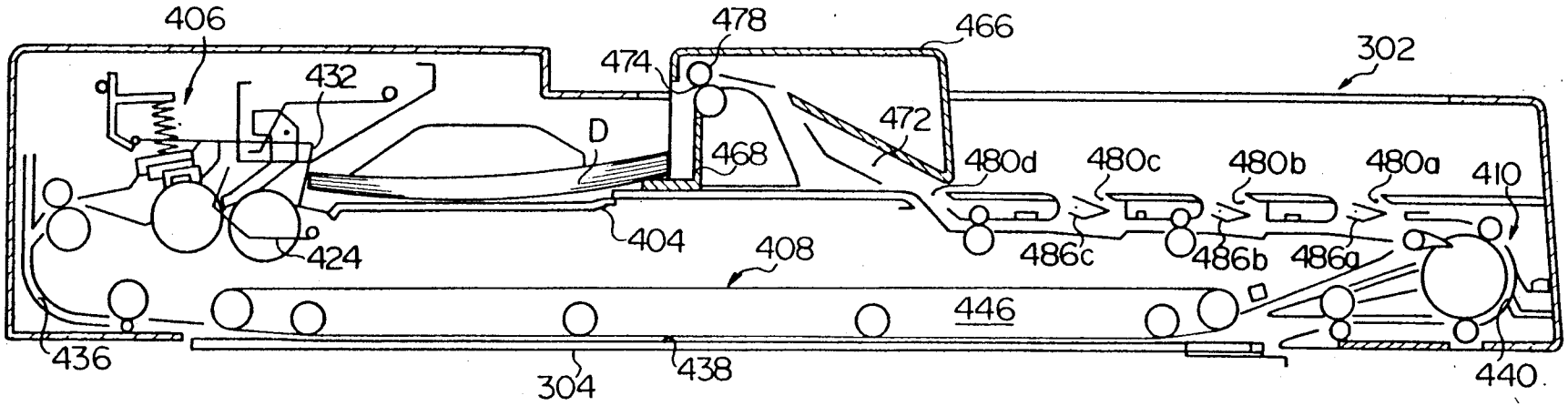
Figure 171:
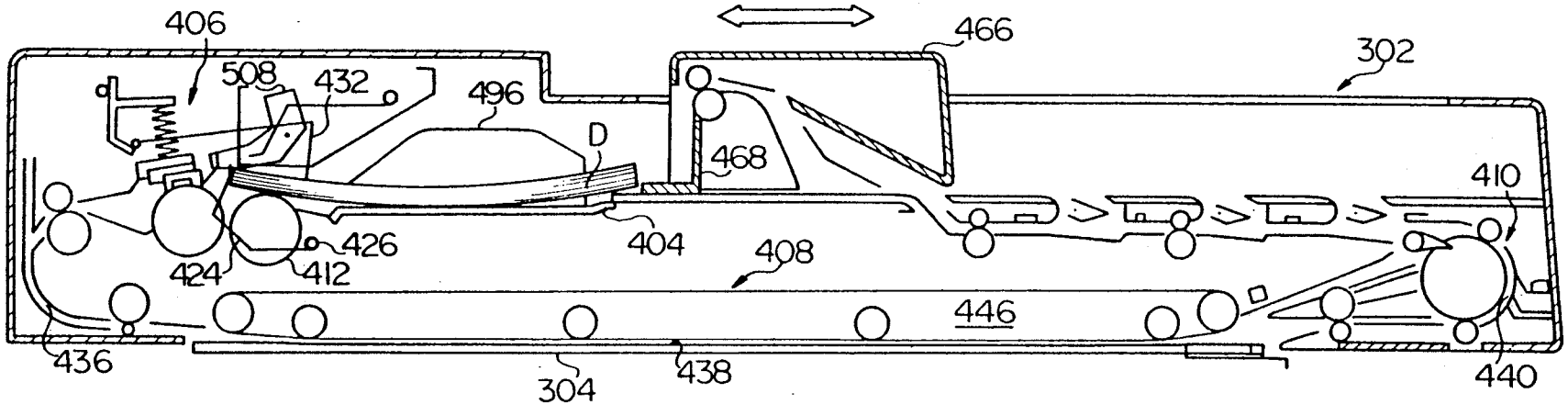

When the documents D which have been returned to the document storage tray 404 as shown in FIG. 17H are to be duplicated for a second time, the document guide assembly 466 is moved forwardly so that the stack of the returned documents D is contacted at its leading end by the document stop member 424 as shown in FIG. 17I. The document guide assembly 466 is then slightly moved backwardly or rightwardly to the position illustrated in FIG. 17H with the documents D conditioned to be ready to be fed from the document storage tray 404 as shown in FIG. 17I.

Figure 17J:
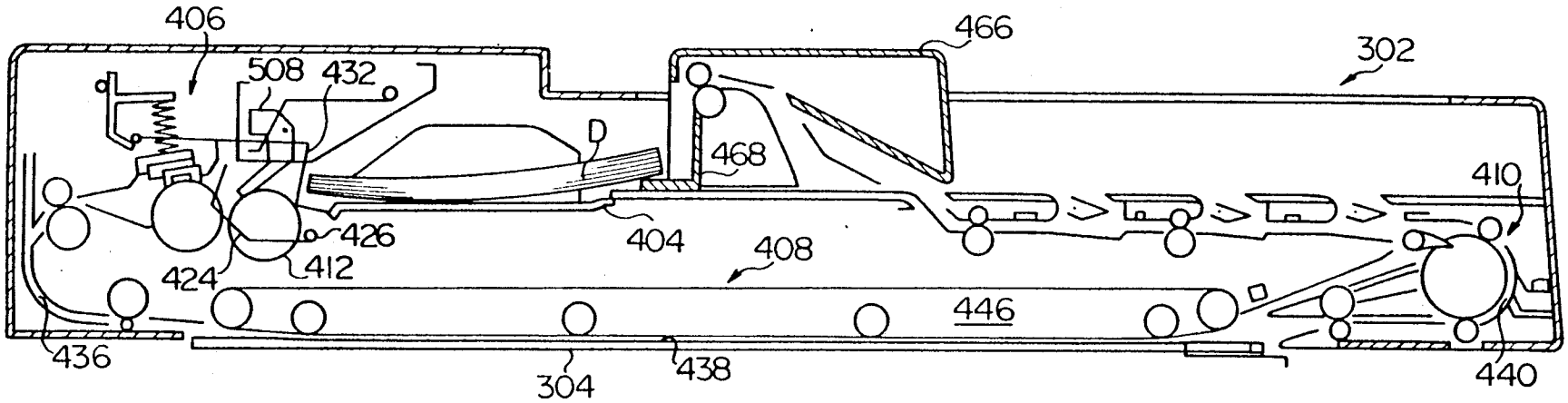
Figure 17K:
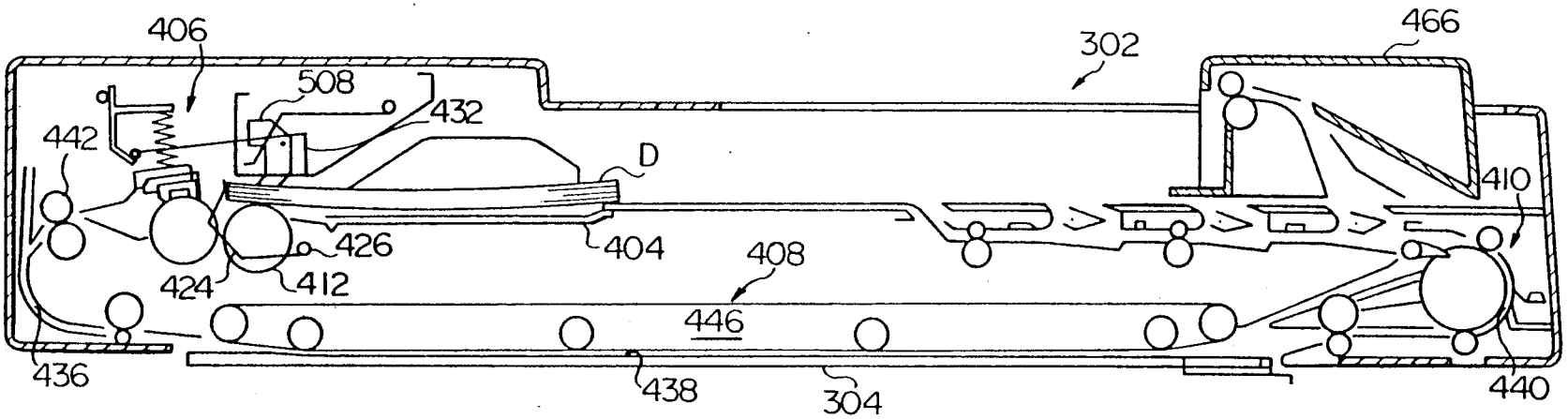

All the documents D will thus be duplicated each by a required number of times and returned to the document storage tray 404 as shown in FIG. 17J. After the documents D are thus returned to the document storage tray 404 at the end of the last cycle of duplicating operation, the document guide assembly 466 is driven to the move the stack of documents D to the position contacted by the document stop member 424. Thereafter, the document guide assembly 466 is moved backwardly to its initial or home position close to the rightmost end of the document storage tray 404 as shown in FIG. 17K.

By the duplicating operation in the document-moved scanning mode, the sorting mode is selected so that the documents D initially stacked on the document storage tray 404 as shown in FIG. 7 are handled as described with reference to FIG. 8. The printed outputs $P_s$ produced from the documents D are thus assorted on the sheet discharge tray 554 or in the stacking assembly 558 in a sequence indicated in FIG. 9.

[2/4] Control Panel 600

Figure 18:
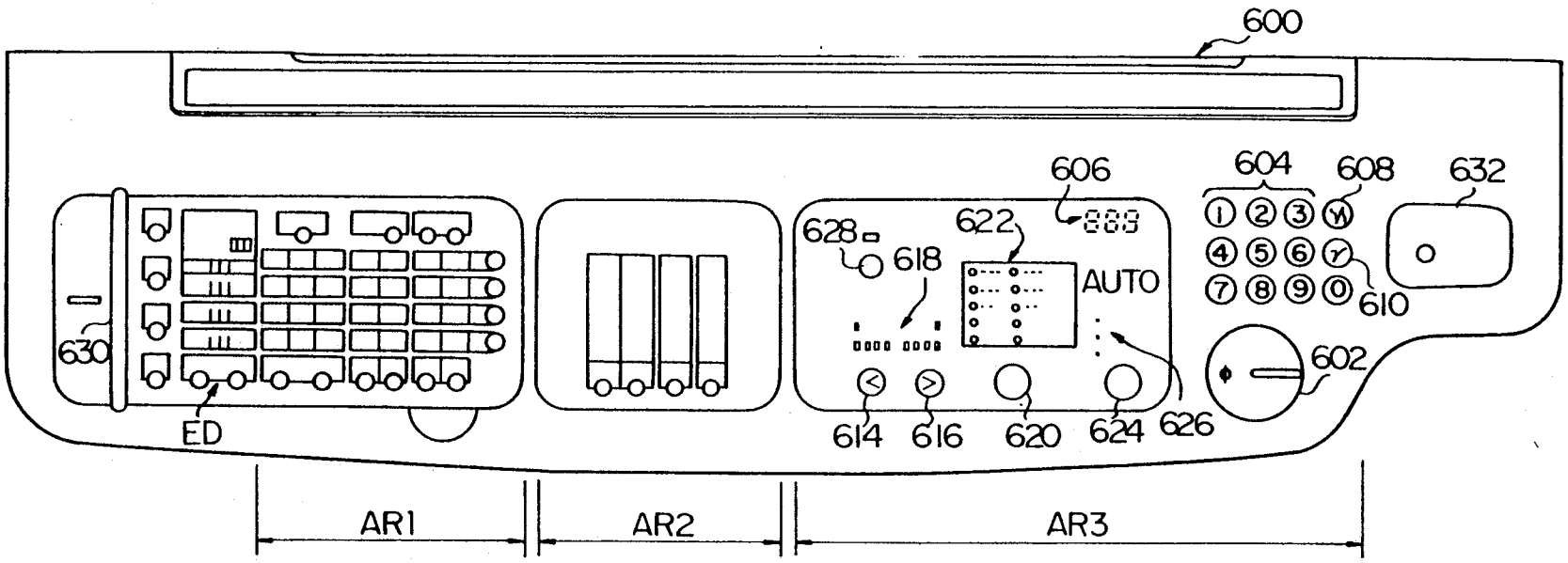
FIG. 18 is a plan view showing an example of the key and indicator arrangement of a control panel which forms part of the image duplicating apparatus implementing the second preferred embodiment of the present invention.

FIG. 18 shows an example of the key and indicator arrangement of a control panel 600 which forms part of the image duplicating apparatus implementing the second preferred embodiment of the present invention.

The control panel 600 largely has three key/indicator areas which consist of first, second and third key/indicator areas AR1, AR2 and AR3 as shown.

In the first key/indicator area AR1 are provided control keys for allowing the operator to select any desired one or more of a first group of modes of operation and indicators to indicate that the particular mode or modes of operation are selected. The first-group or standard modes of operation are available in the scan-mode changeable image duplicating apparatus according to the present invention when the apparatus is equipped with standard options. The detailed arrangement of this first key/indicator area AR1 of the control panel 600 will be hereinafter described with reference to FIG. 19.

The second key/indicator area AR2 has provided therein control keys for allowing the operator to select any desired one or more of a second group of modes of operation and indicators to indicate that the particular mode or modes of operation are selected. The second-group or optional modes of operation are available in the scan-mode changeable image duplicating apparatus according to the present invention when the apparatus is equipped with non-standard, additional options. The detailed arrangement of this second key/indicator area AR2 of the control panel 600 will be hereinafter described with reference to FIG. 20.

In the third key/indicator area AR3 are provided control keys for allowing the operator to select any desired parameter or parameters for the selected first-group and/or second-group operating modes and start a cycle of duplicating operation in accordance with the selected parameter or parameters.

The keys thus provided in the third key/indicator area AR3 of the control panel 600 herein shown include a print start key 602 through which the operator's instruction to start a cycle of duplicating operation is to be entered. The print start key 602 is to be illuminated in green under initial conditions of the duplicating apparatus. The keys on the control panel 600 further include numerical keys 604 allowing the operator to enter a desired quantity of printed outputs to be produced for a single document or a desired R/M ratio for duplication. The quantity of printed outputs to be produced for a single document or the R/M ratio for duplication thus entered at any of the numerical keys 604 are visually indicated on a three-digit numerical display window 606. The quantity of printed outputs to be produced and the R/M ratio which have once been entered can be cancelled by a clear/stop key 608. Further provided on the control panel 402 is an interrupt request key 610 and density-up and density-down control keys 614 and 616 and associated indicators 618 and a print-sheet select key 620 and associated indicators 622. Further provided in the key/indicator area AR3 is an auto/manual shift key 624 which allows the operator to select an automatic print-sheet selecting mode (APS), an automatic magnification selecting mode (AMS) or a manual print-sheet/magnification selecting mode. The automatic print-sheet selecting mode is effective to automatically select one of the first and second sheet supply units 346 and 348 and the automatic magnification selecting mode is effective to automatically select an R/M ratio. In association with this auto/manual shift key 624 are provided indicator lamps 626 which consist of a first indicator lamp to be turned on to indicate that the automatic print-sheet selecting mode is selected, a second indicator lamp to be turned on to indicate that the automatic magnification selecting mode is selected, and a third indicator lamp to be turned on to indicate that the manual print-sheet/magnification selecting mode is selected by the auto/manual shift key 624. Further provided in the third key/indicator area AR3 of the control panel 600 is an indicator lamp 628 when is to be turned on in the presence of a signal supplied from the manually-fed sheet detecting switch 398 detecting a print sheet manually supplied from the manual sheet supply table 352.

The control panel 600 further has an editing area ED adjacent the first key/indicator area AR1. In this editing area ED of the control panel 600 are provided keys and associated indicators which lend themselves to the execution of an editor copying mode which is operable when an editor sheet and a pen-type signal input device (not shown) are added to the apparatus as non-standard, additional options. Where such additional options are not available, the user of the apparatus may conceal the area ED by a slide cover plate 630 also provided on the control panel 600.

Further provided on the control panel 600 is a card-data read instruction key 632 which allows the operator to enter an instruction to read data from an integrated-circuit (IC) card (not shown). In the integrated-circuit card are stored the various modes of operation operable in the apparatus and the various parameters available for each of the modes of operation.

Figure 19:
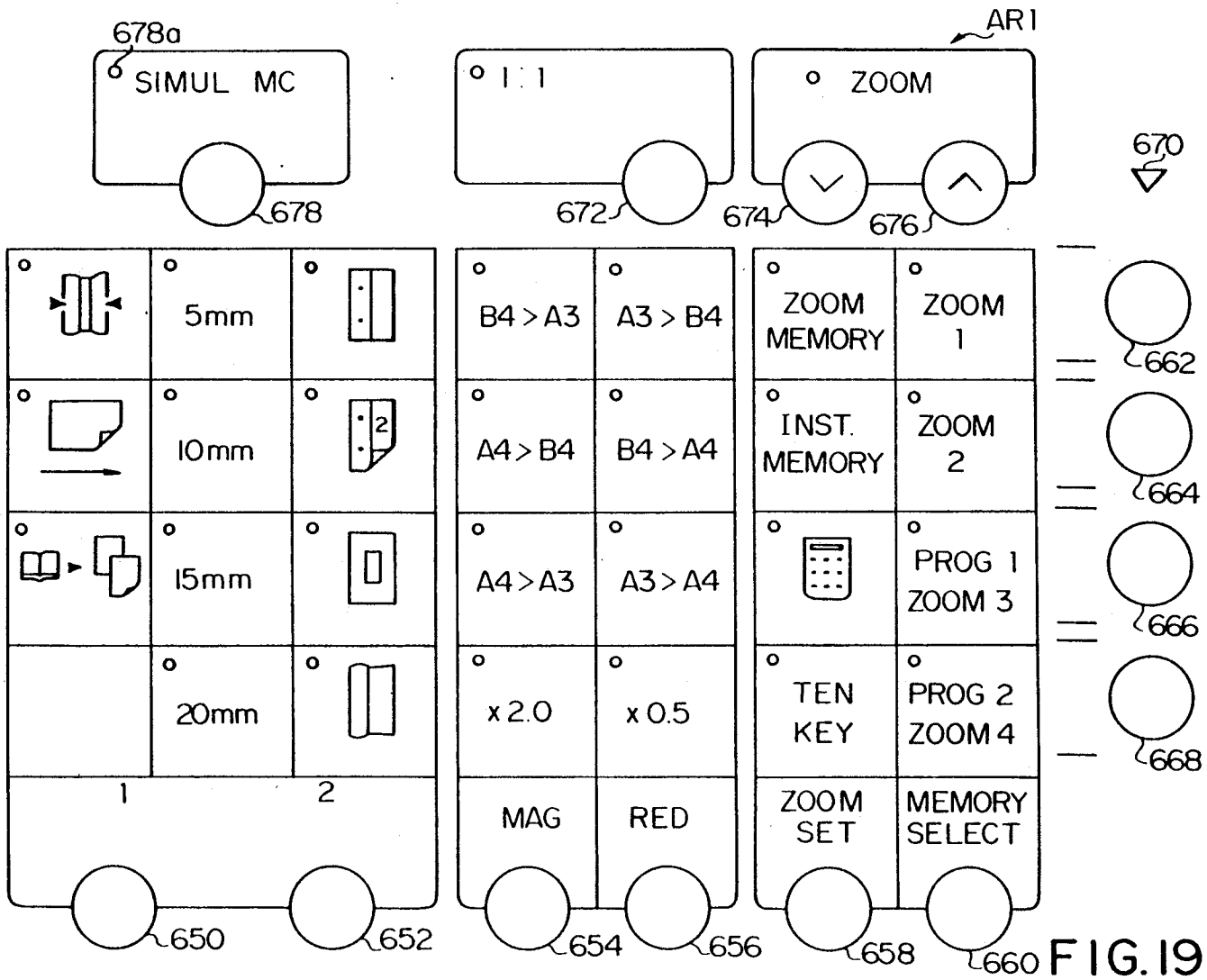
FIG. 19 is a plan view showing, to an enlarged scale, the detailed arrangement of a first key/indicator area of the control panel illustrated in FIG. 18.

FIG. 19 shows, to an enlarged scale, the detailed arrangement of the first key/indicator area AR1 of the control panel 300 hereinbefore described with reference to FIG. 18.

As shown in FIG. 19, the first key/indicator area AR1 of the control panel 300 has indicator sections arranged in rows and columns to provide a wide range of selecting among the first-group modes of operation with use of a small number of keys and to simplify the wiring and other hardware arrangements. Each of the indicator sections is assigned to one of the first-groups modes of operation available in the apparatus. The individual rows and columns of the indicator sections have respectively associated keys which include first to six column keys 650, 652, 654, 656, 658 and 660 respectively associated with the columns of the indicator sections and first to fourth row keys 662, 664, 666 and 668 respectively associated with the rows of the indicator sections. Thus, a particular one of the indicator sections is selected on depression of one of the column keys 650 to 660 and one of the row keys 662 to 668. In association with the row keys 662 to 668 is provided a choice entry request indicator 670 which prompts the operator to enter any mode of operation at one of the keys 662 to 668.

The column of the indicator sections with which the first column key 650 is associated includes indicator sections respectively assigned to an anamorphic copying mode, a non-copying mode, and a book copying mode for producing two separate printed outputs for a single two-page original.

The column of the indicator sections with which the second column key 652 is associated includes indicator sections respectively assigned to a margin-forming copying mode, a reverse-side margin-forming copying mode, a frame-erasing copying mode and an eyelet-erasing copying mode. The second column key 652 is not only for the selection of any of these modes of operation but also for the selection of any of four predetermined margin widths in the margin-forming copying mode or the reverse-side margin-forming copying mode.

The column of the indicator sections with which the third column key 654 is associated includes indicator sections respectively assigned to four predetermined R/M ratios for magnified copying mode. The column of the indicator sections with which the fourth column key 656 is associated includes indicator sections respectively assigned to four predetermined R/M ratios for reduced copying mode. A one-to-one R/M ratio is selected on depression of a key 672.

The fifth and sixth column keys 658 and 660 are used when a zoom-in or zoom-out function is selected on depression of a zoom-in key 674 or a zoom-out key 676 for continuously decreasing or increasing the R/M ratio. The key 658 or 660 is thus used to select an R/M ratio for the zoomed-in or zoomed-out mode of copying operation, store the R/M ratio thus selected into a memory, and call back the R/M ratio from the memory.

Each of the indicator sections thus arranged in the first key/indicator area AR1 has provided therein an indicator lamp as indicated by a bubble in the drawing. The indicator lamp thus located in each indicator section is activated to glimmer when the mode of operation to which the particular indicator section is assigned is currently selected. On termination of the keying operation by the operator, the indicator lamps in the indicator sections assigned to the selected modes of operation remain illuminating with the indicator lamps in all the other indicator sections turned off.

In the first key/indicator area AR1 of the control panel 600 is further provided a simultaneous multi-color mode select key 678 having an associated indicator lamp 678*a*. This simultaneous multi-color mode select key 678 is to be used to select the previously mentioned simultaneous multi-colored copying mode in which images are to be formed in one color in one area of a print sheet and in another color in another area of the print sheet. When the simultaneous multi-colored copying mode is selected at the key 678, the associated indicator lamp 678*a* is turned on to glow.

Description will now be made in regard to the procedure to be followed for selecting the book copying mode which is one of the first-group or standard modes of operation that can be selected in the first key/indicator area AR1 of the control panel 600 as hereinbefore described.

Under initial conditions of the duplicating apparatus, the print start key 602 on the control panel 600 is illuminated in green as previously noted. The operator desiring to select the book copying mode will depress the first column key 650, the indicator lamps in the upper three key/indicator sections with which the key 650 is associated is activated to glimmer in green. Simultaneously, the choice entry request indicator 670 activated to glimmer to prompt the operator to enter any mode of operation at one of the first to fourth row keys 662 to 668 and the print start key 602 is illuminated in red.

The operator will then depress the third row key 666 to select the book copying mode. With the third row key 666 thus depressed, the indicator lamp in the key-/indicator section located at the crossing between the column of key/indicator sections associated with the column key 650 and the row of key/indicator sections is activated to illuminate in green. The indicator lamp in the key/indicator section particularly assigned to the book copying mode is thus allowed to illuminate in green and the other two indicator lamps which have been glimmering in green in the column of key/indicator sections associated with the column key 650 are turned off. The book copying mode is now selected as desired by the operator and as such the print start key 602 is for a second time illuminated in green. When the print start key 602 is thereafter depressed by the operator, a cycle of duplicating operation is started in the selected book copying mode in which a single two-page original is scanned in two successive steps in which the exposure lamp 324 is energized for different periods of time and the original is scanned over different lengths for producing two separate printed outputs for the single two-page original.

Figure 20:
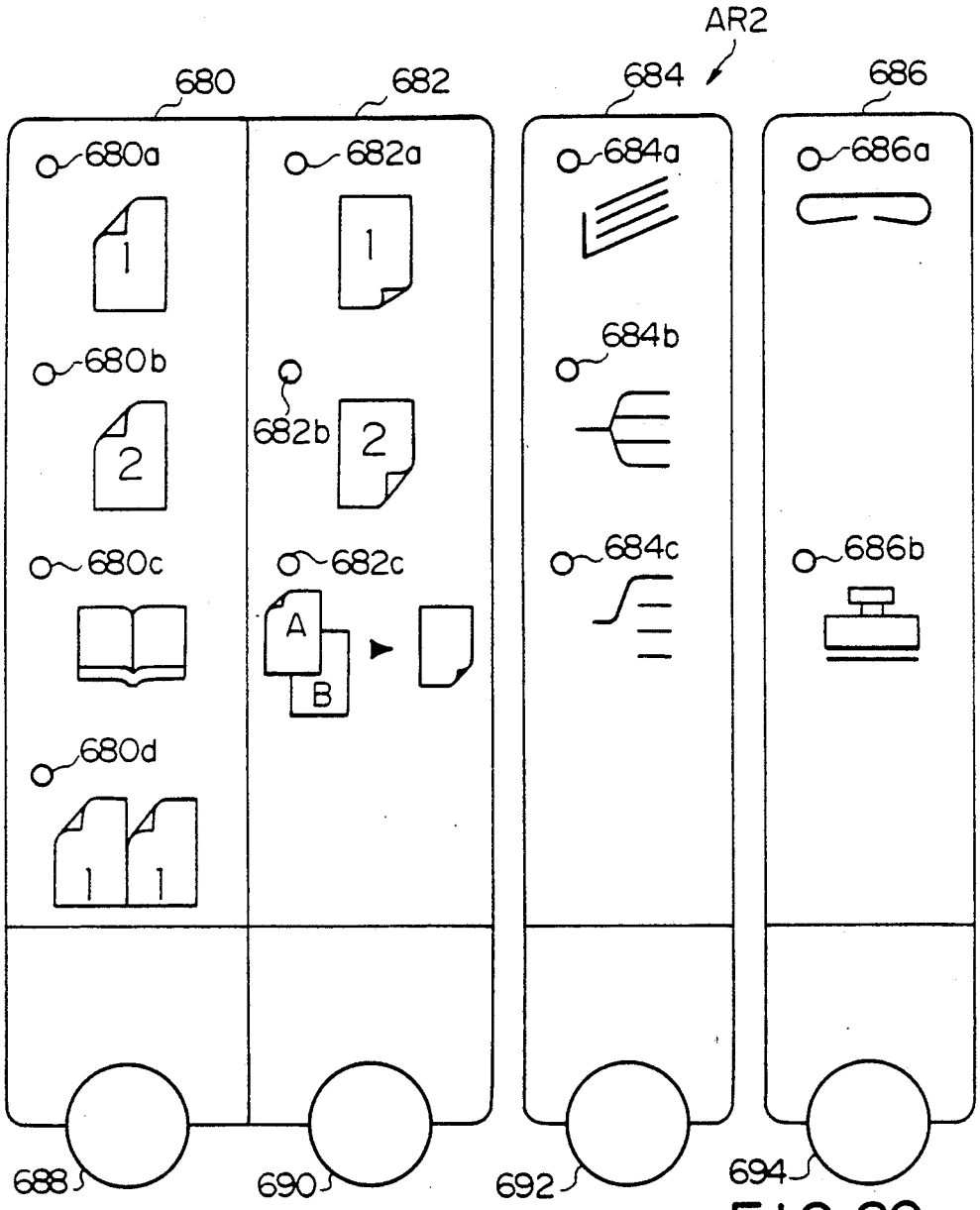
FIG. 20 is a plan view showing, also to an enlarged scale, the detailed arrangement of a second key/indicator area of the control panel illustrated in FIG. 18.

FIG. 20 is a plan view showing, also to an enlarged scale, the detailed arrangement of second key/indicator area AR2 of the control pane 300 hereinbefore described with reference to FIG. 18. As has been noted, the keys provided in the second key/indicator area AR2 are used for allowing the operator to select any desired one or more of the second-group or optional mode operation available in the image duplicating apparatus equipped with non-standard, additional optional units. The additional optional units are used to automate the various routine procedures to be followed in an image duplicating apparatus for offering high performance efficiencies especially in producing a large quantity of printed outputs. Typical of such optional units are the document feeder unit 302 of the RDH type, the finisher unit 550 and an automatic page sorter unit which is not herein shown.

As shown in FIG. 20, the second key/indicator area AR2 of the control panel 300 has indicator sections arranged in columns. Each of the indicator sections is assigned to one of the second-group modes of operation available in the apparatus. The individual columns of the indicator sections have respectively associated keys which include first to fourth column keys 688, 690, 692 and 694 respectively associated with the columns of the indicator sections. Thus, a particular one of the indicator sections is selected on depression of one of the column keys 680 to 686.

The indicator sections of the second key/indicator area AR2 are particularly arranged to facilitate the operator to enter instructions smoothly in a sequence in which the operator takes various considerations into account before beginning the entry of the instructions. Such considerations will typically include:

<1> the nature or type of the documents to be duplicated,

<2> the layout of the images to be reproduced on print sheets,

<3> the manner in which, if desired, the printed outputs are to be assorted or grouped, and <4> the manner in which, if desired, the printed outputs are to be stapled, imprinted or otherwise treated.

Thus, the indicator sections of the second key/indicator area AR2 are arranged to facilitate the operator to enter instructions in the sequence of <1>, <2>, <3> and <4>. For this purpose, the columns of the indicator sections include a first column of indicator sections 680 to specify the nature or type of the documents to be duplicated, a second column of indicator sections 682 to specify the layout of the images to be reproduced on print sheets, a third column of indicator sections 684 to specify the manner in which the printed outputs are to be assorted or grouped, and a fourth column of indicator sections 686 to specify the manner in which the printed outputs are to be treated.

The first-column indicator sections 680 are assigned to the modes of operation available with the document feeder unit 302 of the RDH type. In this connection it may be noted that the modes of operation which can be specified from the first-column indicator sections include the book copying mode which is available in an image duplicating apparatus equipped with standard options. This is because of the fact that the first-column indicator sections 680 are arranged particularly with the nature of the documents taken into account.

Thus, the modes of operation to which the first column of indicator sections 680 include a single-faced document copying mode, a double-faced document copying mode a book copying mode and a two-in-one copying mode. As has been noted, the two-in-one copying mode is a mode of duplicating operation in which two documents are supplied to the document support table 304 one after the other and are duplicated in a single cycle of operation.

Each of the first-column indicator sections has provided therein an indicator lamp as indicated by a bubble in the drawing. In the first column of indicator sections 680 are thus provided an indicator lamp 680*a* in the section assigned to the single-faced document copying mode, an indicator lamp 680*b* in the section assigned to the double-faced document copying mode, an indicator lamp 680*c* in the section assigned to the book copying mode, and an indicator lamp 680*d* in the section assigned to the two-in-one copying mode. The indicator lamp thus located in each indicator section is activated to glimmer when the mode of operation to which the particular indicator section is assigned is currently selected with the first column key 688 depressed. With the first column key 688 depressed repeatedly, the indicator lamps 680*a* to 680*d* provided in the individual first-column indicator sections are turned on recurrently.

The modes of operation to which the second column of indicator sections 682 include a single-face sheet copying mode, a duplex copying mode and a composite copying mode. When the duplex copying mode or the composite copying mode is selected, the sheet recirculation unit 350 (FIG. 14A) is selected for use. The modes of operation to which the third column of indicator sections 684 include a non-sorting mode, a sorting mode and a grouping mode. The modes of operation to which the fourth column of indicator sections 686 are assigned include a stapling mode and a stamping mode for the finisher unit 550.

Each of the second-column, third-column and fourth-column indicator sections also has provided therein an indicator lamp which is to be activated to glimmer when the mode of operation to which the particular indicator section is assigned is currently selected with the second, third or fourth column key 690, 692 or 694 depressed. The indicator lamps thus included in the second column of indicator sections 682 consist of an indicator lamp 682*a* in the section assigned to the single-face sheet copying mode, an indicator lamp 682*b* in the section assigned to the duplex copying mode, and an indicator lamp 682*c* in the section assigned to the composite copying mode. The indicator lamps included in the third column of indicator sections 684 consist of an indicator lamp 684*a* in the section assigned to the non-sorting mode, an indicator lamp 684*b* in the section assigned to the sorting mode, and an indicator lamp 684*c* in the section assigned to the grouping mode. The indicator lamps included in the fourth column of indicator sections 686 consist of an indicator lamp 686*a* in the section assigned to the stapling mode, and an indicator lamp 686*b* in the section assigned to the stamping mode.

[2/5] Control Circuit 700

Figure 21:
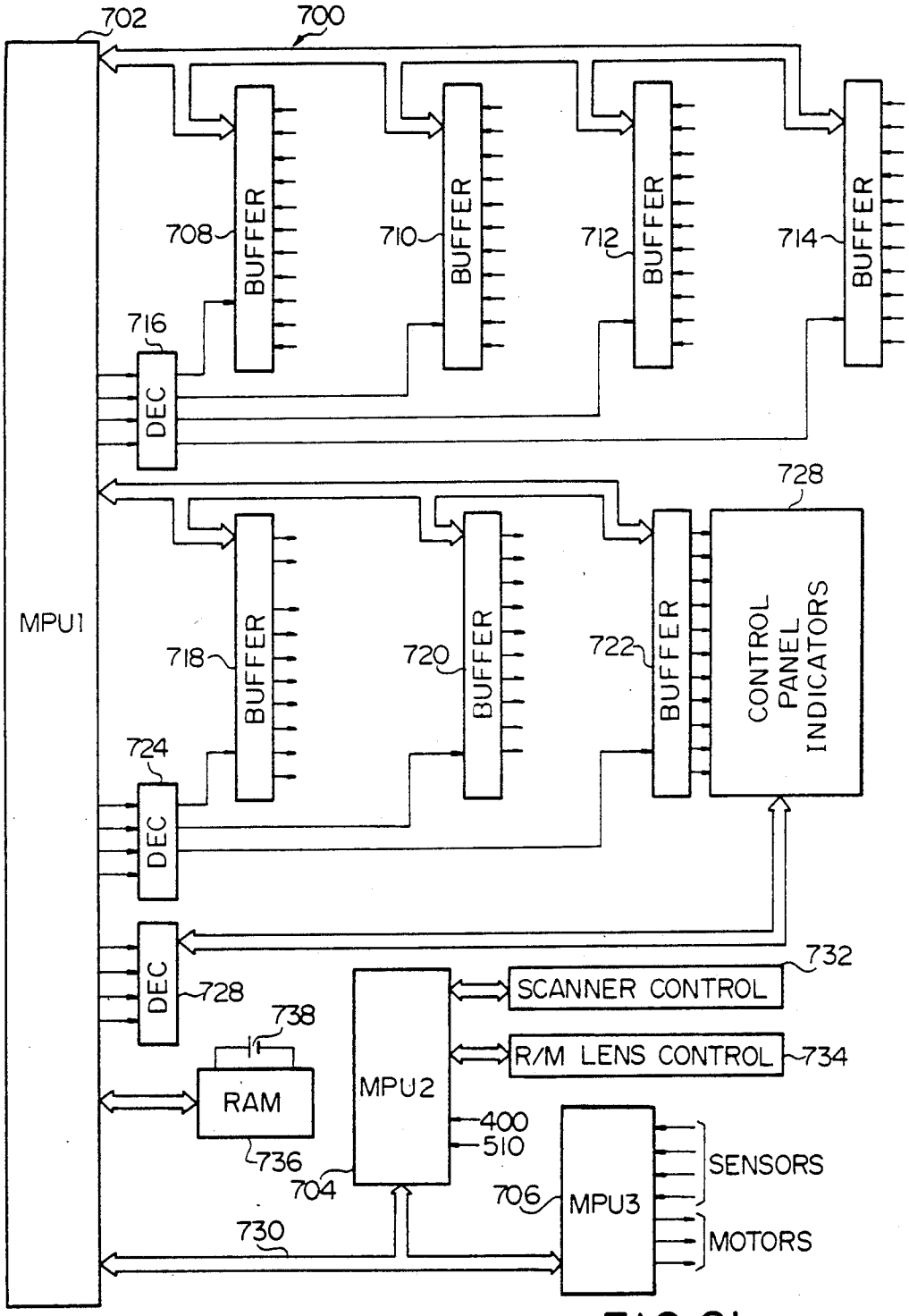
FIG. 21 is a diagram showing the general arrangement of a microprocessor-based control circuit incorporated in the second preferred embodiment of the image duplicating apparatus according to the present invention.

FIG. 21 shows the general arrangement of a microprocessor-based control circuit 700 incorporated in the second preferred embodiment of the present invention. The control circuit 700 comprises a main microprocessor 702 and first and second subsidiary microprocessors 704 and 706.

The main microprocessor 702 (MPU1) is predominant over all the operational aspects of the main duplicator module 300 of the duplicating apparatus implementing the second preferred embodiment of the present invention except for those of the optical system 322. The main microprocessor 702 has input ports electrically connected to input buffers 708, 710, 712 and 714 and through these input buffers to the various keys provided on the control panel 600. The input buffers 708, 710, 712 and 714 have control terminals connected to the microprocessor 702 through a decoder 716 and are activated and de-activated under the control of the microprocessor 702.

The main microprocessor 702 is operative to supply control and driver signals to the actuator elements of the various active devices and drive units provided in the main duplicator module 300 through output buffers 718, 720 and 722.

The main microprocessor 702 is further operative to supply various control and driver signals to the control panel 600. Thus, the main microprocessor 702 has output ports electrically connected through a decoder 724 to a matrix circuit 728 connected to the active elements forming the various indicators and display devices on the control panel 600.

The first subsidiary microprocessor 704 (MPU2) is in control of the operation of the optical system 322 of the main duplicator module 300 and communicates with the main microprocessor 702 through a bidirectional bus 730. The first subsidiary microprocessor 704 is thus responsive to signals supplied from the various sensors and detectors included in or associated with the optical system 322.

The second subsidiary microprocessor 706 (MPU3) is in control of the operation of, particularly, the document feeder unit 302 and communicates with the main microprocessor 702 through the bidirectional bus 730. The second subsidiary microprocessor 706 is thus responsive to signals supplied from the various sensors and detectors included in the document feeder unit 302. The subsidiary microprocessor 706 is further operative to actuate various active devices and drive units included in the document feeder unit 302.

The various pieces of information which are thus supplied to the main and subsidiary microprocessors 702, 704, 706 and 442 are loaded into a random-access memory 736 (RAM) directly or after being processed by the microprocessor 702. The random-access memory 736 has a built-in backup power source 738 to assuredly retain the information thus stored in the memory 736.

Description will be hereinafter made with reference to the flowcharts of FIG. 22 et seq. in regard to the operation of each of the main microprocessor 702 and then first and second subsidiary microprocessors 704 and 706.

Main Routine Program for MPU1

Figure 22:
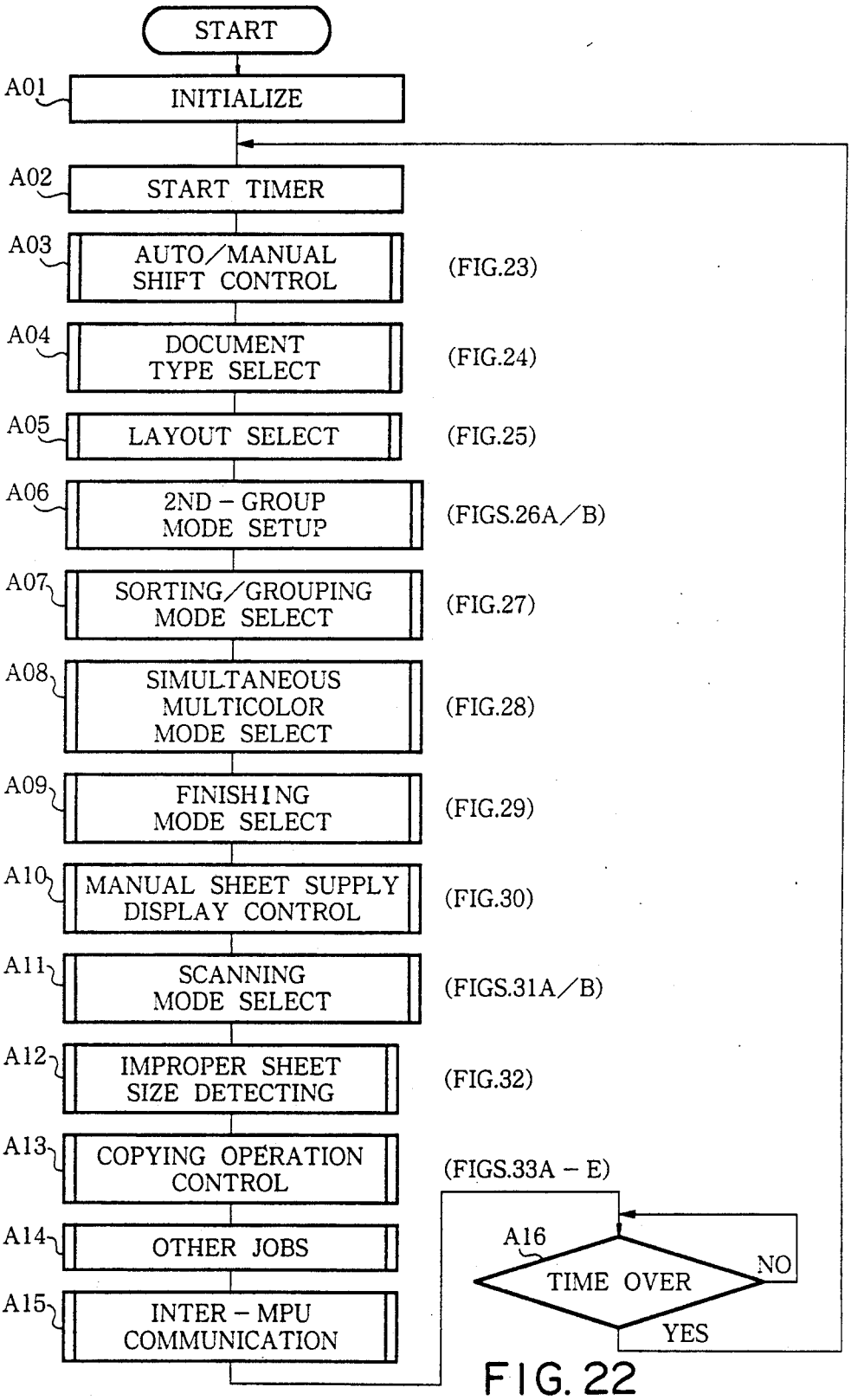
FIG. 22 is a flowchart showing the flow of the main routine program to be executed by a main microprocessor forming part of the control circuit illustrated in FIG. 21.

FIG. 22 is a flowchart showing the flow of the main routine program to be executed by the main microprocessor 702.

The main microprocessor 702 is activated to start execution of the main routine program when the main switch (power supply switch, not shown) of the apparatus is closed or the microprocessor 702 is reset. Thus, the main microprocessor 702 first proceeds to step A01 to initialize all the variable parameters in the system to the starting values selected by the system default rules. At this step A01, the contents of the memory 736 and various registers provided in the microprocessor 702 are thus cleared and the various active units, devices and elements of the duplicating apparatus are set in predetermined initial conditions.

On completion of the initialization of the system, the main microprocessor 702 activates the internal timer which is set for a period of time required for the single itineration through the subsequent steps of the main routine program. Such a period of time has been set in the initialization step A01.

After the internal timer has started time counting operation, the main microprocessor 70 executes a series of subroutine programs A03 to A15 and, on complete iteration of these subroutine programs A03 to A15, proceeds to step A16 to check if the period of time set for the internal timer has elapsed. When it is confirmed at step A16 that the period of time set for the timer has elapsed, the microprocessor 702 reverts to step A02 and reiterates the step A02 and the series of subroutine programs A03 to A15 and step A16.

The series of subroutine programs A03 to A15 thus included in the main routine program for the main microprocessor 702 are as follows:

Auto/manual shift control subroutine program A03 responsive to a signal from the auto/manual shift key 624 for selecting the automatic print-sheet selecting mode (APS) the automatic magnification selecting mode (AMS) or the manual print-sheet/magnification selecting mode. The details of this auto/manual shift control subroutine program A03 are to be described with reference to FIG. 23.

Type-of-document select subroutine program A04 responsive to a signal from the first column key 688 in the second key/indicator area AR2 of the control panel 600 for selecting the type of the documents to be duplicated such as the single-faced type, double-faced type, book type or two-in-one type. The details of this type-of-document select subroutine program A04 are to be described with reference to FIG. 24.

Layout select subroutine program A05 responsive to a signal from the second column key 690 in the second key/indicator area AR2 of the control panel 600 for selecting the layout of the images to be reproduced on print sheets such as the single-face mode, duplex copying mode, or composite copying mode. The details of this layout select subroutine program A05 are to be described with reference to FIG. 25.

Second-group mode setup subroutine program A06 responsive to signals from the first and second column keys 688 and 690 in the second key/indicator area AR2 of the control panel 600 for establishing any of the second-group modes of operation assigned to the columns of indicator sections 680 and 682 associated with the keys 688 and 690, respectively. The details of this are second-group mode setup subroutine program A06 to be described with reference to FIGS. 26A and 26B.

Sorting/grouping mode select subroutine program A07 responsive to a signal from the third column key 692 in the second key/indicator area AR2 of the control panel 600 for selecting either the sorting mode or the grouping mode in collecting discharged printed outputs. The details of this sorting/grouping mode select subroutine program A07 are to be described with reference to FIG. 27.

Simultaneous multi-color mode select subroutine program A08 responsive to a signal from the simultaneous multi-color mode select key 678 in the first key/indicator area AR1 of the control panel 600 for selecting or cancelling the simultaneous multi-colored copying mode. The details of this simultaneous multi-color mode select subroutine program A08 are to be described with reference to FIG. 28.

Finishing mode select subroutine program A09 responsive to a signal from the fourth column key 694 in the second key/indicator area AR2 of the control panel 600 for selecting either the stapling mode or the stamping mode in the finisher unit 550. The details of this finishing mode select subroutine program A09 are to be described with reference to FIG. 29.

Manual sheet supply display control subroutine program A10 responsive to a signal from the manually-fed sheet detecting switch 398 for indicating the number of the print sheets manually supplied through the manual sheet supply table 352. The details of this manual sheet supply display control subroutine program A10 are to be described with reference to FIG. 30.

Scanning mode setup subroutine program A11 for selecting either the scanner-moved scanning mode or the document-moved scanning mode depending on various parameters and selected modes of duplicating operation. The details of this scanning mode select subroutine program A11 are to be described with reference to FIGS. 31A and 31B.

Improper sheet size detecting subroutine program A12 for determining if the size of the print sheets selected is improper for the selected mode of operation for the finisher unit 550. The details of this improper sheet size warning subroutine program A12 are to be described with reference to FIG. 32.

Copying operation control subroutine program A13 responsive to various input signals for generating signals to actuate the various active units and elements which contribute to the execution of copying operation. The details of this copying operation control subroutine program A13 are to be described with reference to FIGS. 33A to 33E.

Subroutine program A14 for performing other jobs such as those for processing various instruction and data signals supplied from the control panel 600 and generating instructions to update the numerical data displayed on the control panel 600.

Subroutine program A15 by which the data received by the main microprocessor 702 may be stored into the registers incorporated in the microprocessor 702 and/or into the memory 736 for transmission to the first subsidiary microprocessor 704 and/or the second subsidiary microprocessor 706 as the case may be.

Auto/Manual Shift Control Subroutine Program A03

Figure 23:
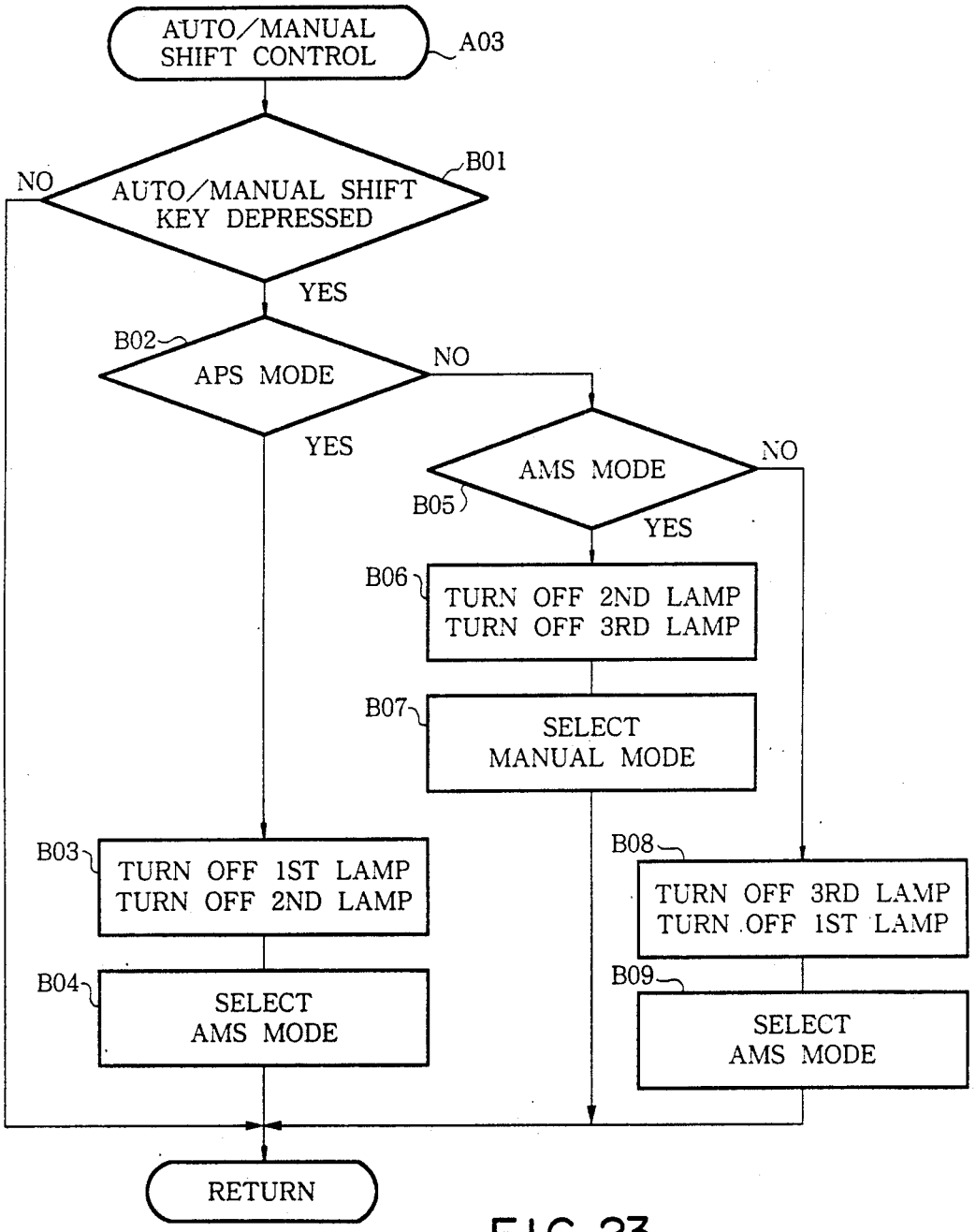
FIG. 23 is a flowchart showing the details of an auto-manual shift control subroutine program included in the main routine program illustrated in FIG. 22.

FIG. 23 is a flowchart showing the auto/manual shift control subroutine program A03 included in the main routine program hereinbefore described with reference to FIG. 22.

In this subroutine program A03, the microprocessor 702 first proceeds to step B01 to check if there is present a signal supplied from the auto/manual shift key 624 of the control panel 600. Every time it is confirmed at step B01 that there is a signal supplied from the auto/manual shift key 624, the steps following step B01 are executed. If it is found at step B01 that there is no signal supplied from the key 624, the main microprocessor 702 reverts to the main routine program illustrated in FIG. 22.

Thus, when the answer for the step B01 is given in the affirmative, the main microprocessor 702 proceeds to step B02 to detect whether or not the first indicator lamp 626 associated with the auto/manual shift key 624 is turned on to indicate that the automatic print-sheet selecting mode is selected. If it is found that this is the case, the microprocessor 702 proceeds to step B03 to turn off the first indicator lamp 626 and turn on the second indicator lamp 626 assigned to the automatic magnification selecting mode. Subsequently, the microprocessor 702 proceeds to step B04 to select the automatic magnification selecting mode (AMS).

On the other hand, if the answer for the step B02 is given in the negative, the main microprocessor 702 proceeds to step B05 to detect whether or not the second indicator lamp 626 is turned on to indicate that the automatic magnification selecting mode is selected. If it is found that this is the case, the microprocessor 702 proceeds to step B06 to turn off the second indicator lamp 626 and turn on the third indicator lamp 626 assigned to the manual print-sheet/magnification selecting mode. Subsequently, the microprocessor 702 proceeds to step B07 to select the manual print-sheet/magnification selecting mode.

Furthermore, if the answer for the step B05 is given in the negative, the main microprocessor 702 proceeds to step B08 to turn off the third indicator lamp 626 and turn on the first indicator lamp 626 associated with the auto/manual shift key 624. The microprocessor 702 then proceeds to step B09 to select the automatic print-sheep selecting mode (APS).

Subsequently to step B04, B07 or B09, the main microprocessor 702 reverts to the main routine program illustrated in FIG. 22 and proceeds to the type-of-document select subroutine program A04.

Type-of-Document Select Subroutine Program A04

Figure 24:
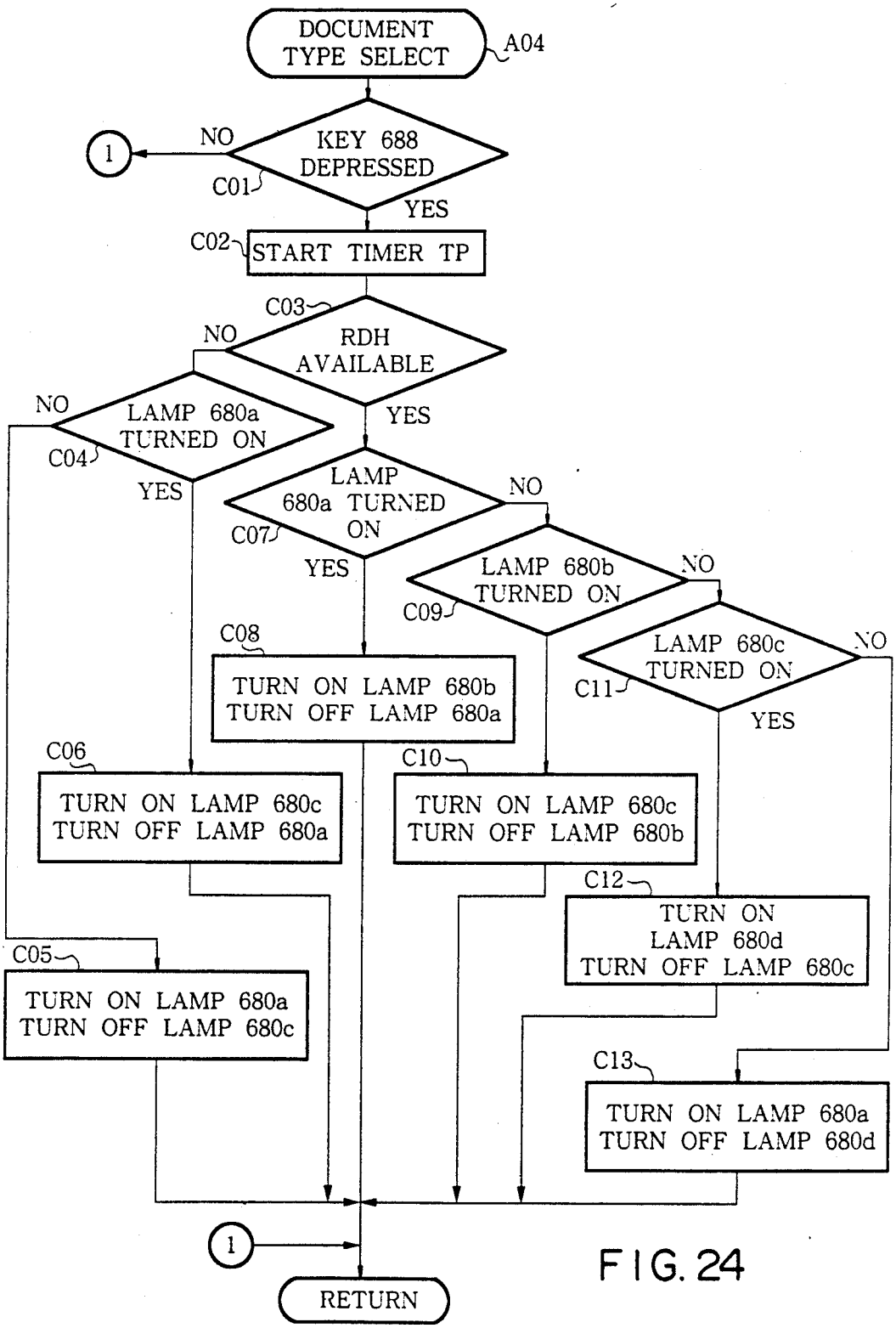
FIG. 24 is a flowchart showing the details of a type-of-document select program included in the main routine program illustrated in FIG. 22.

FIG. 24 is a flowchart showing the type-of-document select subroutine program A04 included in the main routine program described with reference to FIG. 22.

In this subroutine program A04, the microprocessor 702 first proceeds to step C01 to check if there is present a signal supplied from the first column key 688 in the second key/indicator area AR2 of the control panel 600. Every time it is confirmed at step C01 that there is a signal supplied from the key 688, the steps following step C01 are executed. If it is found at step C01 that there is no signal supplied from the key 688, the main microprocessor 702 reverts to the main routine program illustrated in FIG. 22.

Thus, when the answer for the step C01 is given in the affirmative, the main microprocessor 702 proceeds to step C02 to start timer TP and thereafter to step C03 to check if the document feeder unit 302 of the RDH type is available. If the answer for this step C03 is given in the negative, the microprocessor 702 determines that the duplex and two-in-one modes are inoperable and, thus, the step C03 is followed by step C04. At step C04, the main microprocessor 702 checks if the indicator lamp 680*a* associated with the column key 688 and assigned to the single-faced document copying mode is turned on. If it is found that the indicator lamp 680*a* is not turned on, the microprocessor 702 determines that the book copying mode has been selected and, as such, the step C04 is followed by step C05 to turn on the indicator lamp 680*a* and turn off the indicator lamp 680*c* associated with the column key 688 and assigned to the book copying document mode. If it is found at step C04 that the indicator lamp 680*a* is turned on, the microprocessor 702 determines that the single-faced document copying mode has been selected and, in this instance, the step C04 is followed by step C06 to turn off the indicator lamp 680*a* and turn off the indicator lamp 680*c* assigned to the book copying document mode.

On the other hand, if it is found at step C03 that the document feeder unit 302 of the RDH type is available, the microprocessor 702 proceeds to step C07 et seq. and selects the double-faced document, book, or two-in-one copying mode at step C08, C10 or C12, respectively, when it is confirmed at step C07, C09 or C11 that the indicator lamp 680*a*, the indicator lamp 680*b*, or the indicator lamp 680*c* is turned on. When it is found at step C11 that the indicator lamp 680*c* is not turned on, the single-faced document copying mode is selected with the indicator lamp 680*a* turned on at step C13.

After any of the single-faced document, double-faced document, book or two-in-one copying mode is thus selected at any of the steps C08, C10, C12, and C13, the main microprocessor 702 reverts to the main routine program illustrated in FIG. 22 and proceeds to the layout select subroutine program A05.

Layout Select Subroutine Program A05

Figure 25:
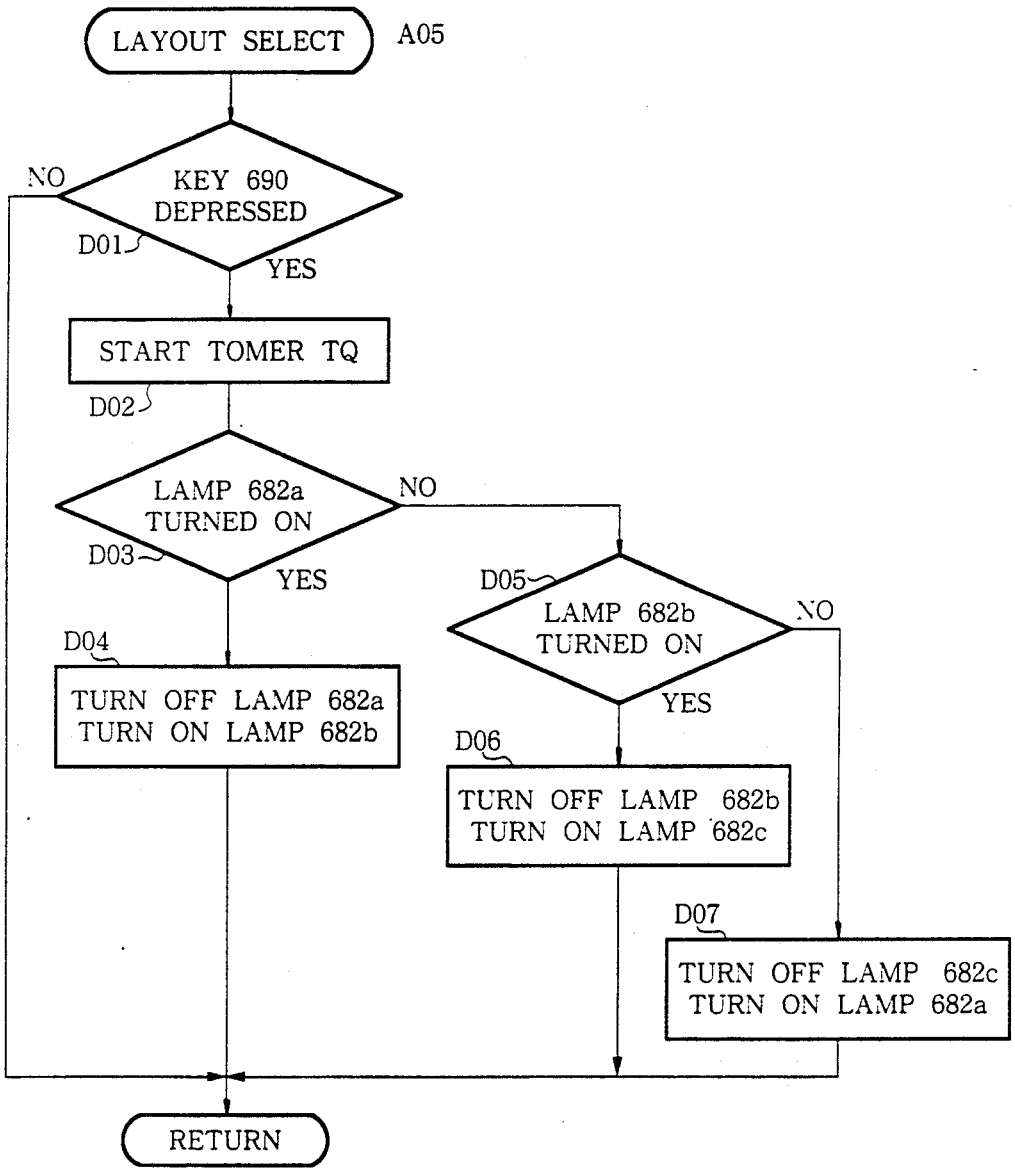
FIG. 25 is a flowchart showing the details of a layout select subroutine program included in the main routine program illustrated in FIG. 22.

FIG. 25 is a flowchart showing the layout select subroutine program A05 included in the main routine program described with reference to FIG. 22.

In this subroutine program A05, the microprocessor 702 first proceeds to step D01 to check if there is present a signal supplied from the second column key 690 in the second key/indicator area AR2 of the control panel 600. Every time it is confirmed at step D01 that there is a signal supplied from the key 690, the steps following step D01 are executed. If it is found at step D01 that there is no signal supplied from the key 690, the main microprocessor 702 reverts to the main routine program illustrated in FIG. 22.

Thus, when the answer for the step D01 is given in the affirmative, the main microprocessor 702 proceeds to step D02 to start timer TQ and thereafter proceeds to step D03 et seq. and selects the duplex or composite copying mode at step D04 or D06, respectively, when it is confirmed at step D03 or D05 that the indicator lamp 682*a* for the single-face sheet copying mode or the indicator lamp 682*b* for the duplex copying mode is turned on. When it is found at step D05 that the indicator lamp 682*b* is not turned on, the single-face sheet copying mode is selected with the indicator lamp 682*a* turned on at step D07.

After any of the single-face, duplex, or composite copying mode is thus selected at any of the steps D04, D06 or D07, the main microprocessor 702 reverts to the main routine program illustrated in FIG. 22 and proceeds to the second-group mode setup subroutine program A06.

Second-Group Mode Setup Subroutine Program A06

Figure 26A:
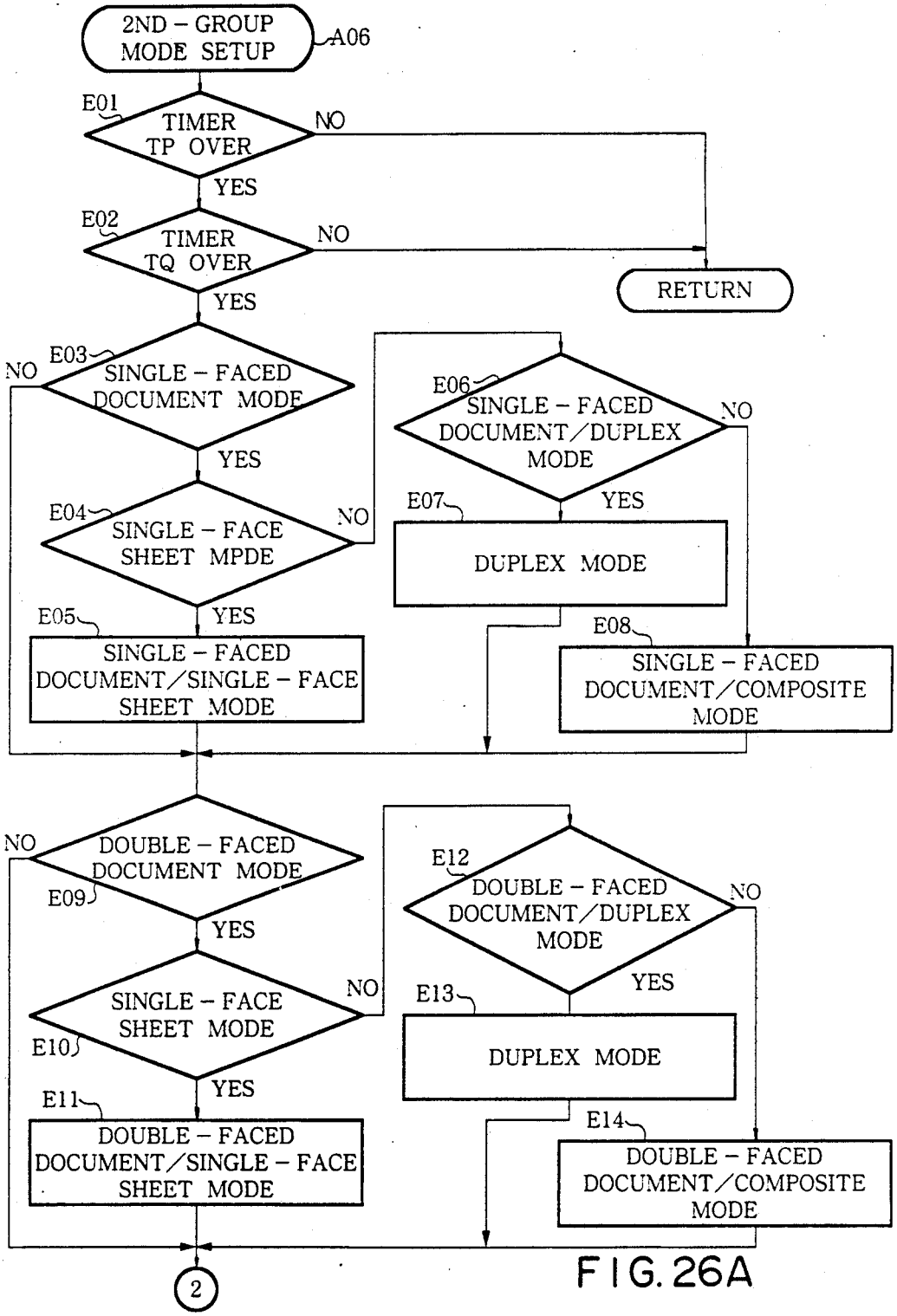
FIGS. 26A and 26B are flowcharts showing the details of a second-group mode setup control subroutine program included in the main routine program illustrated in FIG. 22.
Figure 26B:
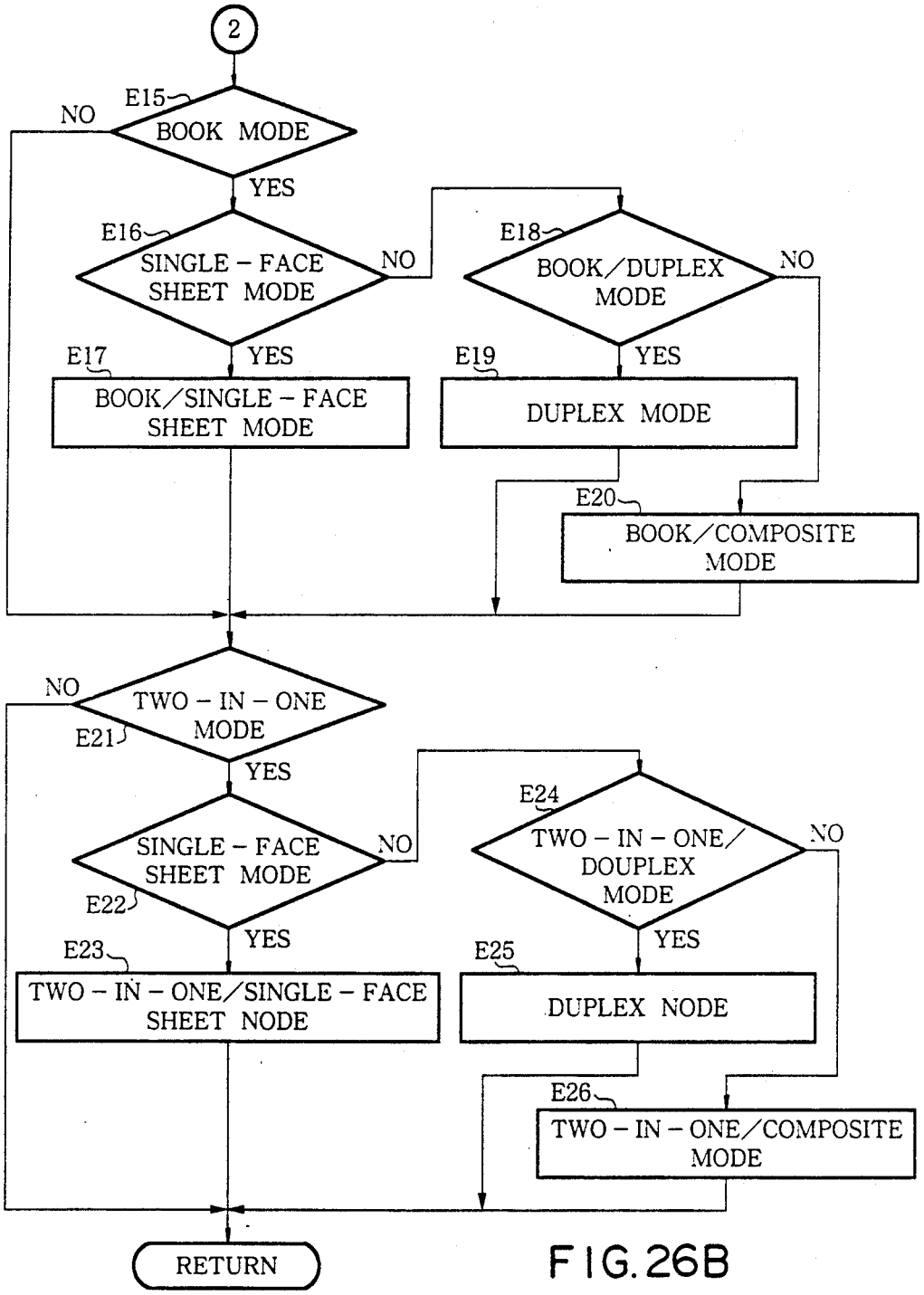

FIGS. 26A and 26B are flowchart showing the second-group mode setup subroutine program A06 included in the main routine program described with reference to FIG. 22. This second-group mode setup subroutine program A06 is executed on confirmation at steps E01 and E02 that both the time duration set for the timer TP used in the type-of-document select subroutine program A04 and the timer TQ used in the layout select subroutine program A05 have elapsed.

When it is thus confirmed at steps E01 and E02 that the time durations set for the timers TP and TQ have elapsed, the microprocessor 702 proceeds to step E03 to check if the single-faced document copying mode is selected by the type-of-document select subroutine program A04. If it is found that the single-faced document copying mode is selected, the microprocessor 702 proceeds to step E04 to check if the single-face sheet copying mode is selected by the layout select subroutine program A05. If the answer for this step E04 is given in the affirmative, the step E04 is followed by step E05 to set up the single-faced document and single-face sheet copying modes. If the answer for the step E04 is given in the negative, the step E04 is followed by step E06 to check if the duplex copying mode is selected by the layout select subroutine program A05. If the answer for this step E06 is given in the affirmative, the step E06 is followed by step E07 to set up the single-faced document and duplex copying modes. If the answer for the step E06 is given in the negative, then the step E06 is followed by step R08 to set up the single-faced document and composite copying modes.

The microprocessor 702 then checks at step E09 if the double-faced document copying mode is selected by the type-of-document select subroutine program A04. If it is found that the double-faced document copying mode is selected, the double-faced document and single-face sheet copying modes are set up through steps E10 and E11, the double-faced document and duplex copying modes are set up through steps E12 and E13, or the double-faced document and composite copying modes are set up through steps E12 and E14.

Subsequently, the microprocessor 702 proceeds to step E15 (FIG. 26B) to check if the book copying mode is selected by the type-of-document select subroutine program A04. If it is found that the book copying mode is selected, the book and single-face sheet copying modes are set up through steps E16 and E17, the book and duplex copying modes are set up through steps E18 and E19, or the book and composite copying modes are set up through steps E18 and E20.

The microprocessor 702 then checks at step E21 if the two-in-one copying mode is selected by the type-of-document select subroutine program A04. If it is found that the two-in-one copying mode is selected, the two-in-one and single-face sheet copying modes are set up through steps E22 and E23, the two-in-one and duplex copying modes are set up through steps E24 and E25, or the two-in-one and composite copying modes are set up through steps E24 and E26.

Subsequently to step E11, E13 or E14, the main microprocessor 702 reverts to the main routine program illustrated in FIG. 22 and proceeds to the sorting/grouping mode select subroutine program A07.

Sorting/Grouping Mode Select Subroutine Program A07

Figure 27:
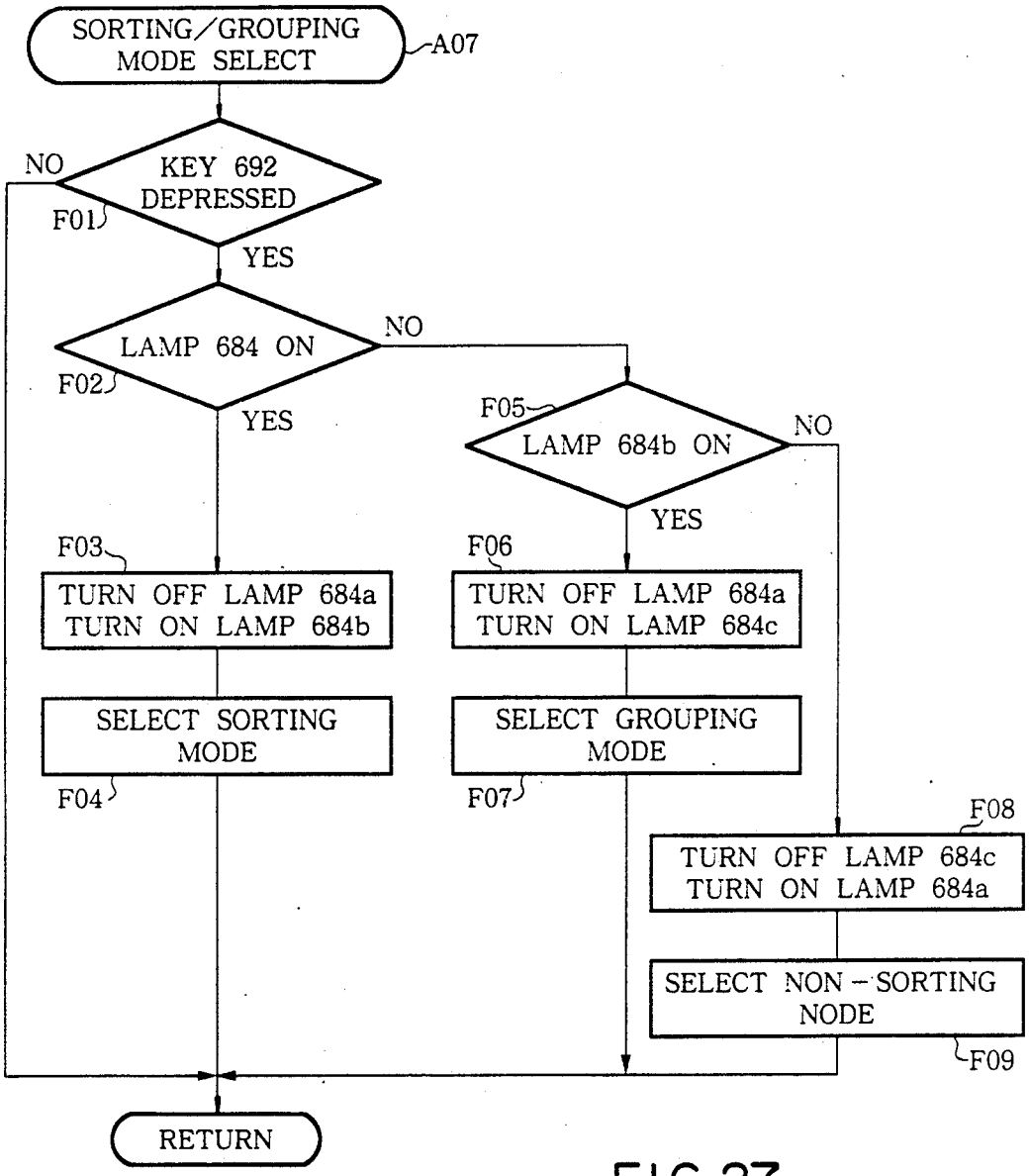
FIG. 27 is a flowchart showing the details of a sorting/grouping mode select subroutine program included in the main routine program illustrated in FIG. 22.

FIG. 27 is a flowchart showing the sorting/grouping mode select subroutine program A07 included in the main routine program described with reference to FIG. 22.

In this subroutine program A07, the microprocessor 702 first proceeds to step F01 to check if there is present a signal supplied from the third column key 692 in the second key/indicator area AR2 of the control panel 600. Every time it is confirmed at step F01 that there is a signal supplied from the key 692, the steps following step F01 are executed. If it is found at step F01 that there is no signal supplied from the key 692, the main microprocessor 702 reverts to the main routine program illustrated in FIG. 22.

Thus, when the answer for the step F01 is given in the affirmative, the main microprocessor 702 proceeds to step F02 to detect whether or not the indicator lamp 684*a* associated with the key 692 is turned on to indicate that the non-sorting mode is selected. If it is found that this is the case, the microprocessor 702 proceeds to step F03 to turn off the indicator lamp 684*a* and turn on the indicator lamp 684*b* associated with the key 692 and assigned to the sorting mode. Subsequently, the microprocessor 702 proceeds to step F04 to select the sorting mode.

On the other hand, if the answer for the step F02 is given in the negative, the main microprocessor 702 proceeds to step F05 to detect whether or not the indicator lamp 684*b* is turned on to indicate that the sorting mode is selected. If it is found that this is the case, the microprocessor 702 proceeds to step F06 to turn off the indicator lamp 684*b* and turn on the indicator lamp 684*c* associated with the key 692 and assigned to the grouping mode. Subsequently, the microprocessor 702 proceeds to step F07 to select the grouping mode.

Furthermore, if the answer for the step F05 is given in the negative, the main microprocessor 702 proceeds to step F08 to turn off the indicator lamp 684*c* and turn on the indicator lamp 684*a*. The microprocessor 702 then proceeds to step F09 to select the non-sorting mode.

Subsequently to step F04, F07 or F09, the main microprocessor 702 reverts to the main routine program illustrated in FIG. 22 and proceeds to the simultaneous multi-color mode select subroutine program A08.

Simultaneous Multi-Color Mode Select Subroutine Program A08

Figure 28:
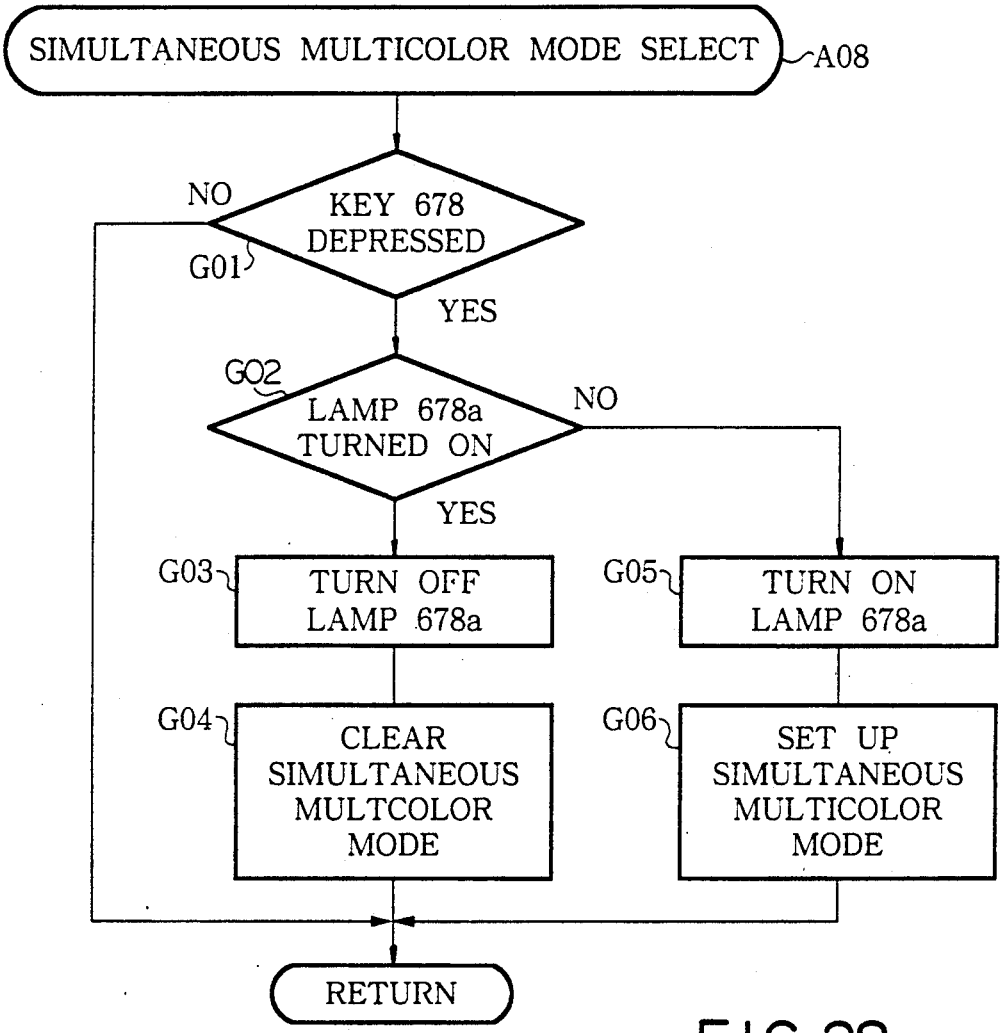
FIG. 28 is a flowchart showing the details of a simultaneous multi-color mode select subroutine program included in the main routine program illustrated in FIG. 22.

FIG. 28 is a flowchart showing the simultaneous multi-color mode select subroutine program A08 included in the main routine program described with reference to FIG. 22.

In this subroutine program A08, the microprocessor 702 first proceeds to step G01 to check if there is present a signal supplied from the simultaneous multi-color mode select key 678 in the first key/indicator area AR1 of the control panel 600. Every time it is confirmed at step G01 that there is a signal supplied from the simultaneous multi-color mode select key 678, the steps following step G01 are executed. If it is found at step G01 that there is no signal supplied from the key 678, the main microprocessor 702 reverts to the main routine program illustrated in FIG. 22.

Thus, when the answer for the step G01 is given in the affirmative, the main microprocessor 702 proceeds to step G02 to detect whether or not the indicator lamp 678*a* associated with the key 678 is turned on to indicate that the simultaneous multi-color mode is selected. If it is found that this is the case, the microprocessor 702 proceeds to step G03 to turn off the indicator lamp 678*a* and further to step G04 to clear the simultaneous multi-color mode.

On the other hand, if the answer for the step G02 is given in the negative, the main microprocessor 702 proceeds to step G05 to turn on the indicator lamp 678*a* and further to step G06 to set up the simultaneous multi-color mode.

Subsequently to step G04 or G06, the main microprocessor 702 reverts to the main routine program illustrated in FIG. 22 and proceeds to the finishing mode select subroutine program A09.

Finishing Mode Select Subroutine Program A09

Figure 29:
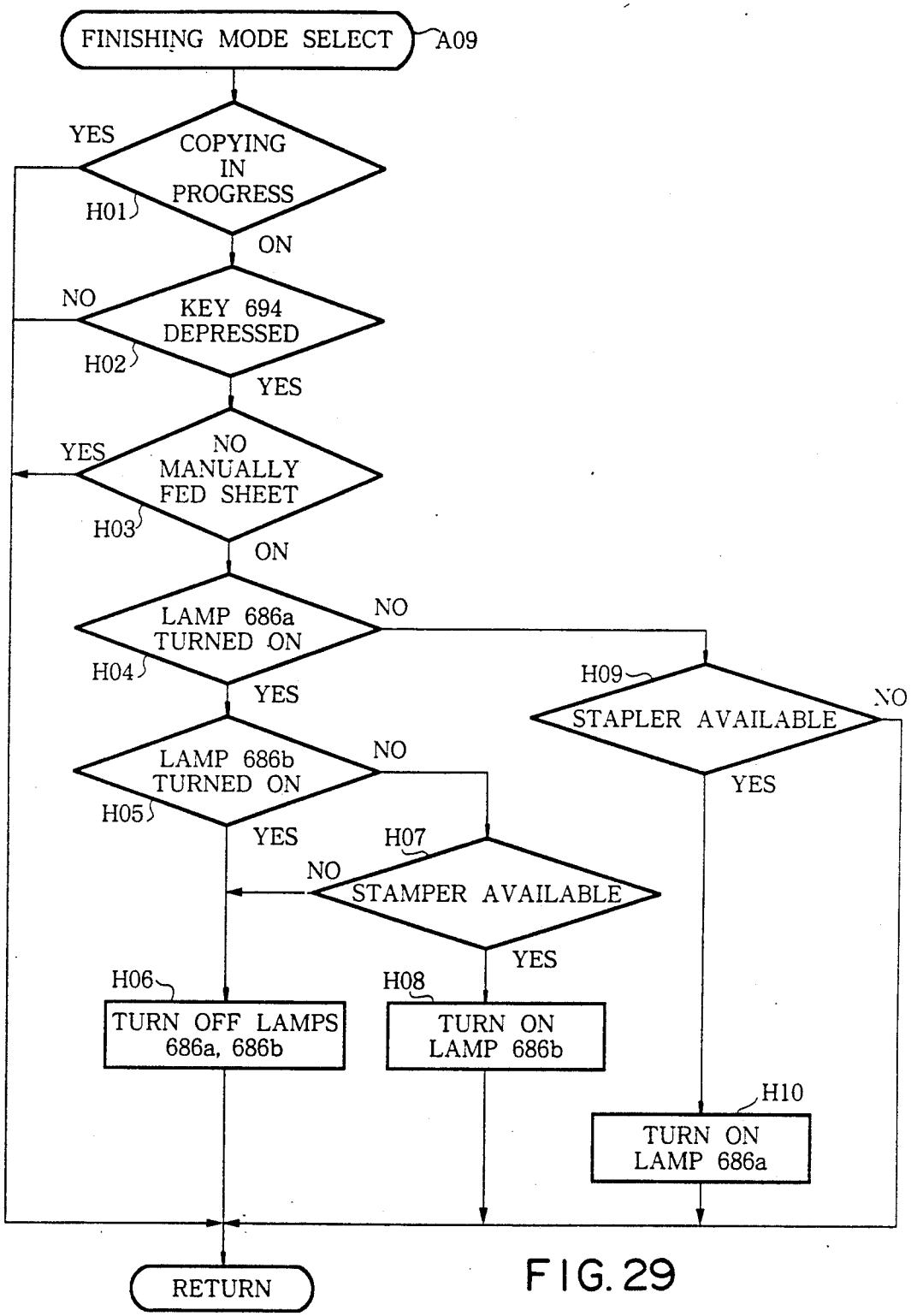
FIG. 29 is a flowchart showing the details of a finishing mode select subroutine program included in the main routine program illustrated in FIG. 22.

FIG. 29 is a flowchart showing the finishing mode select subroutine program A09 included in the main routine program described with reference to FIG. 22.

In this subroutine program A09, the microprocessor 702 first proceeds to step H01 to check if copying operation is currently in progress. If it is found that copying operation is currently in progress, the microprocessor 702 proceeds to the main routine program illustrated in FIG. 22. On the other hand, if the answer for the step H01 is given in the negative, the microprocessor 702 checks at step H02 if there is present a signal supplied from the fourth column key 694 in the second key/indicator area AR2 of the control panel 600. If it is found that there is not present a signal from the key 694, the microprocessor 702 proceeds to the main routine program illustrated in FIG. 22. If however the answer for the step H02 is given in the affirmative, the microprocessor 702 checks at step H03 if there is present a signal supplied from the manually-fed sheet detecting switch 398 which is adapted to detect a print sheet manually supplied into the main duplicator module 300 through the manual sheet supply table 352. If it is found that there is present a signal from the switch 398, the microprocessor 702 also proceeds to the main routine program illustrated in FIG. 22.

Every time it is confirmed at step H03 that there is no signal supplied from the manually-fed sheet detecting switch 398, the steps following step H04 are executed. Thus, when the answer for the step H03 is given in the negative, the main microprocessor 702 proceeds to step H04 to check if the indicator lamp 686*a* associated with the fourth column key 694 in the second key/indicator area AR2 and assigned to the stapling mode of operation of the finisher unit 550 is turned on. If the answer for this step H04 is given in the affirmative, the microprocessor 702 further checks at step H05 if the indicator lamp 686*b* associated with the key 694 and assigned to the stamping mode of operation of the finisher unit 550 is turned on. If the answer for this step H05 is given in the affirmative, the microprocessor 702 proceeds to step H06 to turn off both of the stapling-mode indicator lamp 686*a* and the stamping-mode indicator lamp 686*b*.

If it is found at step H05 that the indicator lamp 686*b* assigned to the stamping mode is not turned on, the step H05 is followed by step H07 to check if the stamper 564 is available. If the answer for this step H07 is given in the affirmative, the microprocessor 702 proceeds to step H08 to turn on the stamping-mode indicator lamp 686*b* and, if the answer for the step H07 is given in the negative, the microprocessor 702 proceeds to step H06 to turn off the indicator lamps 686*a* and 686*b*.

On the other hand, when it is found at step H04 that the stapler-mode indicator lamp 686*a* is not turned on, the microprocessor 702 further checks at step H09 if the stapler 562 is available. If the answer for this step H09 is given in the affirmative, the microprocessor 702 proceeds to step H10 to turn on the stapling-mode indicator lamp 686*a*. If the answer for this step H10 is given in the negative or subsequently to step H06 or H08, the main microprocessor 702 reverts to the main routine program illustrated in FIG. 22 and proceeds to the manual sheet supply display control subroutine program A10.

Manual Sheet Supply Display Control Subroutine Program A10

Figure 30:
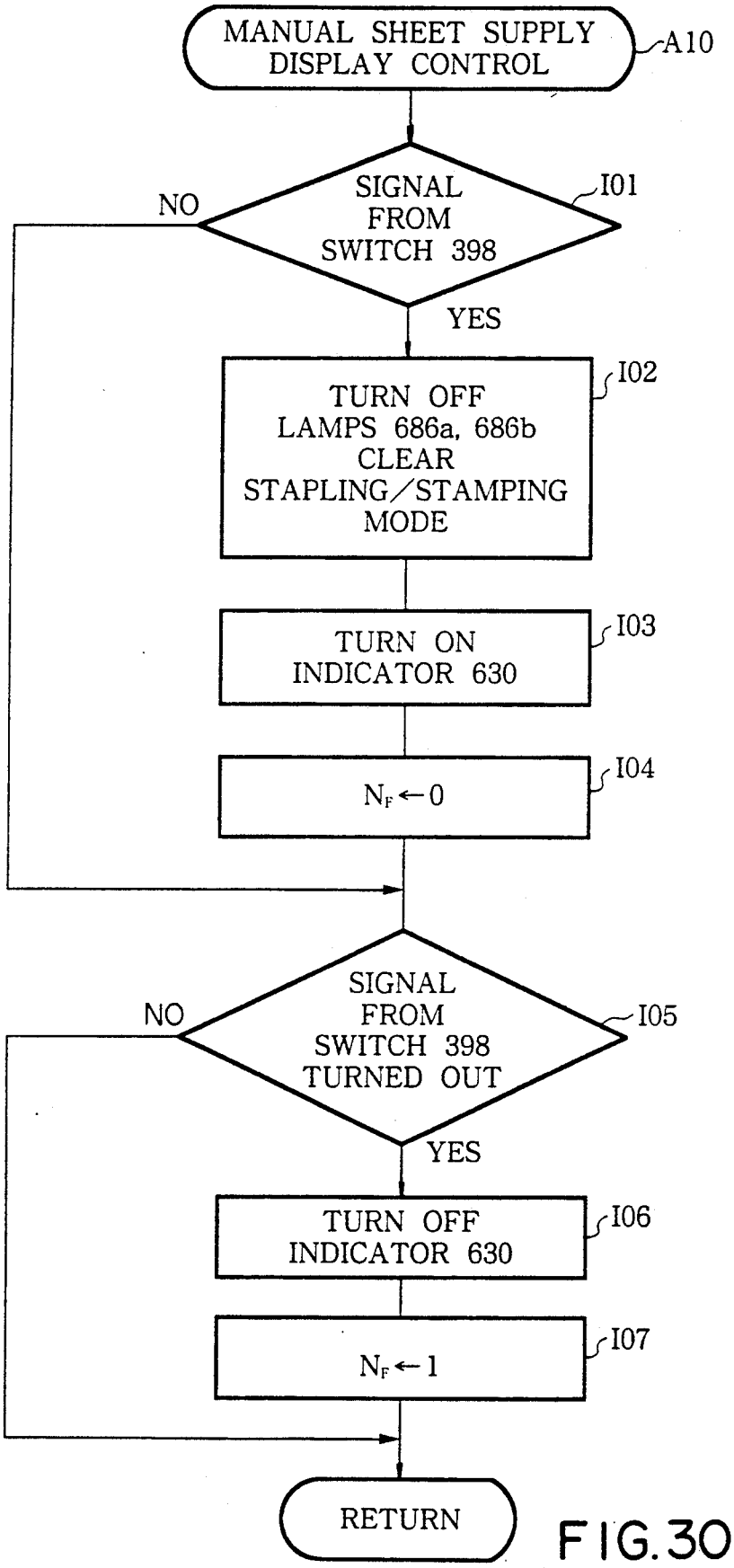
FIG. 30 is a flowchart showing the details of a manual sheet supply display control subroutine program included in the main routine program illustrated in FIG. 22.

FIG. 30 is a flowchart showing the manual sheet supply display control subroutine program A10 included in the main routine program described with reference to FIG. 22.

In this subroutine program A10, the microprocessor 702 first proceeds to step I01 to check if there is present a signal supplied from the manually-fed sheet detecting switch 398 with a print sheets manually supplied through the manual sheet supply table 352. Every time it is confirmed at step I01 that there is a signal supplied from the switch 398, the steps following step I01 are executed. If it is found at step I01 that there is no signal supplied from the switch 398, the main microprocessor 702 reverts to the main routine program illustrated in FIG. 22.

Thus, when the answer for the step I01 is given in the affirmative, the main microprocessor 702 proceeds to step I02 to generate instructions to turn off both of the stapling-mode indicator lamp 686*a* and the stamping-mode indicator lamp 686*b* and clear the stapling or stamping mode which has been selected for the finisher unit 550. It may be noted in this connection that the use of the finisher unit 550 is not desirable for the finishing of printed outputs produced from manually supplied print sheets because of the fact that, ordinarily, a relative small number of print sheets are manually supplied. For this reason, neither the stapling mode nor the stamping mode can be selected and used when print sheets are manually supplied into the apparatus.

The microprocessor 702 then proceeds to step I03 to turn on the indicator lamp 630 located in the this key-/indicator area AR3 of the control panel 600 and further to step I04 to reset the numerical display window 606 on the control panel 600 to indicate numeral "0" as the number $N_F$ of the print sheets to be handled by the finisher unit 550.

Subsequently to step I04 or in the absence detected of a signal from the manually-fed sheet detecting switch 398, the microprocessor 702 proceeds to step I05 to check if the signal which has been supplied from the manually-fed sheet detecting switch 398 is turned out. If it is confirmed at step I05 that there is a signal supplied from the switch 398, the main microprocessor 702 reverts to the main routine program illustrated in FIG. 22.

When it is found at step I05 that the signal from the manually-fed sheet detecting switch 398 is turned out, the microprocessor 702 proceeds to step I06 to turn off the indicator lamp 630 on the control panel 600 and further to step I04 to reset the numerical display window 606 on the control panel 600 to indicate numeral "1" as the initial number of the print sheets to be handled by the finisher unit 550.

Subsequently to step I07 or when it is found at step I05 that there is a signal from the manually-fed sheet detecting switch 398, the main microprocessor 702 reverts to the main routine program illustrated in FIG. 22 and proceeds to the scanning mode select subroutine program A11.

Scanning-Mode Select Subroutine Program A11

Figure 31A:
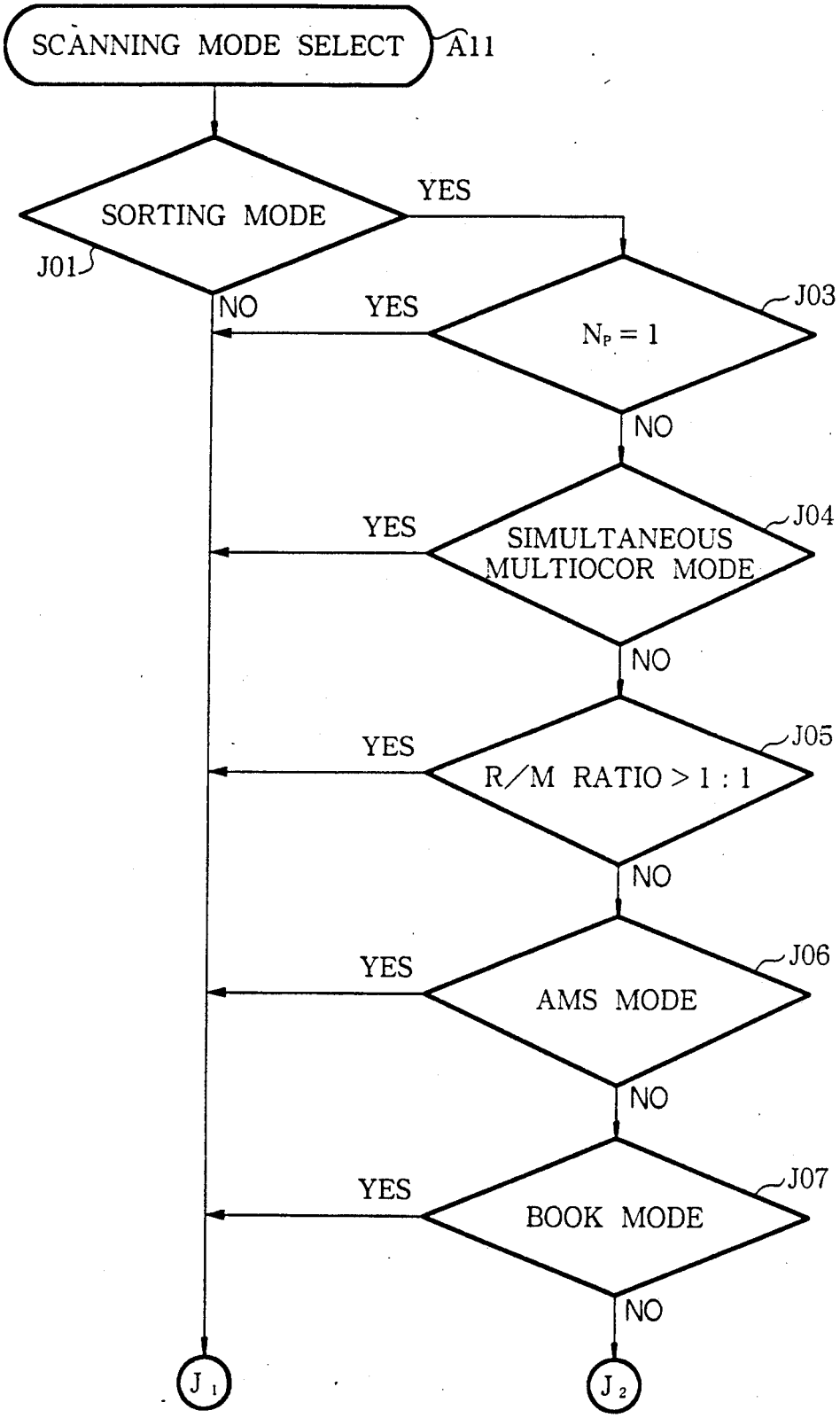
FIGS. 31A and 31B are flowcharts showing the details of a scanning mode select subroutine program included in the main routine program illustrated in FIG. 22.
Figure 31B:
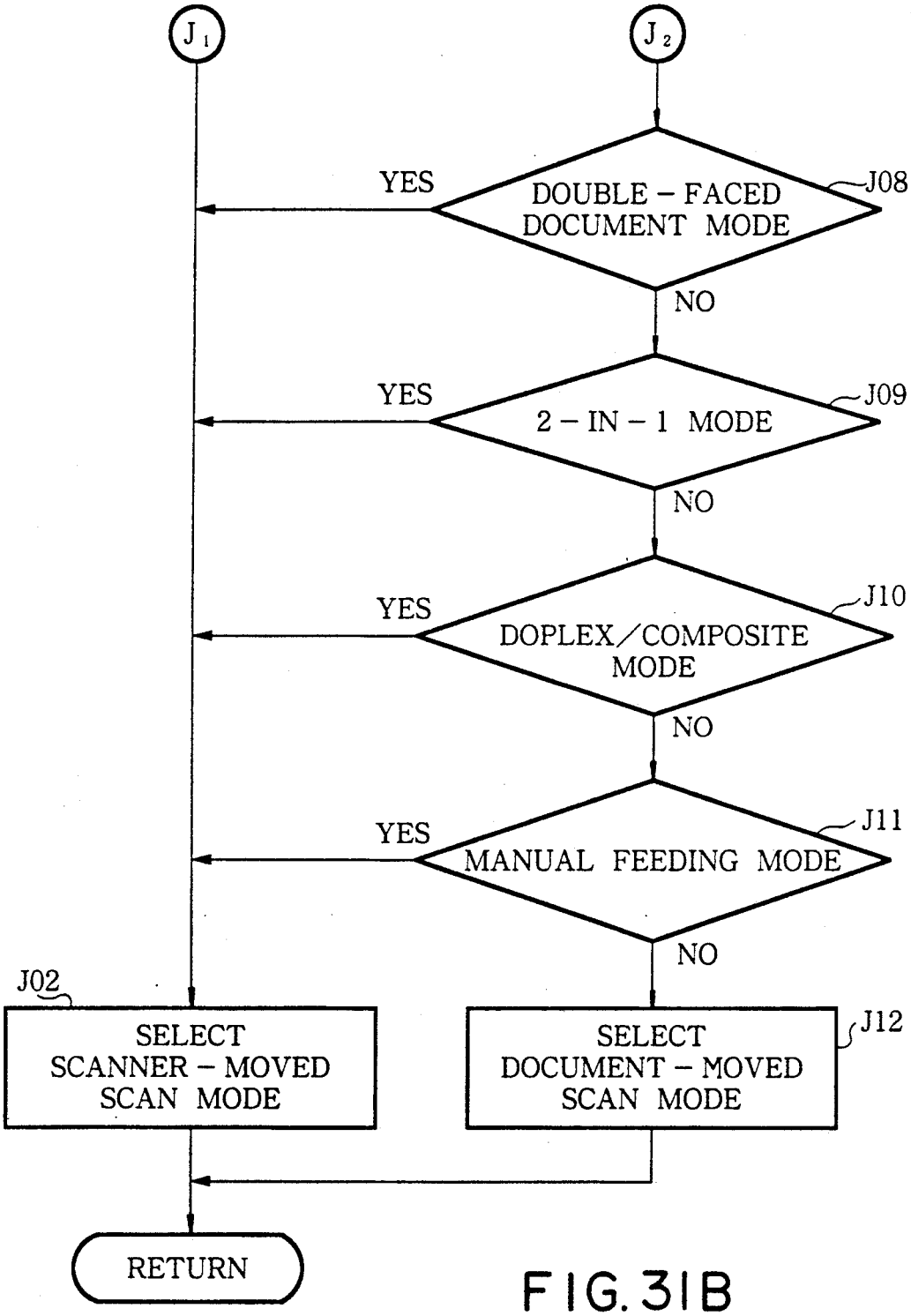

FIGS. 31A and 31B are flowcharts showing the scanning mode select subroutine program A11 included in the main routine program described with reference to FIG. 22. This scanning mode select subroutine program A11 is executed for selecting either the scanner-moved scanning mode or the document-moved scanning mode depending on various parameters and selected modes of duplicating operation.

The scanning mode select subroutine program A11 starts with step J01 at which the main microprocessor 702 checks if the sorting mode is selected for discharging printed outputs. When the answer for this step J01 is given in the negative, the microprocessor 702 selects the scanner-moved scanning mode at step J02 and thereafter returns to the main routine program described with reference to FIG. 22. As has been noted, the scanner-moved scanning mode is more suitable for the grouping mode than the document-moved scanning mode.

If it is determined at step J01 that the sorting mode is selected, the main microprocessor 702 proceeds to steps J03 to J11 to check if the number $N_P$ of the printed outputs to be produced is unity (step J03), if the simultaneous multi-color mode is selected (step J04), if the magnified copying mode is selected with the R/M ratio selected to be larger than 1:1 (step J05), if the automatic magnification select (AMS) mode is selected (step J06), if the book copying mode is selected (step J07), if the double-faced document copying mode is selected (step J08), if the two-in-one copying mode is selected (step J09), if the duplex or composite copying mode is selected (J10), and if the manual sheet feeding mode is selected (step J11). If the answer for any one of these steps J03 to J11 is given in the affirmative, the microprocessor 702 proceeds to the step J02 to select the scanner-moved scanning mode and, if the answer for every one of the steps J03 to J11 is given in the negative, the microprocessor 702 proceeds to step J12 to select the document-moved scanning mode.

Subsequently to the step J02 or the step J12, the microprocessor 702 reverts to the main routine program illustrated in FIG. 22 and proceeds to the improper sheet size detecting subroutine program A12.

Improper Sheet Size Detecting Subroutine Program A12

Figure 32:
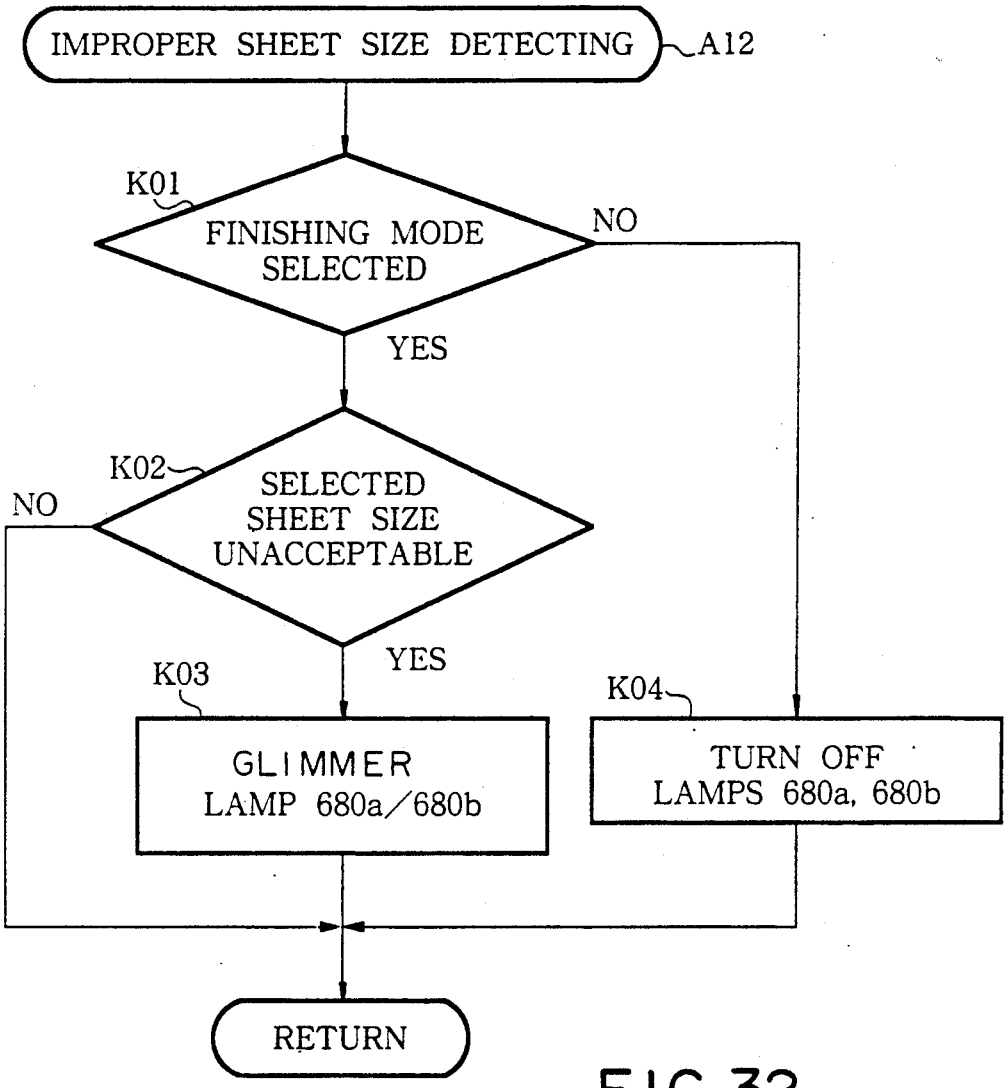
FIG. 32 is a flowchart showing the details of an improper sheet side detecting subroutine program included in the main routine program illustrated in FIG. 22.

FIG. 32 is a flowchart showing the improper sheet size detecting subroutine program A12 included in the main routine program described with reference to FIG. 22. This improper sheet size detecting subroutine program A12 is executed when it is detected at step K01 that the finishing mode is selected responsive to a signal from the fourth column key 694 in the second key/indicator area AR2 of the control panel 600. If the answer for this step K02 is given in the negative, the microprocessor 702 terminates the execution of this subroutine program A12 and reverts to the main routine program illustrated in FIG. 22.

In the presence of a signal from the key 694, the step K01 is followed by step K02 to check if the size of print sheets currently selected is unacceptable for the stapling or stamping operation to be performed in the finisher unit 550. If the answer for this step K02 is given in the affirmative, the microprocessor 702 proceeds to step K03 to generate an instruction so that the indicator lamp 680*a* or 680*b* associated with the key 694 and assigned to the currently selected finishing mode is turned on to glimmer to indicate that the selected size of print sheets is not acceptable for the selected finishing mode such as the stapling or stamping mode.

On the other hand, when it is detected at step K01 that the finishing mode is not selected, the step K01 is followed by step K04 to leave the indicator lamp 680*a* or 680*b* turned off. Subsequently to step k03 or K04, the microprocessor 702 reverts to the main routine program illustrated in FIG. 22 and proceeds to the copying operation control subroutine program A13.

Copying Operation Control Subroutine Program A13

FIGS. 33A to 33E are flowcharts showing the copying operation control subroutine program A13 included in the main routine program described with reference to FIG. 22. In this subroutine program A13, the microprocessor 702 first proceeds to step L01 to check if there is present a signal produced with the print start key 602 depressed on the control panel 600. If it is found that there is such a signal present, it is further checked at step L02 if there is a signal received from the document empty sensor 508 in the document feeder unit 302 with a document or a set of documents D placed on the document storage tray 404.

Figure 34:
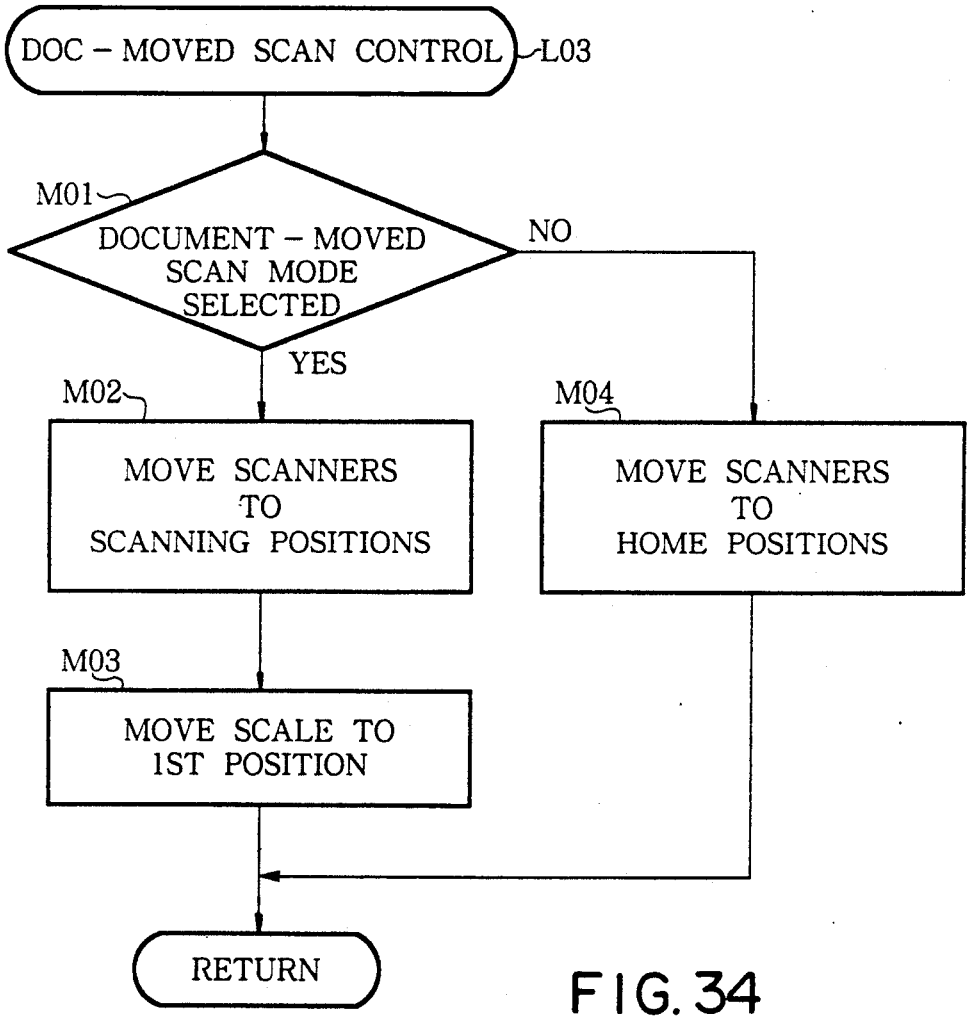
FIG. 34 is a flowchart showing the details of a document-moved scan control subroutine program included in the main routine program illustrated in FIG. 22.

On confirmation that the print start key 602 has been depressed and a document or a set of documents D placed on the tray 404, the microprocessor 702 executes a document-moved scanning mode control subroutine program L03, the details of which are illustrated in FIG. 34.

Referring to FIG. 34, the document-moved scanning mode control subroutine program L03 starts with step M01 to check if the document-moved scanning mode is selected. If it is found that the document-moved scanning mode is selected, the microprocessor 702 proceeds to step M02 to generate instructions to drive the scanner units 324/326 and 328/330 of the optical system 322 to move to their respective predetermined scanning positions below the document support table 304. Thereafter, the microprocessor 702 proceeds to step M03 to generate an instruction to drive the scale member 456 to downwardly turn to the first angular position allowing a document to move from the terminating end of the intermediate path portion 438 to the return-side turning path portion 440.

If it is found at step M01 that the document-moved scanning mode is not selected, then the microprocessor 702 proceeds to step M04 to generate instructions to drive the scanner units 324/326 and 328/330 of the optical system 322 to move to their respective home positions below the document support table 304. After the scanner units 324/326 and 328/330 are thus moved to their respective scanning or home positions with respect to the document support table 304 at step M03 or M04, the microprocessor 702 reverts to the copying operation control subroutine program A13 and proceeds to step L04 to generate a signal effective to initiate the document feeder unit 302 into operation. Subsequently to step L04, the microprocessor 702 proceeds to the steps shown in FIG. 33C et seq.

When it is detected at step L01 that there is a signal supplied from the print start key 602 but it is found at step L02 that there is no document placed on the document storage tray 404, the microprocessor 702 determines that a document is to be manually placed on the document support table 304 with the document feeder unit 302 held inoperative, In this instance, the step L02 is followed by step L05 to select the scanner-moved scanning mode and generate instructions to drive the scanner units 324/326 and 328/330 of the optical system 322 to move to their respective home home positions below the document support table 304.

Subsequently, the microprocessor 702 proceeds to step L06 to check if the selected size of printed sheet is improper or not. If it is determined that the selected size of print sheets is improper, the microprocessor 702 proceeds to the steps shown in FIG. 33C et seq. If it is determined at step L06 that the selected size of print sheets is not improper, the step L06 is followed by step L07 to set a copy start flag $F_{CS}$ to logic "1" state. The microprocessor 702 then proceeds to step L08 to check if a reverse-side copying flag $F_{RC}$ is of logic "0" state. If it is found that the flag $F_{RC}$ is not of logic "0" state, the microprocessor 702 proceeds to the steps shown in FIG. 33C et seq. If it is found at step L08 that the reverse-side copying flag $F_{RC}$ is of logic "0" state, the step L08 is followed by step L09 to set a front-side copying flag $F_{FC}$ to logic "1" state, whereupon the microprocessor 702 proceeds to the steps shown in FIG. 33C et seq.

Figure 33A:
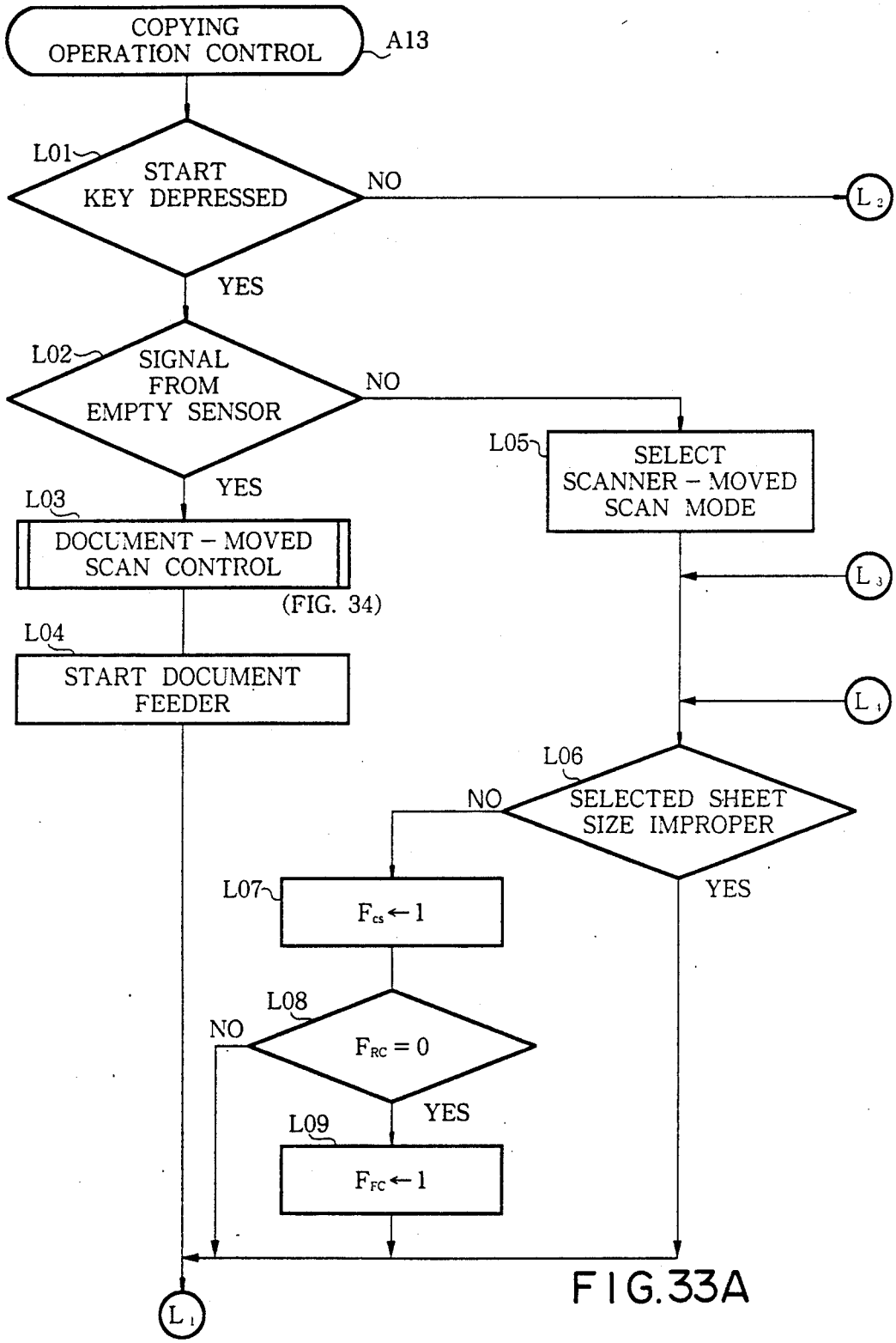
FIGS. 33A to 33E are flowcharts showing the details of a copying operation control subroutine program included in the main routine program illustrated in FIG. 22.
Figure 33B:
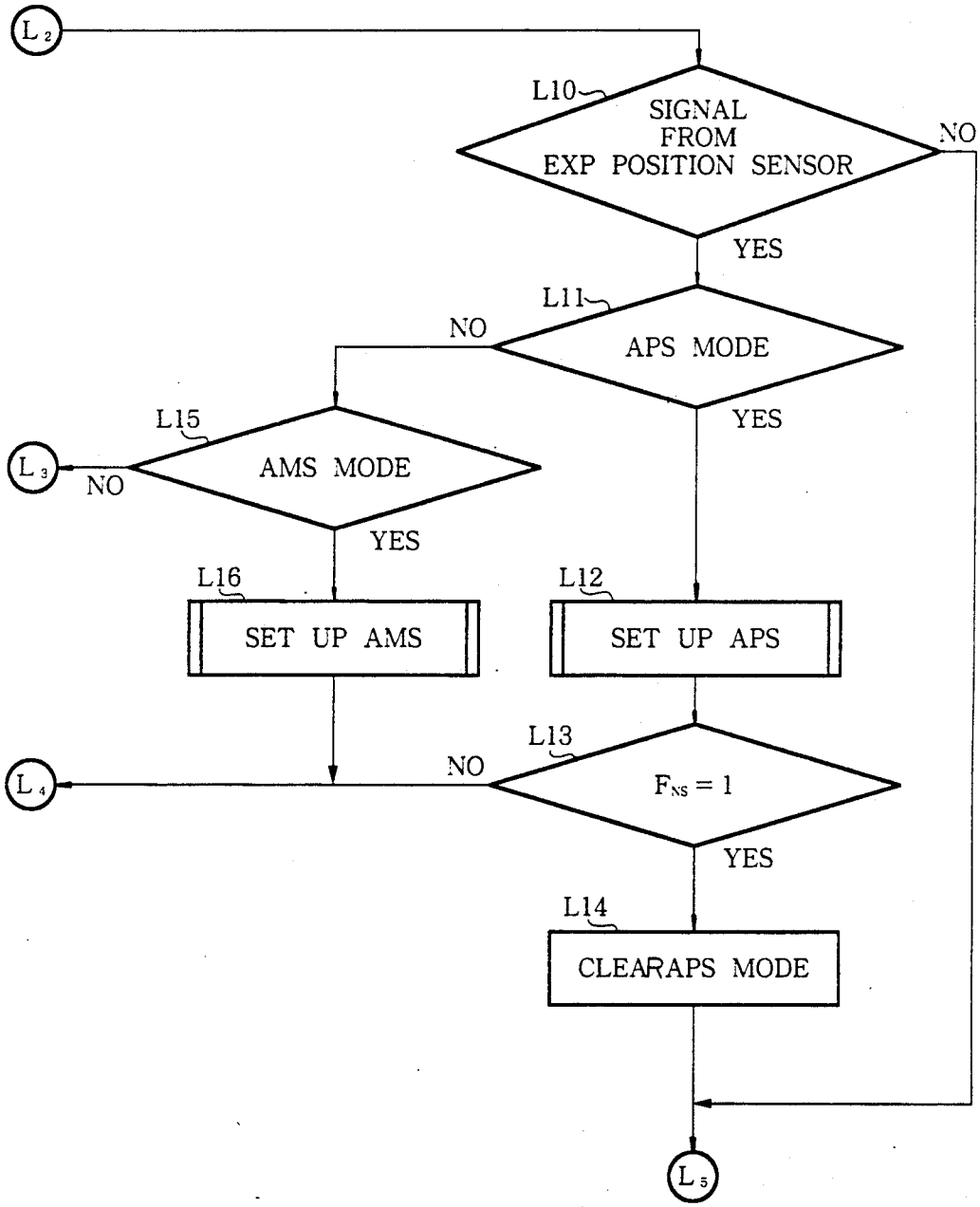

On the other hand, when it is detected at step L01 that there is no signal produced with the print start key 602 depressed, the microprocessor 702 proceeds to step L10 shown in FIG. 33B. At this step L10 is detected whether or not there is a signal supplied from the exposure position sensor 510 which is adapted to detect the presence of a document placed in the predetermined exposure position on the document support table 304. If the answer for this step L10 is given in the negative, the microprocessor 702 proceeds to the steps shown in FIG. 33C et seq.

If it is found at step L10 that there is a signal supplied from the exposure position sensor 510, the microprocessor 702 proceeds to step L11 to check if the automatic print-sheet select (APS) mode is selected at the automanual shift key 624 on the control panel 600. If the answer for this step L11 is given in the affirmative, the microprocessor 702 proceeds to step L12 to set up the automatic print-sheet select mode and further to step L13 to check if a flag $F_{NS}$ is of logic "1" state indicating that the print sheets of the selected size are not available in the first and second print sheet supply units 346 and 347. If it is found that the flag $F_{NS}$ is of logic "1" state, the microprocessor 702 proceeds to step L14 to clear the automatic print-sheet select mode and then to the steps shown in FIG. 33C et seq. If it is found at step L13 that the flag $F_{NS}$ is not of logic "1" state, then the microprocessor 702 determines that the print sheets of the selected size are available in the first or second print sheet supply unit 346 or 347 and as such proceeds to step L06.

When it is found at step L11 that the automatic print-sheet select mode is not selected, the microprocessor 702 proceeds to step L15 to check if the automatic magnification select (AMS) mode is selected. If the answer for this step L15 is given in the negative, the microprocessor 702 determines that neither the automatic print-sheet select mode not the automatic magnification select mode is currently selected and, thus, proceeds to step L06. If it is determined at step L15 that the automatic magnification select (AMS) mode is selected, the microprocessor 702 proceeds to step L16 to set up the automatic magnification select mode and thereafter to step L06.

Figure 33C:
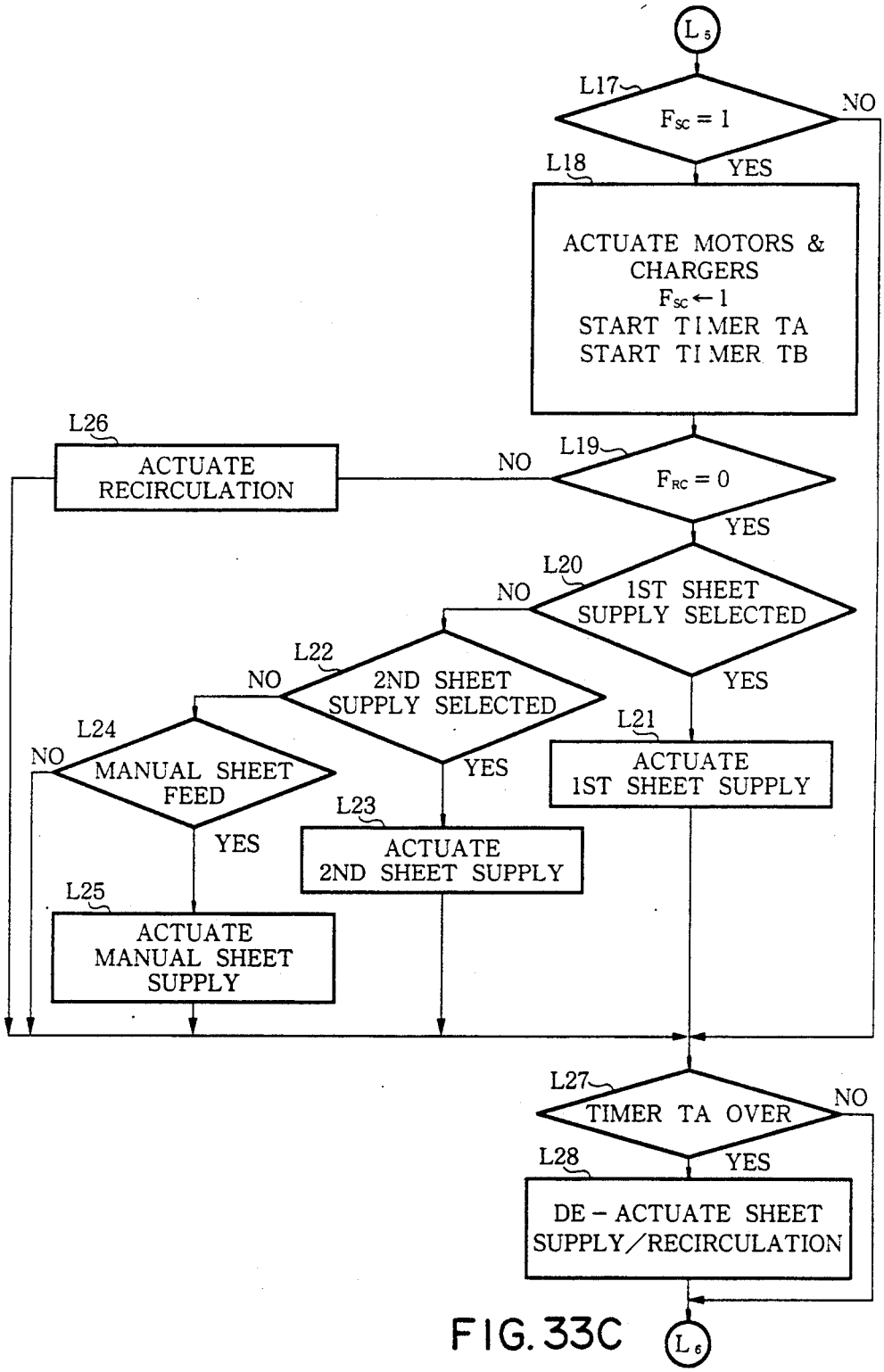
Figure 33D:
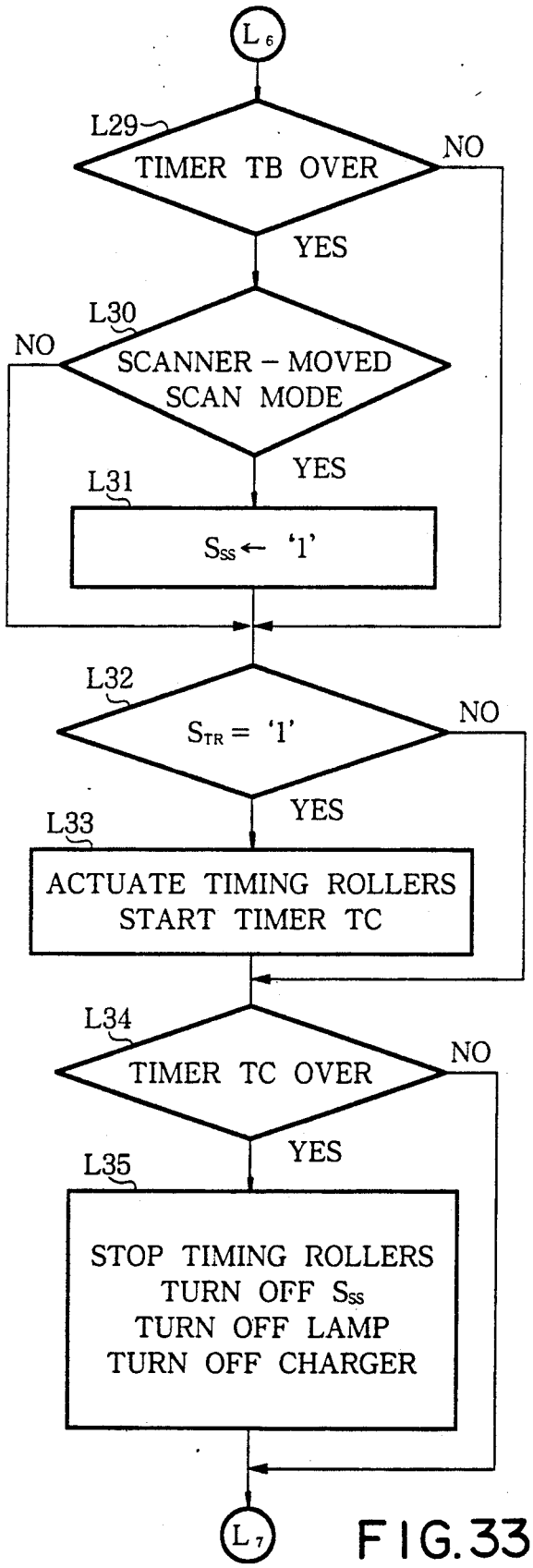
Figure 33E:
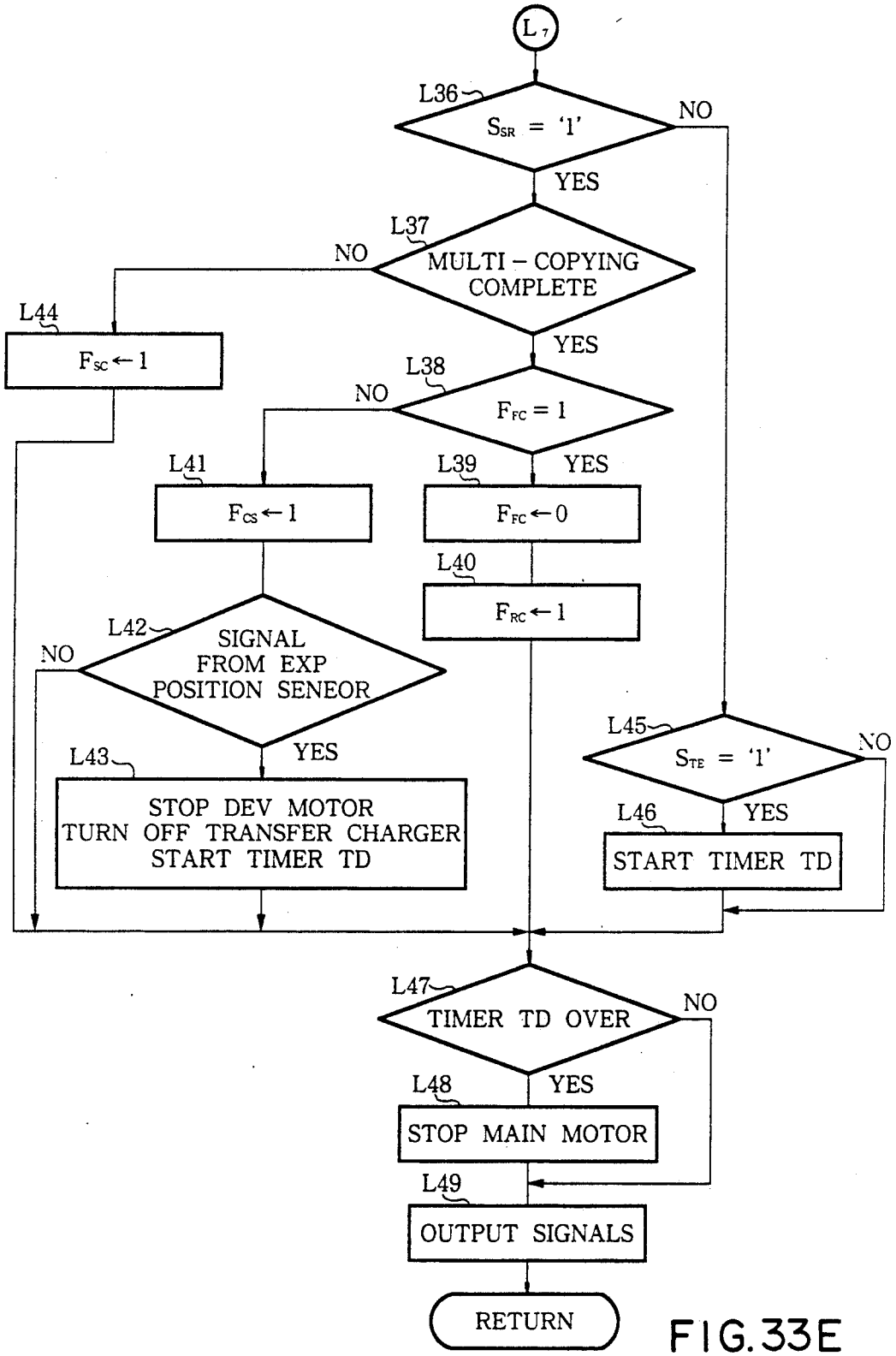

Subsequently to step L04, L09 or L14 or when the answer for step L08 or step L10 is given in the negative or the answer for step L06 is given in the affirmative, the microprocessor 702 proceeds to step L17 shown in FIG. 33C.

The microprocessor 702 checks at step L17 if the copy start flag $F_{CS}$ is of logic "1" state. If the answer for this step L17 is given in the affirmative, the step L17 is followed by step L18 at which the microprocessor 702 generates instructions to activate the exposure lamp 324 in the optical system 322 and the various active devices form the image reproducing stage in the main duplicator module 300. Such active units include the motors for the photosensitive drum 306 and first and second developing units 314*a* and 314*b*, the main charger 310, the transfer charger 316. At step L18, furthermore, the copy start flag $F_{CS}$ is reset to logic "0" state and timers TA and TB are activated.

Subsequently to step L18, the microprocessor 702 proceeds to step L19 to check if the reverse-side copying flag $F_{RC}$ is of logic "0" state. If the answer for this step L19 is given in the negative, the clutch for the pickup roller 354 or 356 associated with the first or second sheet supply unit 346 or 348 is actuated through steps L20 and L21, or the clutch for the feed roller pair 374 associated with the manual sheet supply table 352 is actuated through steps L22 and L23. If it is found at step L19 that the reverse-side copying flag $F_{RC}$ is not of logic "0" state, the microprocessor 702 determines that the duplex copying mode is currently selected and, as such, proceeds to step L26 to actuate the clutch for the pickup roller 358 associated with the sheet recirculation unit 350.

Subsequently to the step L21, L23, L25 or L26 or when the answer for the step L17 is given in the negative, the microprocessor 702 proceeds to step L27 to check if the time duration set for the timer TA has elapsed. If the answer for this step L27 is given in the affirmative, the step L27 is followed by step L28 to turn off the clutch for the pickup roller 354 or 356 associated with the sheet supply unit 346 or 348, the clutch for the manual sheet feed roller pair 374 or the clutch for the pickup roller 358 associated with the sheet recirculation unit 350 to put an end to the sheet feeding operation. Subsequently to this step L28 or when the answer for the preceding step L27 is given in the negative, the microprocessor 702 proceeds to step L29 shown in FIG. 33D.

At this step L29 is checked if the time duration set for the timer TB has elapsed. If the answer for the step L29 is given in the affirmative, it is confirmed at step L30 if the scanner-moved scanning mode is selected. If the answer for this step L30 is given in the affirmative, the microprocessor 702 proceeds to step L31 to generate a scan signal $S_{SS}$. Subsequently to step L31 or when the answer for the step L29 or the step L30 is given in the negative, the microprocessor 702 proceeds to step L32 to check if there is a signal $S_{TR}$ supplied from the timing detect switch 400 in the presence of a print sheet which has reached the timing roller pair 372. In the presence detected of the signal $S_{TR}$ from the timing detect switch 400, the microprocessor 702 proceeds to step L33 and generates an instruction to actuate the clutch for the timing roller pair 372 and activates a timer TC. When it is detected at step L34 that the time duration set for this timer TC is elapsed, the microprocessor 702 proceeds to step L35 to generate instructions to de-activate the clutch for the timing roller pair 372, turn off the exposure lamp 324 and main charger 310 and ceases generation of the start signal $S_{SS}$. With this step L35, a single cycle of scanning of a document and the formation of latent images of the document on the photosensitive drum 306 is complete. Subsequently to step L35 or when the answer for the step L32 is given in the negative, the microprocessor 702 proceeds to step L36 shown in FIG. 33E.

At this step L36 is checked if there is a scanner return signal $S_{SR}$ requiring the scanner units 324/326 and 328/330 to return to their respective home positions. If the answer for this step L36 is given in the affirmative, it is further checked at step L37 if the multi-copying operation, viz., a cycle of operation for producing a plurality of printed outputs from a single or each document is complete. If it is determined at this step L37 that the multi-copying operation is complete, it is checked at step L38 if the front-side copying flag $F_{FC}$ is of logic "1" state. If the answer for this step L38 is given in the affirmative, the microprocessor 702 determines that a specified number of printed outputs each having images printed on the front face thereof have been produced. In this instance, the microprocessor 702 proceeds to step L39 to reset the front-side copying flag $F_{FC}$ to logic "0" state and further to step L40 to set the reverse-side copying flag $F_{RC}$ to logic "1" state.

On the other hand, if it is found at step L38 that the front-side copying flag $F_{FC}$ is not of logic "1" state, then the microprocessor 702 proceeds to step L41 to set the copy start flag $F_{CS}$ to logic "1" state and further to step L42 to check if there is a signal supplied from the exposure position sensor 510. In the presence detected of such a signal, the step L42 is followed by step L43 to generate instructions to stop the motor for the developing unit 314*a* or 314*b*, turn off the transfer charger 316 and activates timer TD.

If it is determined at step L36 that there no scanner return signal $S_{SR}$ requiring the scanner units 324/326 and 328/330 to return to their respective home positions, it is checked at step L44 if there is present a document transport complete signal $S_{TE}$ indicating that the transportation of the document scanned is complete. In the presence detected of such a signal $S_{TE}$, the microprocessor 702 proceeds to step L45 to activate the timer TD. If it is determined at step L37 that the multi-copying operation is still incomplete and is in progress, the microprocessor 702 proceeds to step L46 to set the copy start flag $F_{CS}$ to logic "1" state.

Subsequently to the step L40, L43, L45 or L46 or when the answer for the step L42 or L44, the microprocessor 702 proceeds to step L47 to check if the time duration set for the timer TD has elapsed. When the answer for this step L47 is given in the affirmative, the microprocessor 702 proceeds to step L48 to stop the main motor for the photosensitive drum 306 and thereafter to step L49 to output all the signals and instructions which have been generated in the subroutine program A13. Subsequently to step L49, the main microprocessor 702 reverts to the main routine program illustrated in FIG. 22 and proceeds to the subroutine program A14.

Main Routine Program for MPU2

Figure 35:
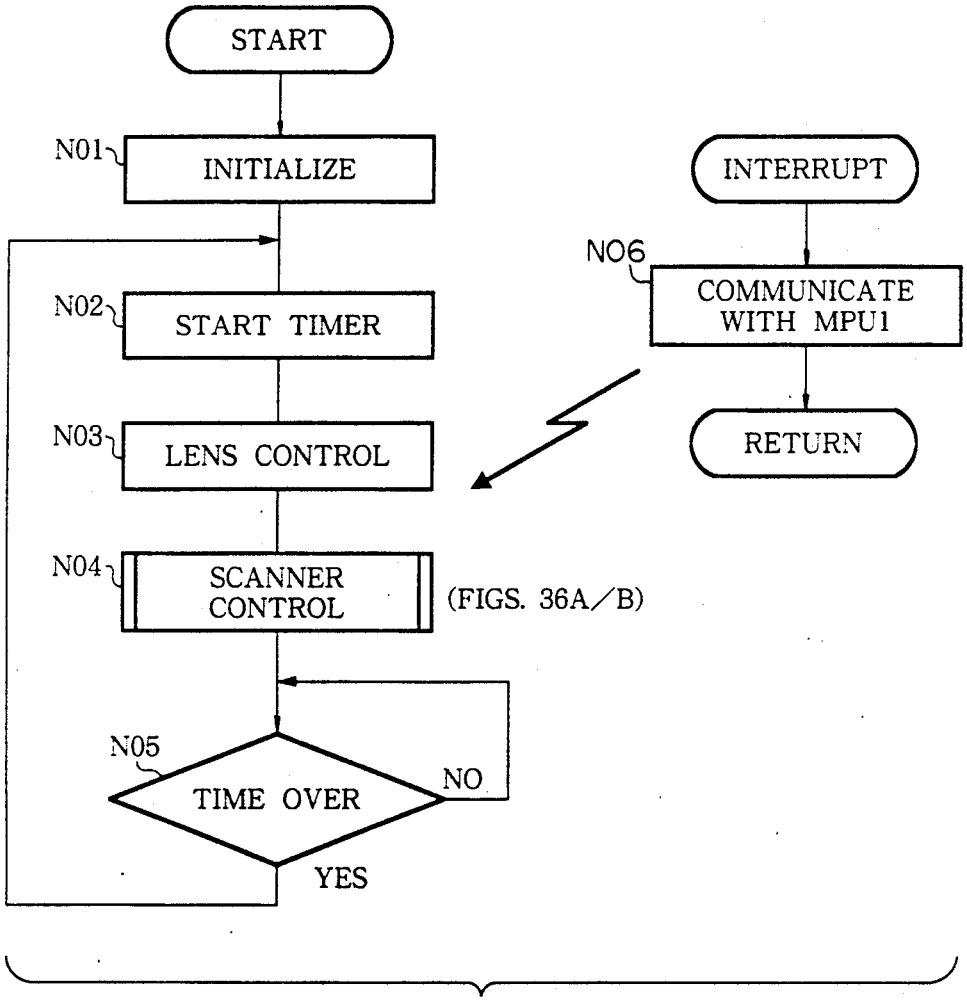
FIG. 35 is a flowchart showing the flow of the main routine program to be executed by a first subsidiary microprocessor forming part of the control circuit illustrated in FIG. 21.

FIG. 35 is a flowchart showing the flow of the main routine program to be executed by the first subsidiary microprocessor 704.

The first subsidiary microprocessor 704 first proceeds to step N01 to initialize all the variable parameters therein to the starting values selected by the default rules. On completion of the initialization of the system, the first subsidiary microprocessor 704 activates the internal timer which is set for a period of time required for the single itineration through the subsequent steps of the main routine program.

Figure 36A:
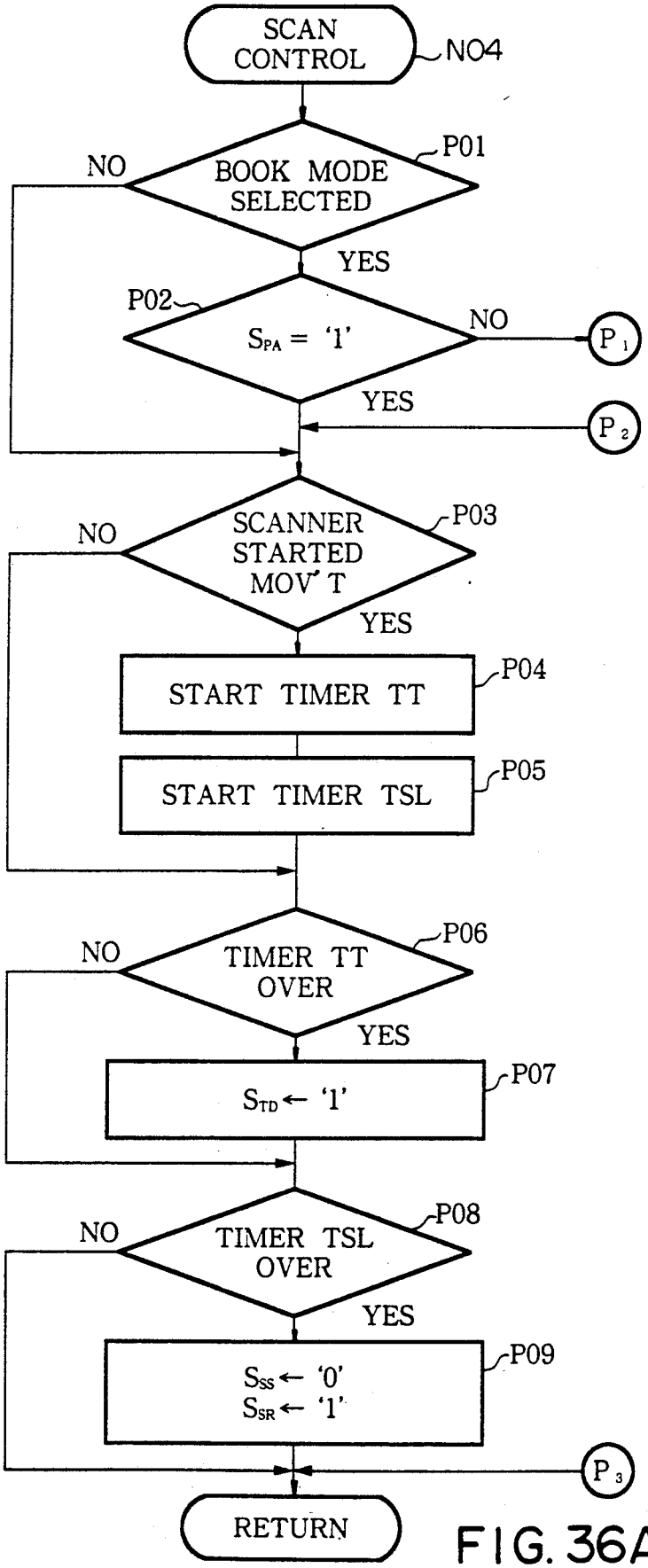
FIG. 36 is a flowchart showing the details of a scanner control subroutine program included in the main routine program illustrated in FIG. 35.
Figure 36B:
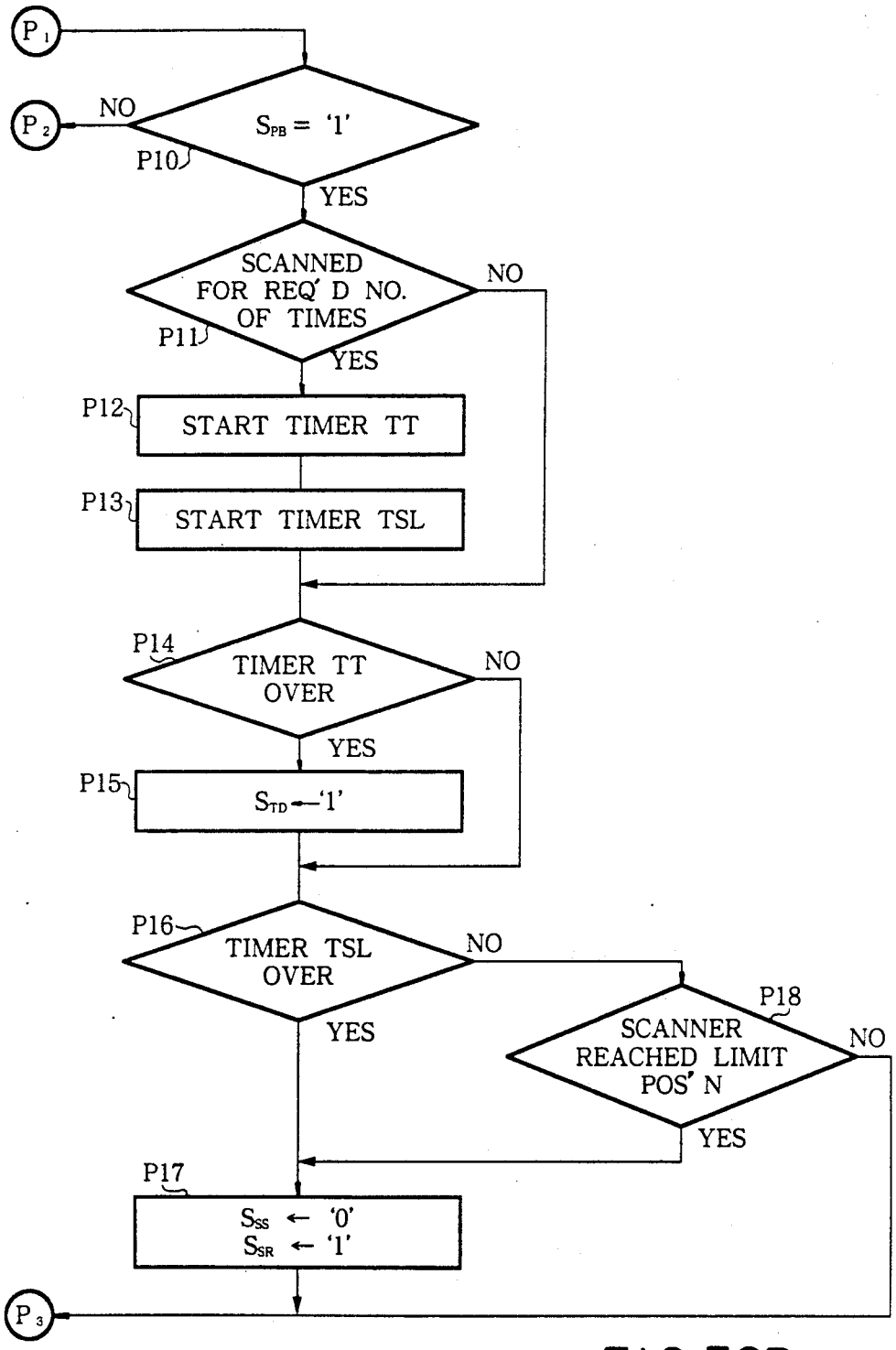

After the internal timer has started time counting operation, the first subsidiary microprocessor 704 proceeds to step N03 to control the movement of the lens unit 332. The step N03 is followed by a scanner control subroutine program N04 to control the operation of the scanner units 324/326 and 328/330 of the optical system 322. The details of this scanner control subroutine program N04 will be hereinafter described with reference to FIGS. 36A and 36B. On termination of the subroutine program N04, the microprocessor 704 proceeds to step N05 to check if the period of time set for the internal timer has elapsed. When it is confirmed at step N05 that the period of time set for the timer has elapsed, the microprocessor 704 reverts to step N02 and reiterates the steps N02 and N03 and subroutine program N04.

When there is a request for interrupt from the main microprocessor 702, the first subsidiary microprocessor 704 proceeds to step N06 to communicate with the main microprocessor 702.

Scanner Control Subroutine Program N04

FIG. 36 are flowcharts showing the details of the scanner control subroutine program N04 included in the main routine program hereinbefore described with reference to FIG. 35.

The scanner control subroutine program N04 starts with a step P01 at which the microprocessor 704 checks if the book copying mode is currently selected. As has been noted, the book copying mode is selected either by the key 650 in the first key/indicator area AR1 or by the key 688 in the second key/indicator area AR2 of the control panel 600. When the answer for this step P01 is given in the affirmative, it is further tested at step P02 whether or not there is present a page "A" scan signal $S_{PA}$ requiring the scanning of page "A" of a book-type document having pages "A" and "B". When the answer for this step P02 is given in the affirmative, the microprocessor 704 starts the scan control operation.

Thus, when it is detected at step P03 that the first scanner unit 324/326 is driven to move leftwardly from its home position that that the signal from the home position sensor 401 is turned off, the microprocessor 704 processor proceeds to step P04 to activate a timer TT. The microprocessor 704 further proceeds to step P05 to activate a scan length timer TSL. For this scan length timer is set a time duration corresponding to the scan length multiplied by the selected R/M ratio, wherein the scan length refers to the width of each of the pages forming a book-type document which is opened out on the document support table 304.

When it is thereafter confirmed at step P06 that the time duration set for the timer TT has elapsed, the microprocessor 704 proceeds to step P07 to generate a timing roller drive signal $S_{TD}$. When it is further confirmed at step P08 that the time duration set for the scan length timer TSL has elapsed, the microprocessor 704 proceeds to step P09 to turn off the scan signal $S_{SS}$ and turn on the scanner return signal $S_{SR}$. The microprocessor 704 then reverts to the main routine program hereinbefore described with reference to FIG. 35.

On the other hand, when it is found at step P10 that there is present a page "B" scan signal $S_{PB}$ requiring the scanning of page "B" of the book-type document. When the answer for this step P10 is given in the affirmative, the microprocessor 704 proceeds to step P11 to check if the first scanner unit 324/326 has been driven to move for a period of time determined by the above defined scan length multipled by the selected R/M ratio. Subsequently, the microprocessor 704 executes a series of steps P12 to P17 which are respectively similar to the steps P04 to P09. In this instance, however, if it is found at step P16 that the time duration set for the scan length timer TSL has not yet elapsed, it is checked at step P18 if the scanner unit 324/326 has reached the forward limit position with respect to the document support table 304. Thus, if it is found that the scanner unit 324/326 has reached such a position before the time duration set for the timer TSL has elapsed, the microprocessor 704 proceeds to step P17 to turn off the scan signal $S_{SS}$ and turn on the scanner return signal $S_{SR}$. Subsequently to this step P17 or when the answer for the step P18, the microprocessor 704 reverts to the main routine program hereinbefore described with reference to FIG. 35.

Main Routine Program for MPU3

Figure 37:
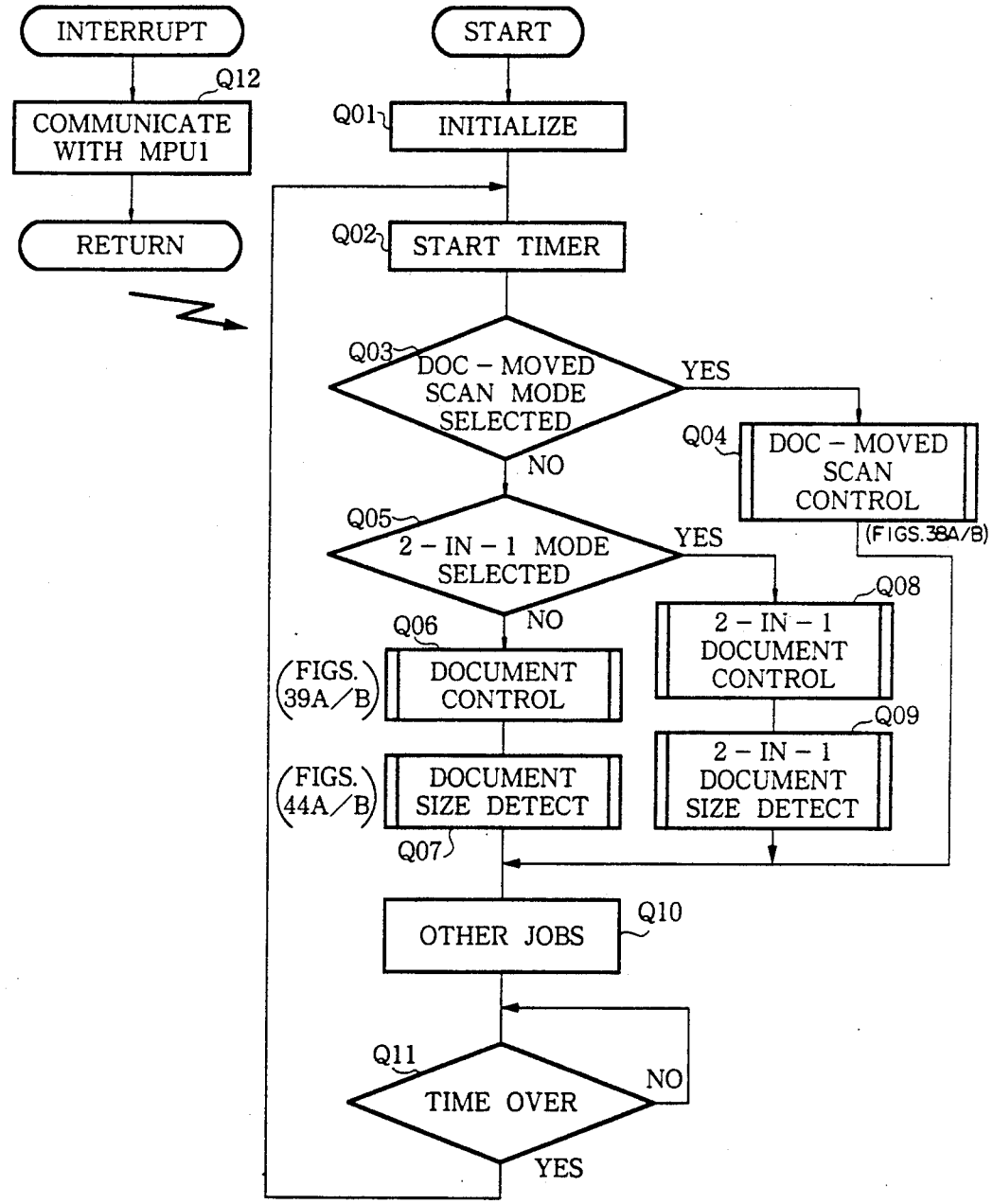
FIG. 37 is a flowchart showing the details of a subroutine program included in the main routine program illustrated in FIG. 14.

FIG. 37 is a flowchart showing the flow of the main routine program to be executed by the second subsidiary microprocessor 706.

The second subsidiary microprocessor 706 first proceeds to step Q1 to initialize all the variable parameters therein to the starting values selected by the default rules. On completion of the initialization of the system, the second subsidiary microprocessor 706 activates the internal timer which is set for a period of time required for the single itineration through the subsequent steps of the main routine program.

After the internal timer has started time counting operation, the first subsidiary microprocessor 70 proceeds to step Q03 to check if the document-moved scanning mode is selected. If it is detected that the document-moved scanning mode is selected, the microprocessor 702 executes a document-moved scanning mode control subroutine program Q04, the details of which will be hereinafter described with reference to FIGS. 38A and 38B.

If the answer for the step Q03 is given in the negative, the step Q05 to check if the two-in-one copying mode is selected. If the answer for this step Q05 is also given in the negative, that is, neither the document-moved scanning mode not the two-in-one copying mode is currently selected, the microprocessor 706 executes document control and document size detect subroutine programs Q06 and Q07. The details of these document control and document size detect subroutine programs Q06 and Q07 will be hereinafter described with reference to FIGS. 39A and 39B and FIGS. 44A and 44B, respectively.

On the other hand, if the answer for the step Q05 is given in the affirmative, that is, it is found that the two-in-one copying is currently selected, the microprocessor 702 executes two-in-one document control and two-in-one document size detect subroutine programs Q08 and Q09. In the two-in-one document control subroutine program Q08, the document feeder unit 302 is controlled to operate in such a manner as to move two documents from the document storage tray 404 and place the documents on the document support table 304 with the trailing edge of the leading document held in abutting contact with the leading edge of the trailing document. In the two-in-one document size detect subroutine program Q09, the size of one of the two documents supplied from the document storage tray 404 is detected while the documents are being transported toward the document support table 304. The detected size of one of the documents is doubled to indicate the overall size of the two-in-one document. Further details of the subroutine programs Q08 and Q09 are rather immaterial to the understanding the gist of the present invention and will not be herein described.

On termination of the subroutine programs Q06 and Q07 or the subroutine programs Q08 and Q09, the microprocessor 706 proceeds to step Q10 to perform other jobs required for the microprocessor 706. The microprocessor 706 then proceeds to step Q11 to check if the period of time set for the internal timer has elapsed. When it is confirmed at step Q11 that the period of time set for the timer has elapsed, the microprocessor 706 reverts to step Q02 and reiterates the steps and subroutine programs Q02 to Q11.

When there is a request for interrupt from the main microprocessor 702, the second subsidiary microprocessor 706 proceeds to step Q12 to communicate with the main microprocessor 702.

Document-Moved Scan Control Subroutine Program Q04

Figure 38A:
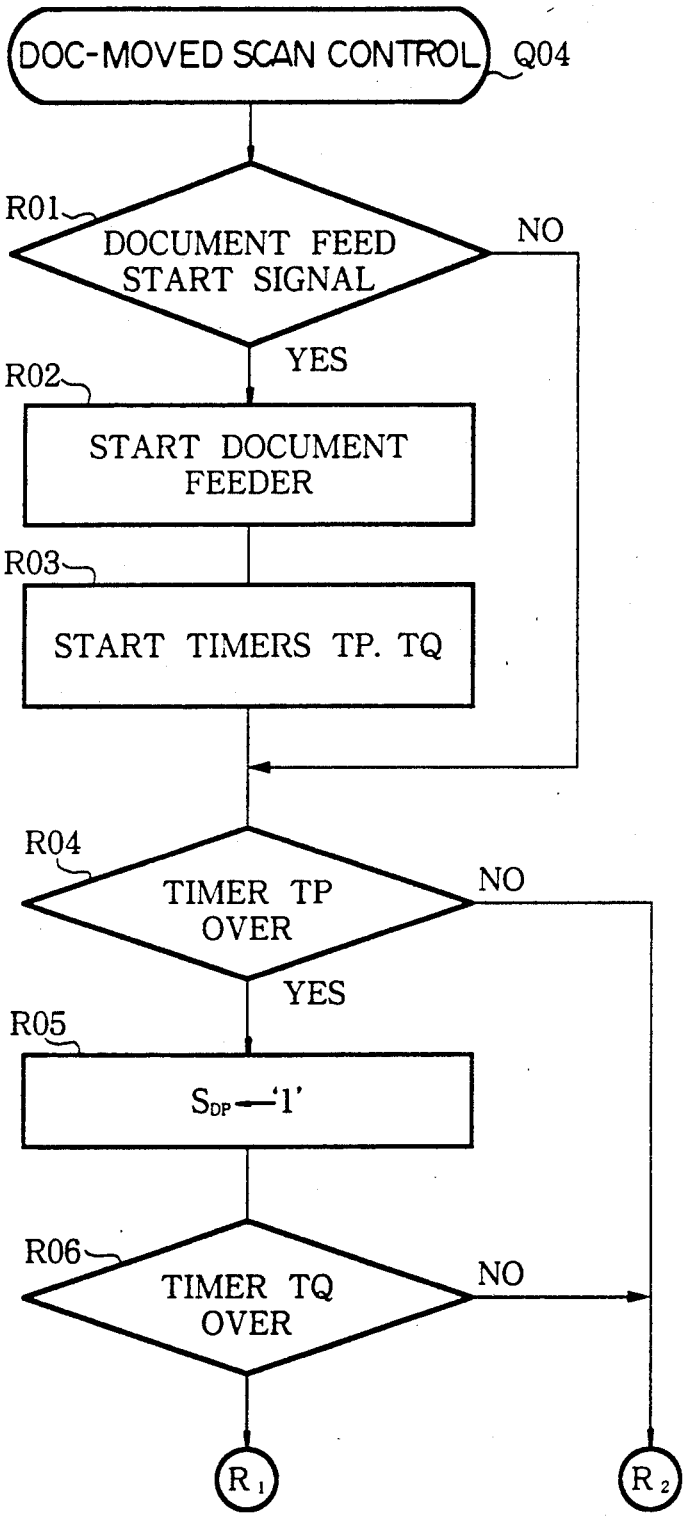
FIGS. 38A and 38B are flowcharts showing the details of a document-moved scan control subroutine program included in the main routine program illustrated in FIG. 37.
Figure 38B:
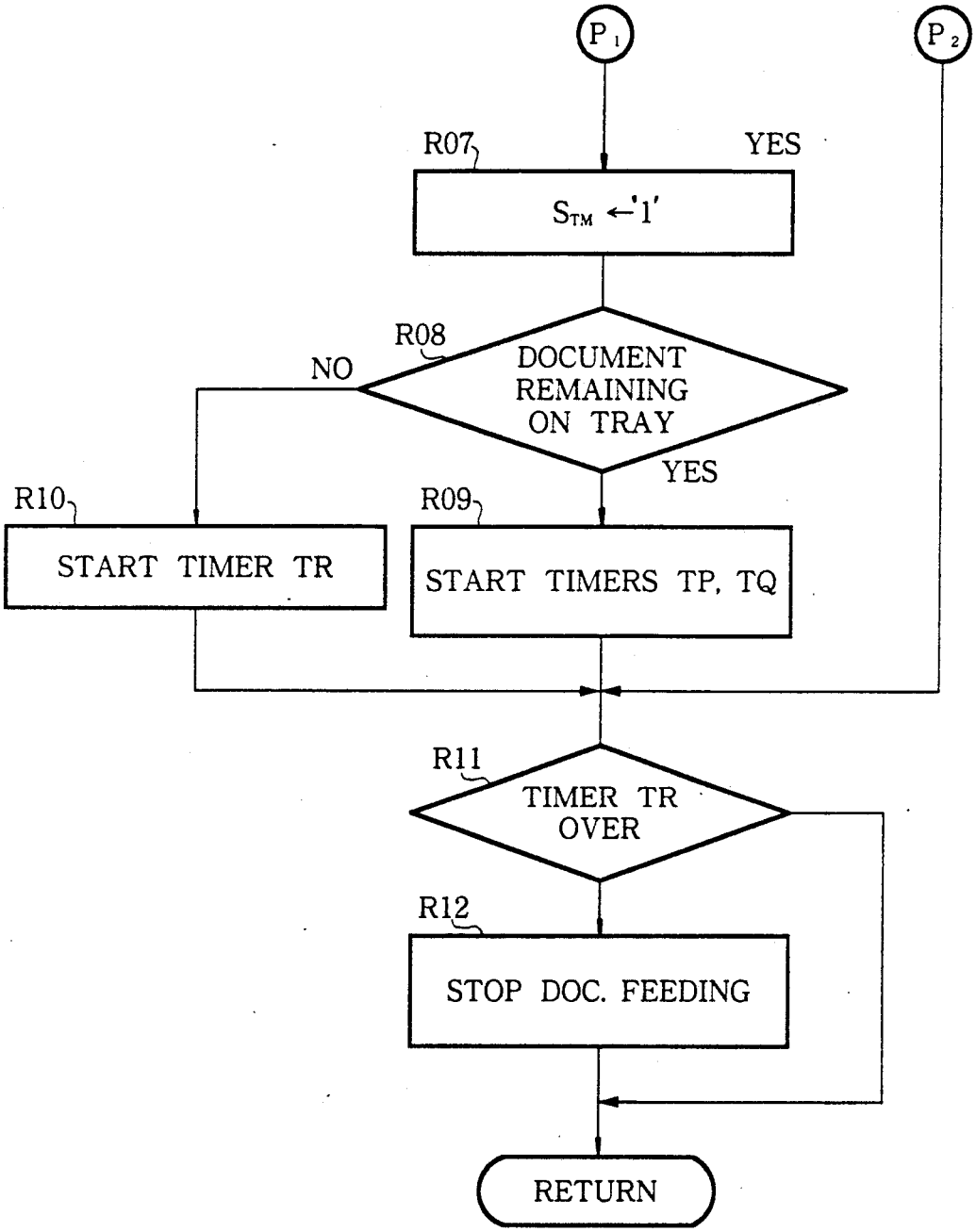

FIGS. 38A and 38B are flowcharts showing the details of the document-moved scan control subroutine program Q04 included in the main routine program hereinbefore described with reference to FIG. 37.

In this document-moved scan control subroutine program Q04, the microprocessor 706 first proceeds to step R01 to check if there is present a signal to start the feeding of a document in the document feeder unit 302. In the presence detected of such a signal, the microprocessor 706 proceeds to step R02 to generate an instruction to actuate the document feeder unit 302 into operation and further to step R03 to activate the timers TP and TQ. When it is thereafter confirmed at step R04 that the time duration set for the timer TP has elapsed, the microprocessor 706 proceeds to step R05 to generate a signal $S_{DP}$ to move the document to the predetermined exposure position on the document support table 304. When it is further confirmed at step R06 that the time duration set for the timer TQ has elapsed, the microprocessor 706 proceeds to step R07 to generate a timing signal $S_{TM}$.

Subsequently to the step R07, the microprocessor 706 proceeds to step R08 to check if there is a document remaining on the document storage tray 404. This decision is made on the basis of a signal which may be supplied from the document empty sensor 508 provided in the document feeder unit 302. If the answer for this step R08 is given in the affirmative, the microprocessor 706 proceeds to step R09 to activate the times TP and TQ for a second time to continue the feeding of a document. On the other hand, if it is found at step R08 that there is no document remaining on the document storage tray 404, that is, all the documents initially placed on the tray 404 have been supplied therefrom, then the step R08 is followed by step R10 to activate the timer TR. For this timer TR is set a time duration until the last document is withdrawn from the document storage tray 404.

Subsequently to step R09 or step R10 or if it is found at step R04 or step R06 that the time duration set for the timer TP or the timer TQ has not yet elapsed, the microprocessor 706 proceeds to step R11 to check if the time duration set for the timer TR has elapsed. When it is confirmed that such a time duration has elapsed, the microprocessor 706 proceeds to step R12 to generate an instruction to bring an end to the feeding of document and a signal indicating that the feeding of document is terminated.

The microprocessor 706 then reverts to the main routine program illustrated in FIG. 37 and proceeds to the subroutine program Q07.

Document Control Subroutine Program Q06

Figure 39A:
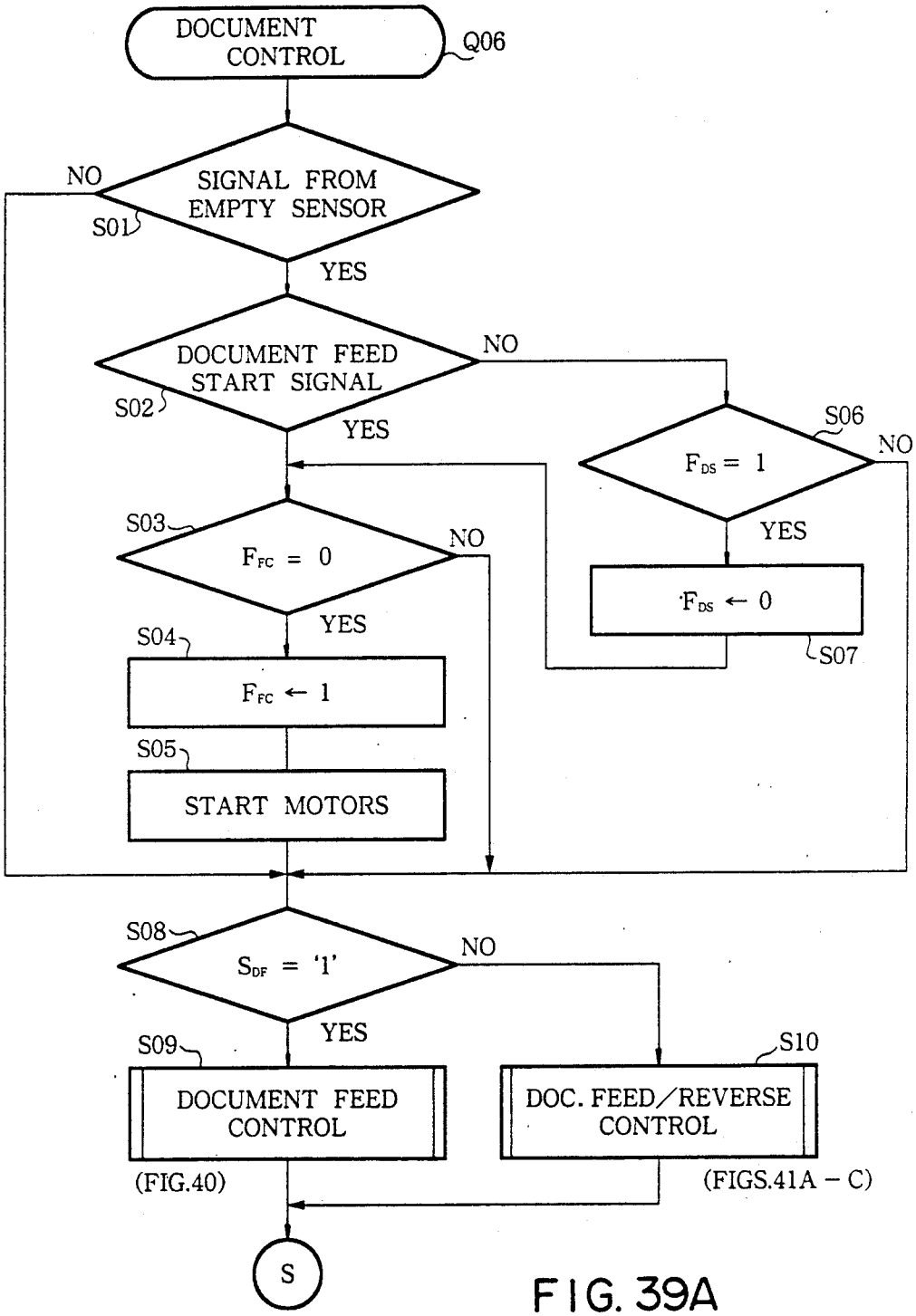
FIGS. 39A and 39B are flowcharts showing the details of a document control subroutine program included in the main routine program illustrated in FIG. 37.
Figure 39B:
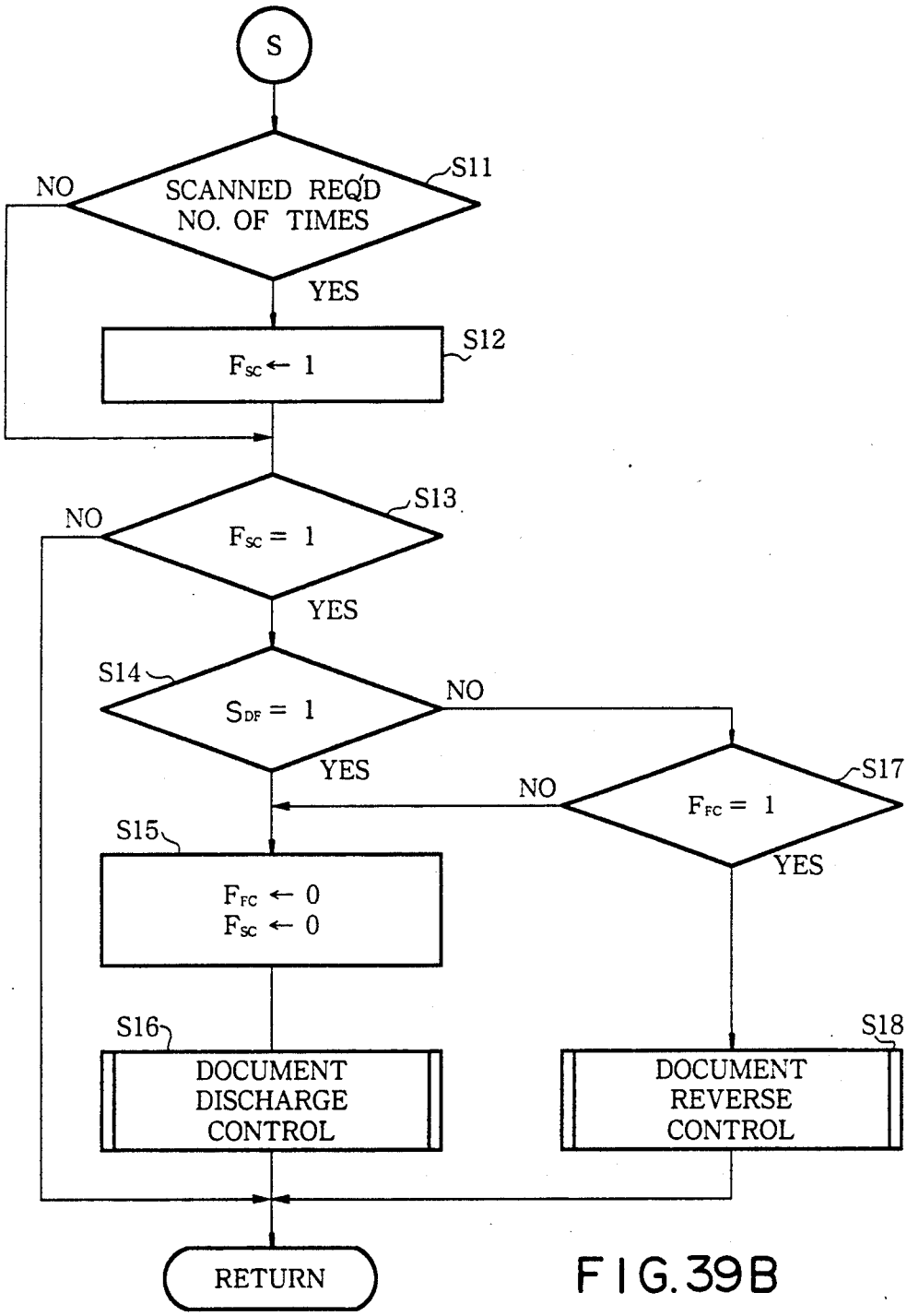

FIGS. 39A and 39B are flowcharts showing the details of the document control subroutine program Q06 included in the main routine program hereinbefore described with reference to FIG. 37.

In this document control subroutine program Q06, the microprocessor 706 first proceeds to step S01 to check if there is present a signal supplied from the document empty sensor 508 in the absence of a document remaining on the document storage tray 404. If the answer for this step S01 is given in the affirmative, the microprocessor 706 further checks at step S02 if there is present a signal to start the feeding of a document in the document feeder unit 302. In the presence detected of such a signal, the microprocessor 706 proceeds to step S03 to check if the front-side copying flag $F_{FC}$ is of logic "0" state. If it is found that this is the case, the microprocessor 706 proceeds to step S04 to set the front-side copying flag $F_{FC}$ to logic "1" state and further to step S05 to actuate the motors for the various driven units and members provided in the document feeder unit 302 to transport a document from the document storage tray 404 back to the tray 404. Such driven units and members include the pickup roller 412, transfer roller pair 416, feed roller pair 442, pinch roller pair 444, return roller 460, discharge roller pair 478 and the drive roller forming part of the belt assembly 446. It may be noted that these rollers are in this instance driven for rotation each in a forward direction.

On the other hand, if it is found at step S02 that there is no signal supplied from the document empty sensor 508, the microprocessor 706 proceeds to step S06 to check if a document supply flag $F_{DS}$ is of logic "1" state. If the answer for this step S06 is given in the affirmative, the microprocessor 706 determines that the document has already been withdrawn from the document storage tray 404 and thus proceeds to step S07 to reset the document supply flag $F_{DS}$ to logic "0" state. This step S07 is followed by the steps S03 et seq.

Subsequently to the step S05 or when the answer for the step S01, S03 or S06, the microprocessor 706 proceeds to step S08 to check if a double-faced document signal $S_{DF}$ is supplied from the second key/indicator area AR2 of the control panel 600. In the presence detected of such a signal, the microprocessor 706 executes a document feed control subroutine program S09 and, in the absence detected of the signal $S_{DF}$, the microprocessor 706 executes a document feed/reverse control subroutine program S10. On termination of the execution of the document feed control subroutine program S09 or the document feed/reverse control subroutine program S10, the microprocessor 706 proceeds to step S11 shown in FIG. 39B. The details of the document feed control subroutine program S09 will be hereinafter described with reference to FIG. 40 and the details of the document feed/reverse control subroutine program S09 will be hereinafter described with reference to FIGS. 41A to 41C.

At this step S11 is tested whether or not the document has been scanned a number of times corresponding to the required quantity of printed outputs to be produced. At a point of time the answer for this step S11 is given in the affirmative, the microprocessor 706 proceeds to step S12 to set a scan complete flag $F_{SC}$ to logic "1" state. The microprocessor 706 then proceeds to step S13 to check if the scan complete flag $F_{SC}$ is of logic "1" stat and, if the answer is given in the affirmative further proceeds to step S14 to check if the double-faced document signal $S_{DF}$ is supplied from the second key/indicator area AR2 of the control panel 600. In the presence detected of such a signal, the microprocessor 706 proceeds to step S15 to reset each of the front-side copying flag $F_{FC}$ and scan complete flag $F_{SC}$ to logic "0" state and thereafter executes a document discharge subroutine program S16. The details of this document discharge control subroutine program S16 will be hereinafter described with reference to FIG. 42.

On the other hand, if it is determined at step S14 that the double-faced document signal $S_{DF}$ is absent, the microprocessor 706 proceeds to step S17 to check if the front-side copying flag $F_{FC}$ is of logic "1" state. If it is found that this is the case, the microprocessor 706 executes a document reverse control subroutine program S18. The details of this document reverse control subroutine program S18 will be hereinafter described with reference to FIGS. 43A and 43B. If it is found at step S17 that the front-side copying flag $F_{FC}$ is not of logic "1" state, the step S17 is followed by the step S15 and subroutine program S16.

On termination of the execution of the document discharge control subroutine program S16 or the document reverse control subroutine program S18, the microprocessor 706 reverts to the main routine program illustrated in FIG. 37.

Document Feed Control Subroutine Program S09

Figure 40:
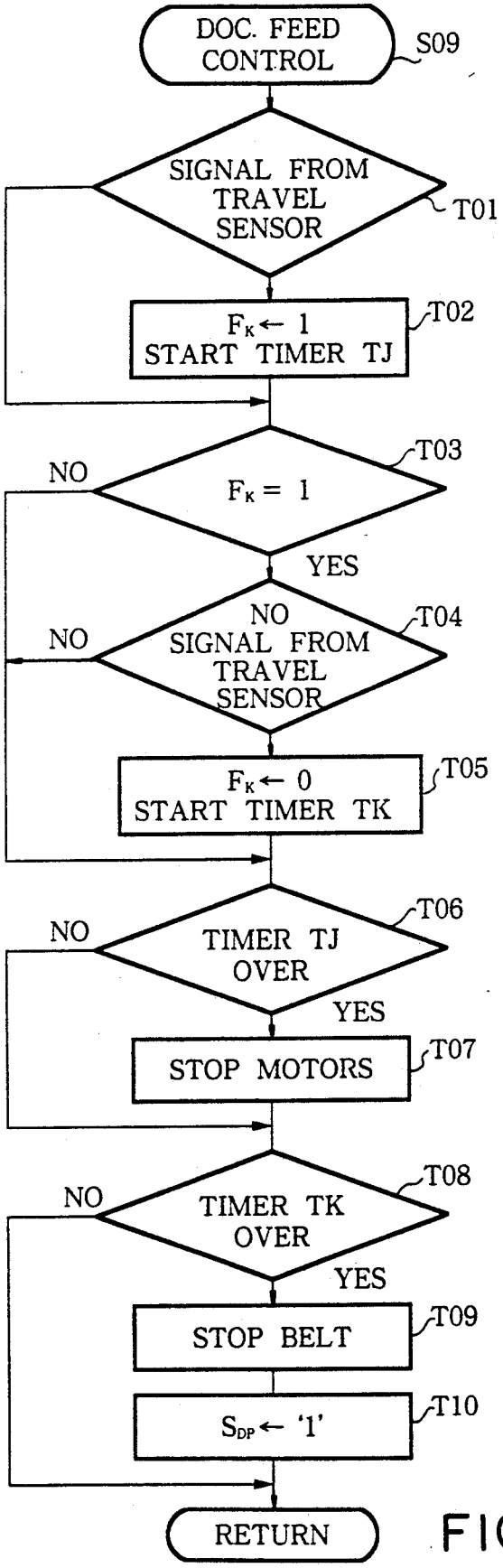
FIG. 40 is a flowchart showing the details of a document feed control subroutine program included in the document control subroutine program illustrated in FIGS. 39A and 39B.

FIG. 40 is a flowchart showing the details of the document feed control subroutine program S09 included in the document control subroutine program Q06 hereinbefore described with reference to FIGS. 39A and 39B.

In this document feed control subroutine program S09, the microprocessor 706 first proceeds to step T01 to check if there is a signal supplied from the document travel sensor 506 responsive to the leading edge of the document supplied through the supply-side turning path portion 436 in the document feeder unit 302. In the presence detected of such a signal, the microprocessor 706 proceeds to step T02 to set a flag $F_K$ to logic "1" state and activate a timer TJ. For this timer TJ is set a time duration until the feeding of a document is to be terminated.

Subsequently to step T02 or when it is found at step T01 that there is no signal supplied from the document travel sensor 506, the microprocessor 706 proceeds to step T03 to check if the flag $F_K$ is of logic "1" state. When the answer for this step T03 is given in the affirmative, the microprocessor 706 proceeds to step T04 to check if the signal from the travel sensor 506 has turned off. If the answer for this step T04 is also given in the affirmative, the step T04 is followed by step T05 to reset a flag $F_K$ to logic "0" state and activate a timer TK. For this timer TK is set a time duration until the document is correctly positioned on the document support table 304 immediately ahead of the scale member 456.

Subsequently to step T05 or when the answer for step T03 or step T04 is given in the negative, the microprocessor 706 proceeds to step T06 to check if the time duration set for the timer TJ has elapsed. At a point of time the answer for this step T06 is turned affirmative, the microprocessor 706 proceeds to step T07 to turn off the drive motor for the active units and members to supply documents from the document storage tray 404. When it is thereafter confirmed at step T08 that the time duration set for the timer TK has elapsed, the microprocessor 706 proceeds to step T09 to turn off the drive motor for the belt assembly 446 to have the document correctly positioned on the document support table 304 immediately ahead of the scale member 456. The microprocessor 706 thereafter proceeds to step T10 to generate the signal $S_{DP}$ to move the document to the predetermined exposure position on the document support table 304.

Subsequently to step T10 or when it is found at step T08 that the timer TK is still in operation, the microprocessor 706 reverts to the main routine program illustrated in FIGS. 39A and 39B.

Document Feed/Reverse Control Subroutine Program S10

Figure 41A:
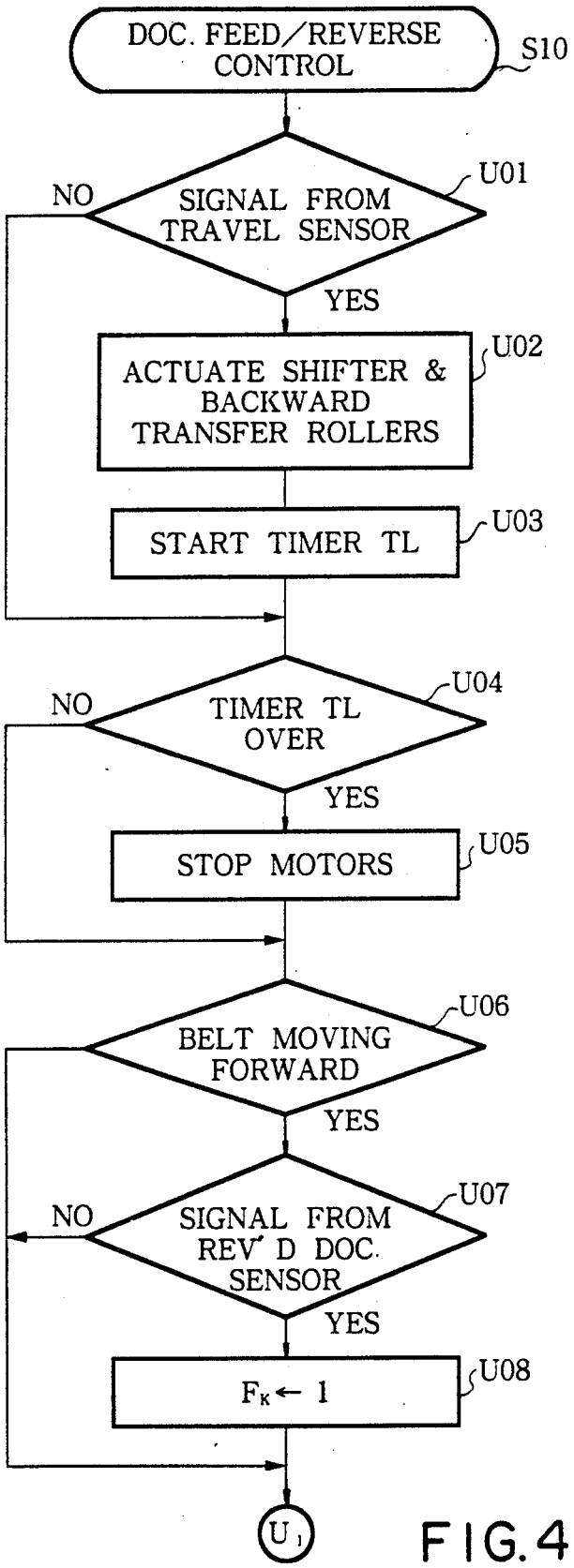
FIGS. 41A, 41B and 41C are flowcharts showing the details of a document feed/reverse control subroutine program also included in the document control subroutine program illustrated in FIGS. 39A and 39B.
Figure 41B:
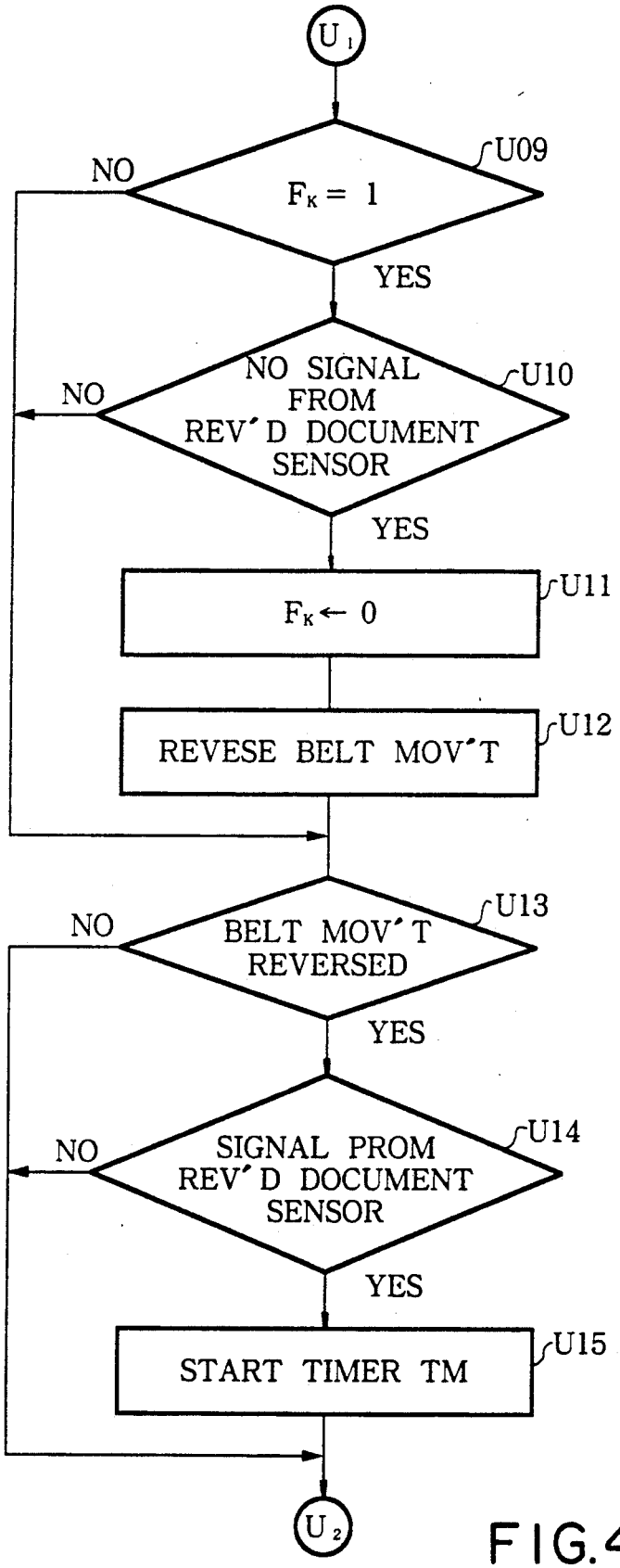
Figure 41C:
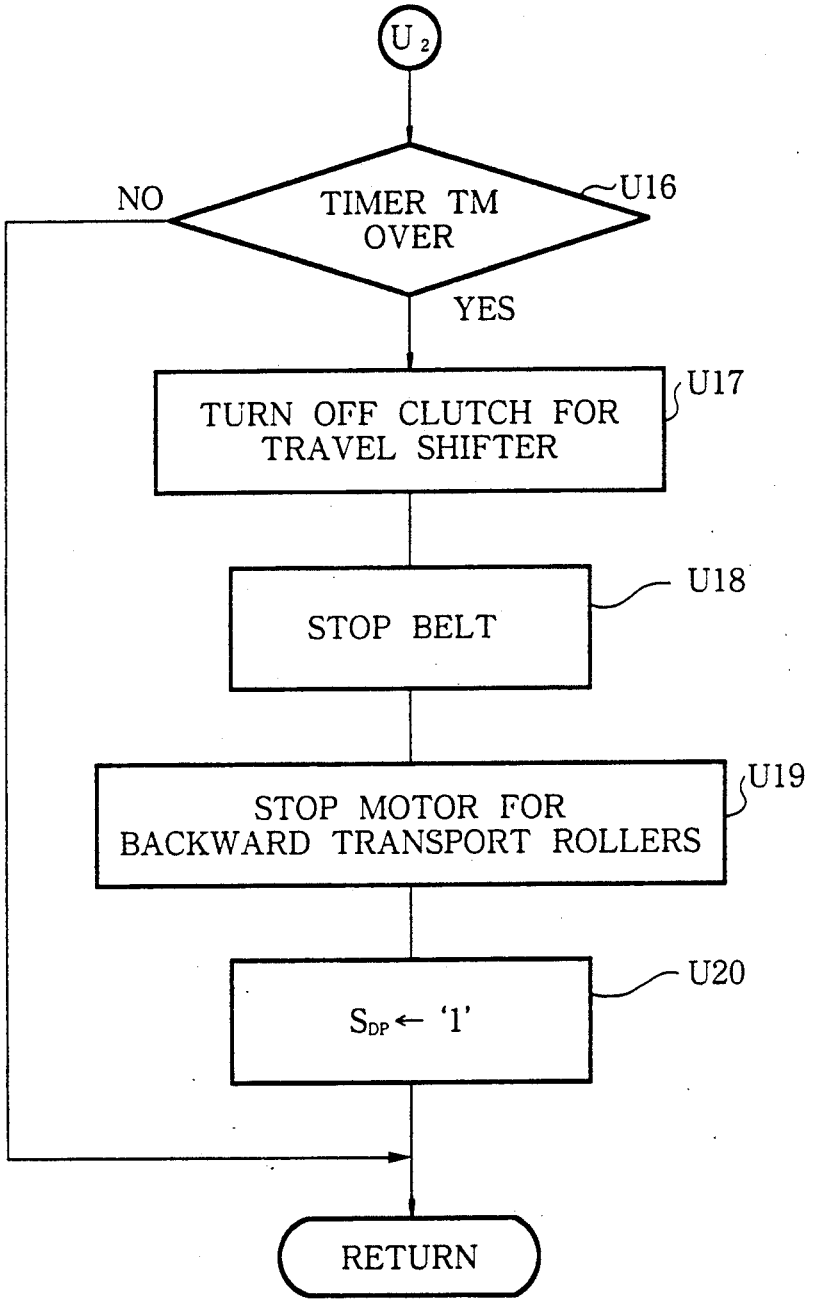

FIGS. 41A, 41B and 41C are flowcharts showing the details of the document feed/reverse control subroutine program S10 also included in the document control subroutine program hereinbefore described with reference to FIGS. 39A and 39B.

In this document feed/reverse control subroutine program S10, the microprocessor 706 first proceeds to step U01 to check if there is a signal supplied from the document travel sensor 506. In the presence detected of such a signal, the microprocessor 706 proceeds to step U02 to actuate the clutch for the travel shifter 494 provided in association with the return-side turning path portion 440 in the document feeder unit 302. The travel shifter 494 is thus driven to turn to the second angular position selecting the backward document guide passageway 490. At step U02 is further actuated the motor for the backward transport roller pair 492. The microprocessor 706 then proceeds to step U03 to activate a timer TL.

When it is thereafter confirmed that the time duration set for the timer TL has lapsed, the microprocessor 706 proceeds to step U05 to turn off the motors for the active unit and members to stop the feeding of documents document from the document storage tray 404. The microprocessor 706 then checks at step U06 if the belt 448 of the belt assembly 446 is forwardly (or rightwardly in the drawing) moving on the document support table 304 and, if it is found that this is the case, further checks at step U07 if there is a signal supplied from the sensor 512 responsive to the trailing edge of a document being transferred from the return-side turning path portion 440 to the backward guide passageway 490. When the answer for the step U07 is given in the affirmative, the step U07 is followed by step U08 to set the flag $F_K$ to logic "1" state.

When it is then confirmed at step U09 that the flag $F_K$ is of logic "1" state, the microprocessor 706 proceeds to step U10 to check if the signal from the reversed document sensor 512 has turned out. If the answer for this step U10 is given in the affirmative, the microprocessor 706 proceeds to step U11 to reset the flag $F_K$ to logic "0" state and thereafter to step U12 to generate an instruction to reverse the direction of movement of the belt assembly 446.

Thereafter, the microprocessor 706 proceeds to step U13 to check if the direction of movement of the belt assembly 446 has been reversed and further to step U14 to see if there is a signal supplied from the reversed document sensor 512 responsive to the leading edge of the document being passed through the backward document guide passageway 490. If the answer for each of these steps U13 and U14 is given in the affirmative, the microprocessor 706 proceeds to step U15 to activate a timer TM. When it is thereafter confirmed at step U16 that the time duration set for the timer TM has elapsed, the microprocessor 706 proceeds to a series of steps U17, U18, U19 and U20 to turn off the clutch for the travel shifter 494, stop the operation of the belt assembly 446, and generate the signal $S_{DP}$ to move the document to the predetermined exposure position on the document support table 304. After the document is thus reversed and the reversed document is placed on the document storage tray 404, the microprocessor 706 then reverts to the main routine program illustrated in FIGS. 39A and 39B.

If desired, the document reversed may be transported past the scale member 456 and by way of the return-side turning path portion 440 with the belt 448 of the belt assembly 446 driven to travel forwardly (or rightwardly) on the document support table 304.

Document Discharge Control Subroutine Program S16

Figure 42:
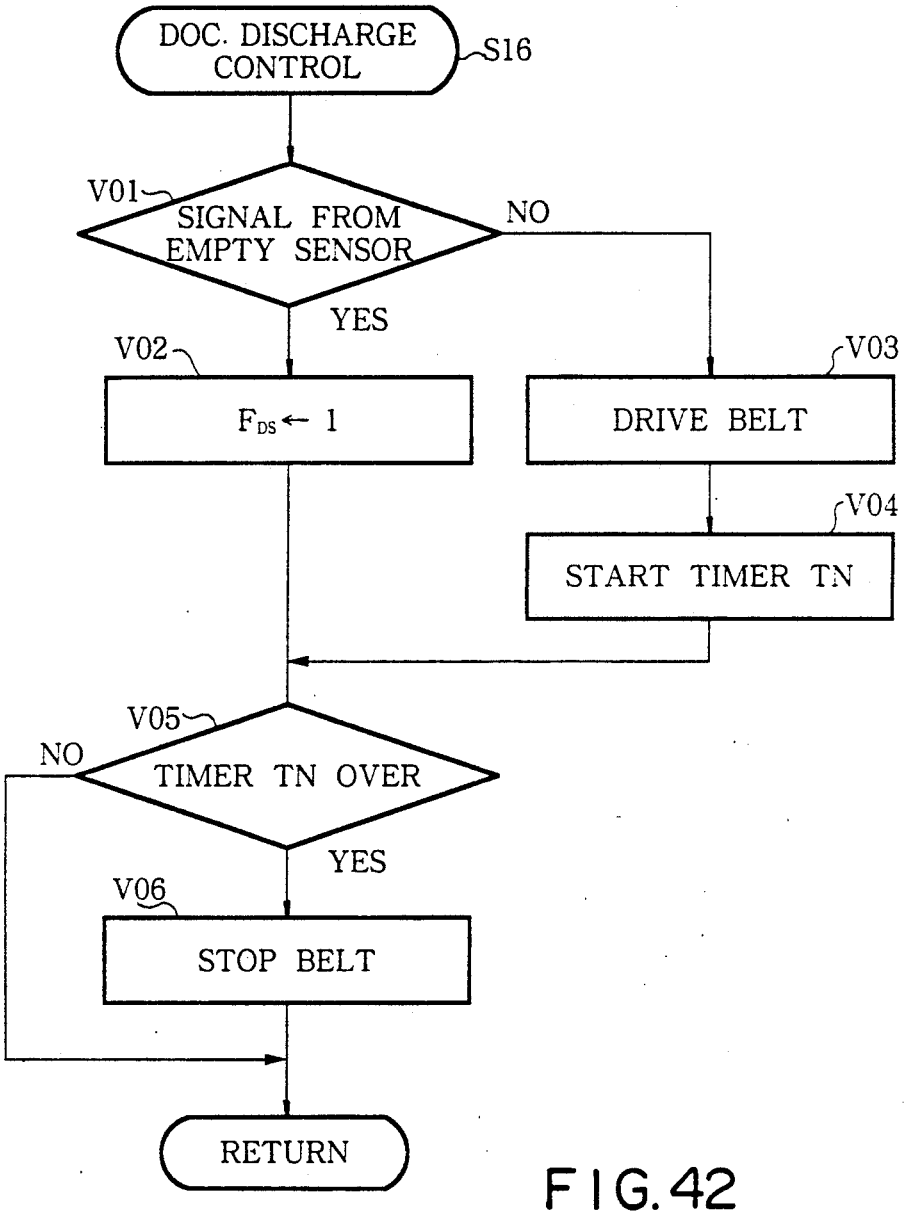
FIG. 42 is a flowchart showing the details of a document discharge control subroutine program also included in the document control subroutine program illustrated in FIGS. the document control subroutine program illustrated in FIGS. 39A and 39B.

FIG. 42 is a flowchart showing the details of the document discharge control subroutine program S16 also included in the document control subroutine program Q06 hereinbefore described with reference to FIGS. 39A and 39B.

In this document discharge control subroutine program S16, the microprocessor 706 first proceeds to step V01 to check if there is a signal received from the document empty sensor 508. In the presence detected of such a signal, the microprocessor 706 proceeds to step V02 to set the document supply flag $F_{DS}$ to logic "1" state so as to enable the subsequent document to be supplied from the document storage tray 404.

If it is found at step V01 that there is no signal received from the document empty sensor 506, then the microprocessor 706 determines that there is no document stored on the document storage tray 404 and as such proceeds to step V03 to actuate the motor for the belt assembly 446. The belt 448 of the belt assembly 446 is thus driven to travel forwardly (or rightwardly in the drawing) on the document support table 304 so that the document on the document support table 304 is withdrawn therefrom. The step V03 is followed by step V04 at which a timer TN is activated to start time counting operation.

Subsequently to the step V02 or to the step V04, the microprocessor 706 proceeds to step V05 to check if the time duration set for the timer TN has elapsed. When the answer for the step V05 is turned affirmative, the microprocessor 706 determines that the document has been completely withdrawn from the document support table 304 and, thus, proceeds to step V06 to bring the belt assembly 446 to a stop. The microprocessor 706 then reverts to the main routine program illustrated in FIGS. 39A and 39B.

Document Reverse Control Subroutine Program S18

Figure 43A:
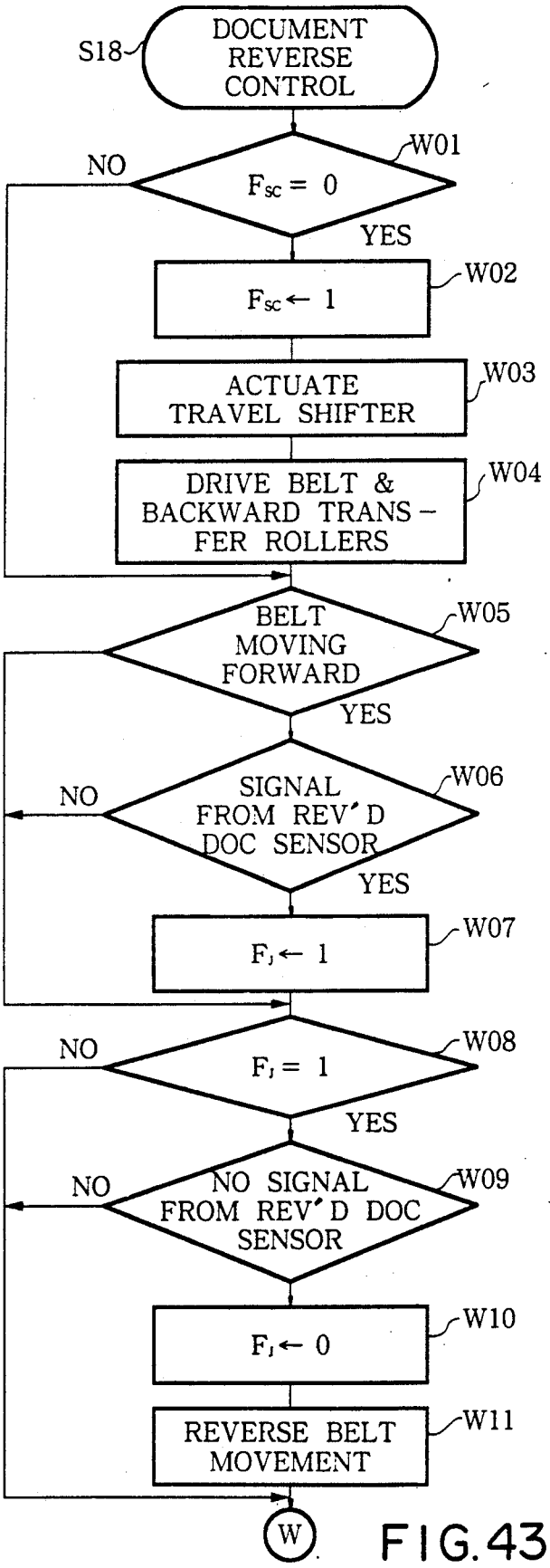
FIGS. 43A and 43B are flowchart showing the details of a document reverse control subroutine program further included in the document control subroutine program illustrated in FIGS. 39A and 39B.
Figure 43B:
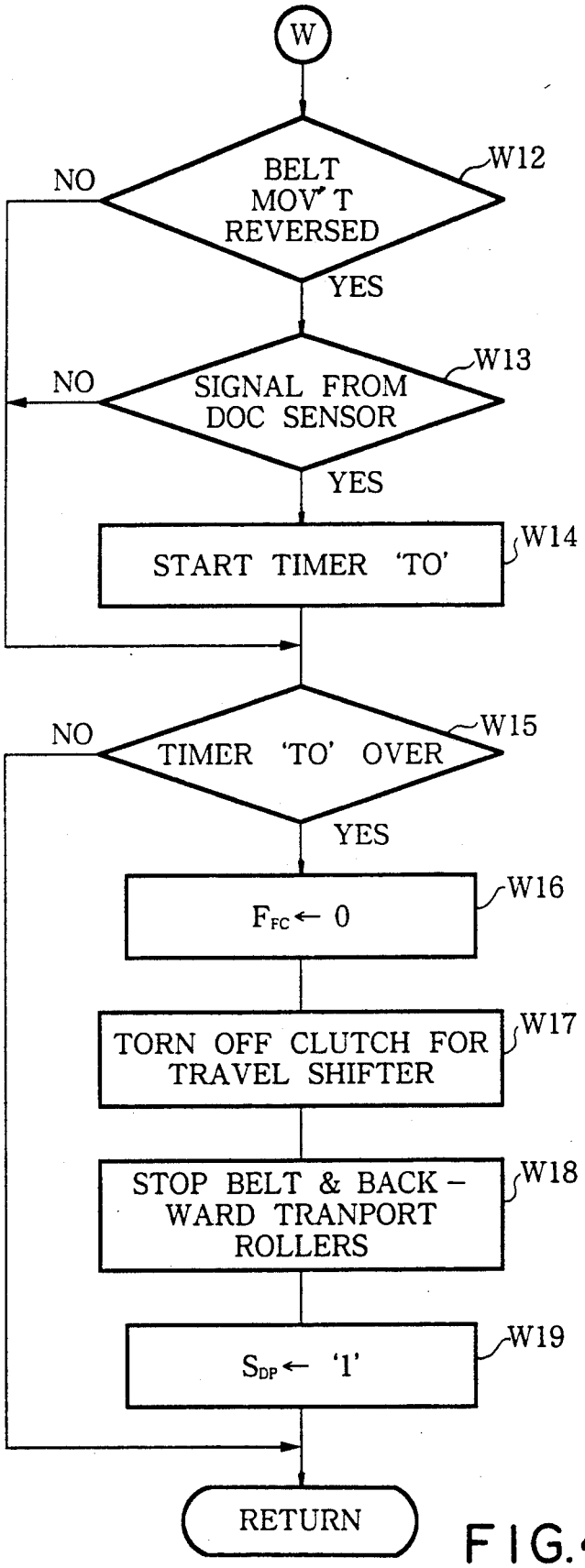

FIGS. 43A and 43B are flowchart showing the details of the document reverse control subroutine program S18 further included in the document control subroutine program Q06 hereinbefore described with reference to FIGS. 39A and 39B.

In this document reverse control subroutine program S18, the microprocessor 706 first proceeds to step W01 to check if the scan complete flag $F_{SC}$ is of logic "1" state. If the answer for this step W01 is given in the affirmative, the microprocessor 706 proceeds to step W02 to reset the flag $F_{SC}$ to logic "0" state and further to step W03 to actuate the clutch for the travel shifter 494. The travel shifter 494 is thus driven to turn to the second angular position selecting the backward document guide passageway 490. The microprocessor 706 then proceeds to step W04 to actuate the motors for the backward transport roller pair 492 and the belt assembly 446 so that the belt 448 travels forwardly (or rightwardly) on the document support table 304.

The microprocessor 706 then checks at step W05 if the belt 448 of the belt assembly 446 is forwardly (or rightwardly in the drawing) moving on the document support table 304 and, if it is found that this is the case, further checks at step W06 if there is a signal supplied from the sensor 512 responsive to the trailing edge of a document being transferred from the return-side turning path portion 440 to the backward guide passageway 490. When the answer for the step W06 is given in the affirmative, the step W06 is followed by step W07 to set the flag $F_J$ to logic "1" state.

When it is then confirmed at step W08 that the flag $F_J$ is of logic "1" state, the microprocessor 706 proceeds to step W09 to check if the signal from the reversed document sensor 512 has turned out. If the answer for this step W09 is given in the affirmative, the microprocessor 706 proceeds to step W10 to reset the flag $F_J$ to logic "0" state and thereafter to step W11 to generate an instruction to reverse the direction of movement of the belt assembly 446.

Thereafter, the microprocessor 706 proceeds to step W12 to check if the direction of movement of the belt assembly 446 has been reversed and further to step W13 to see if there is a signal supplied from the reversed document sensor 512 responsive to the leading edge of the document being passed through the backward document guide passageway 490. If the answer for each of these steps W12 and W13 is given in the affirmative, the microprocessor 706 proceeds to step W15 to activate a timer "TO". When it is thereafter confirmed at step W15 that the time duration set for the timer "TO" has elapsed, the microprocessor 706 proceeds to a series of steps W16, W17, W18 and W19 to reset the frontside copying flag $F_{FC}$ to logic "0" state, turn off the clutch for the travel shifter 494, stop the operation of the belt assembly 446, and generate the signal $S_{DP}$ to move the document to the predetermined exposure position on the document support table 304. After the document is thus reversed and the reversed document is placed on the document storage tray 404, the microprocessor 706 then reverts to the main routine program illustrated in FIGS. 39A and 39B.

Document Size Detect Subroutine Program Q07

Figure 44A:
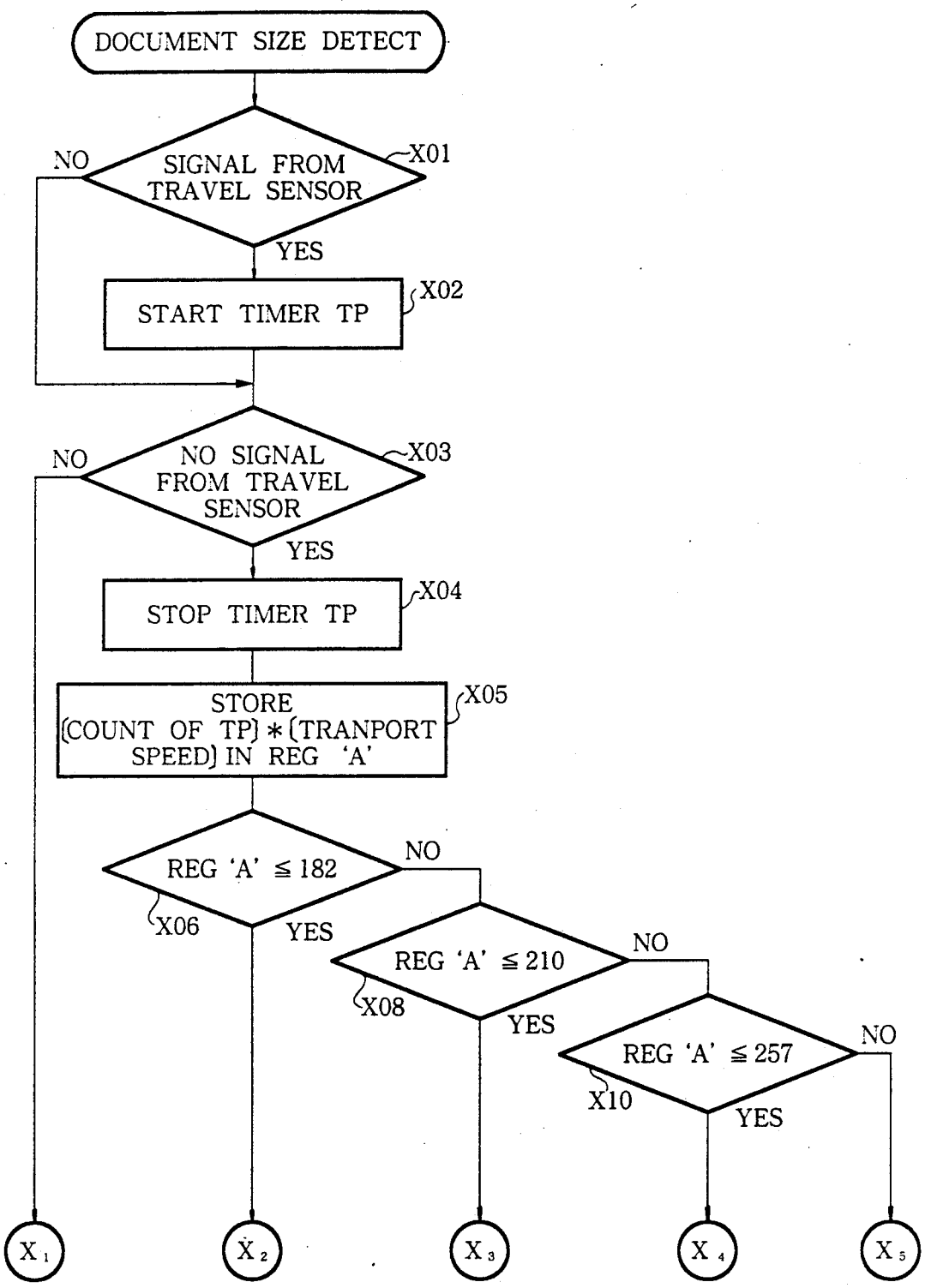
FIGS. 44A and 44B are flowcharts showing the details of a document size detect subroutine program included in the main routine program illustrated in FIG. 37.
Figure 44B:
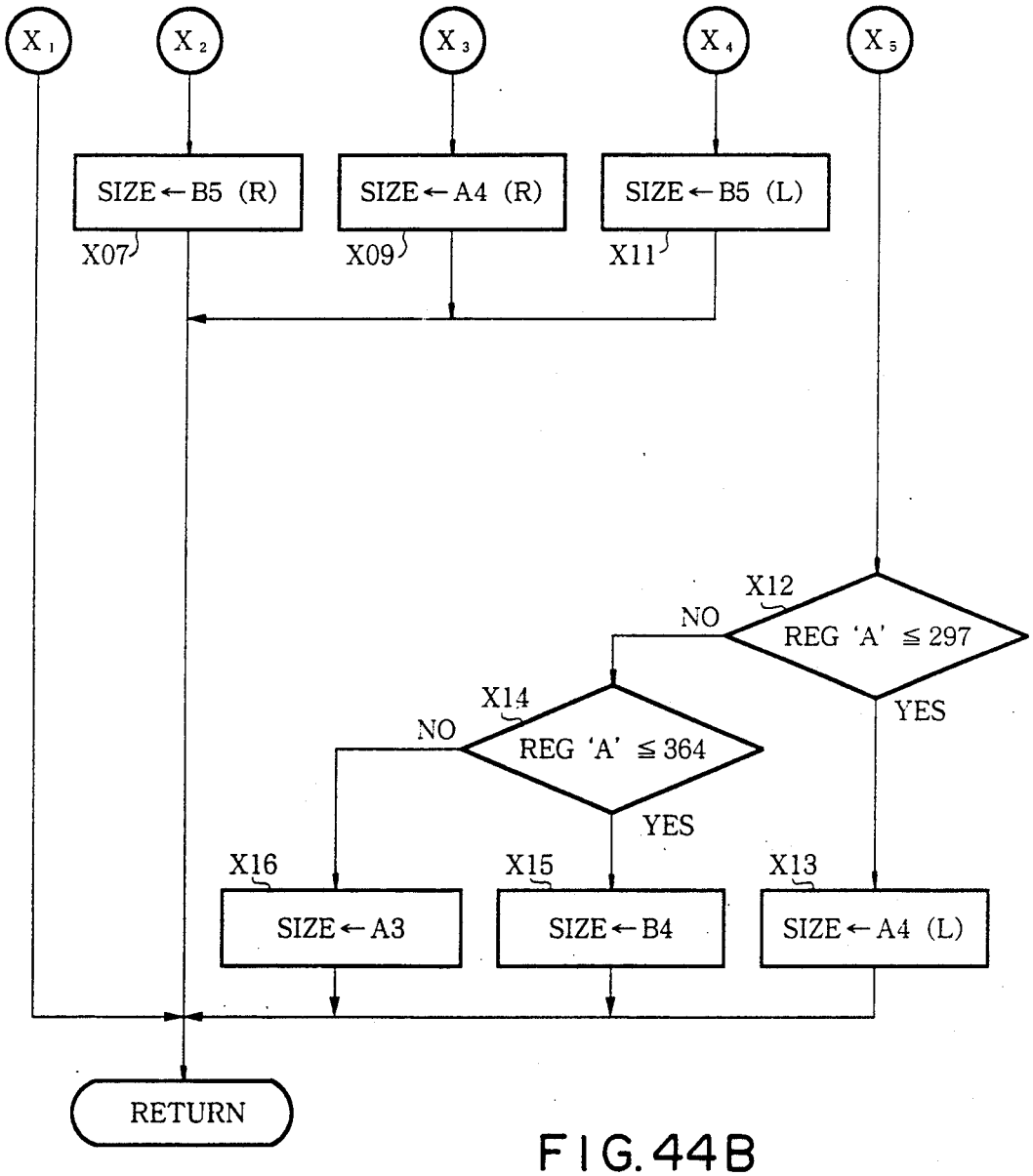

FIGS. 44A and 44B are flowcharts showing the details of the document size detect subroutine program Q07 included in the main routine program hereinbefore described with reference to FIG. 37.

In this document size detect subroutine program Q07, the size of a document is detected when, and only when, a document mode other than the two-in-one copying mode is selected. The size of a document can be detected with use of the time duration set for the timer TP on the basis of the time interval between the points of time at which the leading and trailing edges of a document are detected by the travel sensor 506. Because, however, of the fact that a document of any size detected can be duplicated, the size of the document detected is used directly as the size of the document to be duplicated.

In each of the preferred embodiments of the present invention which has thus far been described, the document support table is used for both of the scanner-moved and document-moved scanning modes. During scanner-moved mode of scanning operation, the scanner units are driven to move back and forth below the document support table to scan the document fixedly placed on the table. During document-moved mode of scanning operation, the scanner units are fixedly held in place in the vicinity of the rightmost end of the document support table and scan the image on the document being moved at a fixed speed on the upper face of the table.

Such document scanning arrangements may however be substituted by the arrangement in which the document support table is used exclusively for the scanner-moved mode of scanning. In this modified form of duplicating apparatus according to the present invention, the document-moved scanning mode of operation is performed with use of an exposure window additionally provided in the vicinity of, for example, the left end of the table, though not shown in the drawings. During document-moved mode of scanning operation, the document to be duplicated is thus driven to move on this additional exposure window and is scanned by the scanner units moved to and held in position below the exposure window.

What is claimed is:

1. A scan-mode changeable image duplicating apparatus having a plurality of operational parameters and a plurality of modes of operation and operative to duplicate a document or documents in accordance with selected ones of the operations parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) control means for controlling said recirculating document handling means and said scanning means to operate either in a scanner-moved scanning mode in which said scanning means is driven to move with respect to said exposure position to scan a document fixedly held the exposure position or a document-moved scanning mode in which said scanning means is fixed with respect to the exposure position and scans a document being moved with respect to the exposure position, d) input means for entering desired ones of said operational parameters and said modes of operation, and e) selecting means responsive to the operational parameters and modes of operation entered by said input means for automatically selecting the scanning mode in which said control means is to control said recirculating document handling means and said scanning means, wherein said modes of operation include a mode of operation which is dominant for said scanner-moved scanning mode rather than said document-moved scanning mode and a mode of operation dominant for said document-moved scanning mode rather than said scanner-moved scanning mode.

2. A scan-mode changeable image duplicating apparatus as set forth in claim 1, in which said operational parameters include a quantity of printed outputs to be produced for a single document, and a reduction/magnification ratio for image reproducing.

3. A scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) control means for controlling said recirculating document handling means and said scanning means to operate either in a scanner-moved scanning mode in which said scanning means is driven to move with respect to said exposure position to scan a document fixedly held in the exposure position or a document-moved scanning mode in which said scanning means is fixed with respect to the exposure position and scans a document being moved with respect to the exposure position, d) first input means for entering an instruction to select a sorting mode, e) second means for entering a desired quantity of printed outputs to be produced for a single document, and f) selecting means for automatically selecting the scanner-moved scanning mode when an instruction to select the sorting mode is entered by said first input means and the quantity of printed outputs entered by said second input means is unity, and the document-moved scanning mode when an instruction to select the sorting mode is entered by said first input means and the quantity of printed outputs entered by said second input means is at least two.

4. A scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) control means for controlling said recirculating document handling means and said scanning means to operate either in a scanner-moved scanning mode in which said scanning means is driven to move with respect to said exposure position to scan a document fixedly held in the exposure position or a document-moved scanning mode in which said scanning means is fixed with respect to the exposure position and scans a document being moved with respect to the exposure position, d) first input means for entering an instruction to select a sorting mode, e) second means for entering a desired reduction/-magnification ratio for image reproducing, and f) selecting means for automatically selecting the scanner-moved scanning mode when an instruction to select the sorting mode is entered by said first input means and the reduction/magnification ratio entered by said second input means is a magnification ratio, and the document-moved scanning mode when an instruction to select the sorting mode is entered by said first input means and the reduction/magnification ratio entered by said second input means is a reduction ratio.

5. A scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) control means for controlling said recirculating document handling means and said scanning means to operate either in a scanner-moved scanning mode in which said scanning means is driven to move with respect to said exposure position to scan a document fixedly held in the exposure position or a document-moved scanning mode in which said scanning means is fixed with respect to the exposure position and scans a document being moved with respect to the exposure position, d) input means for entering information indicating that the document to be duplicated is a double-faced document bearing images on both faces thereof or a single-face document bearing images on a single face thereof, and e) selecting means for automatically selecting the scanner-moved scanning mode when the information indicating that the document to be duplicated is a double-faced document is entered by said input means.

6. A scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) intermediate sheet storage means for temporarily storing therein a document before the document is to be returned to the document storage tray after the document is once scanned by said scanning means, d) control means for controlling said recirculating document handling means and said scanning means to operate either in a scanner-moved scanning mode in which said scanning means is driven to move with respect to said exposure position to scan a document fixedly held in the exposure position or a document-moved scanning mode in which said scanning means is fixed with respect to the exposure position and scans a document being moved with respect to the exposure position, e) input means for entering an instruction to select a mode of operation using said intermediate sheet storage means, and f) selecting means for automatically selecting the scanner-moved scanning mode when the instruction to select a mode of operation using said intermediate sheet storage means is entered by said input means.

7. A scan-mode changeable image duplicating apparatus having a plurality of operational parameters and a plurality of modes of operation and operative to duplicate a document or documents in accordance with selected ones of the operational parameters and modes of operation, comprising a) recirculating document handling means having a single document storage tray and a passageway through which a document is to be withdrawn from the document storage tray and returned to the tray by way of an exposure position in which the document is to be scanned, b) scanning means for scanning a document in said exposure position, the scanning means being movable back and forth with respect to said exposure position, c) control means for controlling said recirculating document handling means and said scanning means to operate either in a scanner-moved scanning mode in which said scanning means is driven to move with respect to said exposure position to scan a document fixedly held in the exposure position or a document-moved scanning mode in which said scanning means is fixed with respect to the exposure position and scans a document being moved with respect to the exposure position, d) manual sheet feeding means for allowing the operator to manually feed a print sheet into the apparatus, and e) selecting means for automatically selecting the scanner-moved scanning mode when said manual sheet feeding means is activated.

* * * * *